US009858893B2

(12) United States Patent
Ahn

(10) Patent No.: US 9,858,893 B2
(45) Date of Patent: Jan. 2, 2018

(54) DISPLAY DEVICE AND METHOD FOR DRIVING THE SAME

(71) Applicant: LG Display Co., Ltd., Seoul (KR)

(72) Inventor: Ji-Young Ahn, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 91 days.

(21) Appl. No.: 14/930,992

(22) Filed: Nov. 3, 2015

(65) Prior Publication Data

US 2016/0055824 A1 Feb. 25, 2016

Related U.S. Application Data

(62) Division of application No. 13/856,560, filed on Apr. 4, 2013, now Pat. No. 9,236,025.

(30) Foreign Application Priority Data

Apr. 5, 2012 (KR) ..... 10-2012-0035623

(51) Int. Cl.

| | |
|---|---|
| ***G09G 5/10*** | (2006.01) |
| ***G09G 5/02*** | (2006.01) |
| ***G09G 3/36*** | (2006.01) |

(52) U.S. Cl.

CPC ..... *G09G 5/10* (2013.01); *G09G 3/3607* (2013.01); *G09G 3/3648* (2013.01); *G09G 5/02* (2013.01);

(Continued)

(58) Field of Classification Search

CPC ..... G09G 3/3648; G09G 2300/0426; G09G 2310/0218; G09G 2330/021; G09G 5/02

(Continued)

(56) References Cited

U.S. PATENT DOCUMENTS 5,822,264 A 10/1998 Tomishima
6,317,109 B1 11/2001 Lee (Continued)

FOREIGN PATENT DOCUMENTS

CN 1941057 A 4/2007
CN 100375143 C 3/2008

(Continued)

OTHER PUBLICATIONS

Office Action issued in counterpart Korean Patent Application No. 10-2012-0035623 dated Dec. 27, 2013.

(Continued)

*Primary Examiner* — Prabodh M Dharia

(74) *Attorney, Agent, or Firm* — Morgan, Lewis & Bockius LLP

(57) ABSTRACT

A display device capable of displaying a standby screen on a display panel with various colors in a standby mode, and a method for controlling the same are disclosed. The display device includes a display panel including pixels, gate lines and data lines connected to the pixels and a common line connected to the pixels, a gate switching unit for connecting the gate lines in response to an external standby mode signal, a data switching unit for grouping the data lines in response to the standby mode signal and connecting the data lines belonging to the same group, and a standby mode driving unit for driving the gate lines in response to the standby mode signal and driving the data lines of at least one group and the common line so as to generate a potential difference between the data lines of the group and the common line.

22 Claims, 32 Drawing Sheets

(52) U.S. Cl.
CPC ..... *G09G 2300/0426* (2013.01); *G09G 2300/0452* (2013.01); *G09G 2310/0218* (2013.01); *G09G 2310/0289* (2013.01); *G09G 2320/0626* (2013.01); *G09G 2330/021* (2013.01)

(58) Field of Classification Search
USPC ... 345/1.1, 1.3, 48, 211, 212, 589, 690–692; 315/169.3; 349/151; 365/222
See application file for complete search history.

(56) References Cited

U.S. PATENT DOCUMENTS

| | | | | |
|---|---|---|---|---|
| 7,532,296 | B2 | 5/2009 | An et al. | |
| 7,864,134 | B2 | 1/2011 | Kim et al. | |
| 8,358,258 | B1 | 1/2013 | Fan | |
| 8,390,536 | B2 | 3/2013 | Troccooli et al. | |
| 8,570,258 | B2 | 10/2013 | Park et al. | |
| 2002/0054036 | A1 | 5/2002 | Johnson et al. | |
| 2002/0063674 | A1* | 5/2002 | Chiang | G09G 3/2011 345/98 |
| 2003/0107564 | A1* | 6/2003 | Miyazawa | G09G 3/3648 345/204 |
| 2004/0130520 | A1 | 7/2004 | Maeda et al. | |
| 2004/0130544 | A1 | 7/2004 | Sun | |
| 2004/0160404 | A1* | 8/2004 | Nakajima | G09G 3/2011 345/96 |
| 2005/0140566 | A1* | 6/2005 | Kim | G06F 3/1431 345/1.1 |
| 2005/0200788 | A1* | 9/2005 | Edwards | G09G 3/3648 349/139 |
| 2005/0253778 | A1 | 11/2005 | Ku et al. | |
| 2005/0270412 | A1 | 12/2005 | Kamon | |
| 2006/0007092 | A1 | 1/2006 | Sekiguchi | |
| 2006/0008148 | A1 | 1/2006 | Mochizuki | |
| 2006/0017683 | A1 | 1/2006 | Murase | |
| 2006/0215007 | A1 | 9/2006 | Silverbrook | |
| 2006/0232533 | A1* | 10/2006 | Miyazawa | G09G 3/3648 345/88 |
| 2006/0244691 | A1* | 11/2006 | Lee | G09G 3/3233 345/76 |
| 2006/0262059 | A1* | 11/2006 | Hashimoto | G09G 3/3685 345/89 |
| 2007/0046884 | A1 | 3/2007 | An et al. | |
| 2007/0057883 | A1 | 3/2007 | Cho et al. | |
| 2007/0063991 | A1 | 3/2007 | Lee et al. | |
| 2008/0136338 | A1 | 6/2008 | Troccooli et al. | |
| 2008/0225033 | A1 | 9/2008 | Hector | |
| 2009/0015768 | A1* | 1/2009 | Igeta | G02F 1/133512 349/106 |
| 2009/0102991 | A1* | 4/2009 | Chen | G09G 3/3614 349/33 |
| 2009/0244426 | A1* | 10/2009 | Hasegawa | G09G 3/3659 349/48 |
| 2009/0251404 | A1 | 10/2009 | Hwang et al. | |
| 2010/0085375 | A1 | 4/2010 | Chung et al. | |
| 2010/0156965 | A1 | 6/2010 | Kim et al. | |
| 2010/0253644 | A1 | 10/2010 | Lee et al. | |
| 2011/0025677 | A1 | 2/2011 | Park et al. | |
| 2011/0032231 | A1 | 2/2011 | Maruyama | |
| 2011/0128272 | A1* | 6/2011 | Chen | G09G 3/3614 345/211 |
| 2011/0157460 | A1* | 6/2011 | Kim | H04N 5/232 348/372 |
| 2011/0193852 | A1* | 8/2011 | Lee | G02F 1/133555 345/213 |
| 2012/0001950 | A1 | 1/2012 | Kim | |
| 2012/0139886 | A1* | 6/2012 | Lee | G09G 3/3677 345/209 |
| 2012/0154369 | A1 | 6/2012 | Yamauchi | |
| 2014/0168036 | A1* | 6/2014 | Kubota | G09G 3/003 345/80 |

FOREIGN PATENT DOCUMENTS

| | | | |
|---|---|---|---|
| CN | 101551566 | A | 10/2009 |
| CN | 102314830 | A | 1/2012 |
| KR | 10-2002-0084085 | A | 11/2002 |
| KR | 10-2007-0057504 | A | 6/2007 |
| KR | 10-0782456 | B1 | 12/2007 |
| WO | 03/094141 | A1 | 11/2003 |

OTHER PUBLICATIONS

Office Action issued in counterpart Korean Patent Application No. 10-2012-0035623 dated Jul. 22, 2013.
Office Action dated Jan. 29, 2015, issued by the State Intellectual Property Office of China in Chinese Patent Application No. 201310118997.6.

* cited by examiner

| SBMS | DL-R | DL-G | DL-B | CL |
|---|---|---|---|---|
| 000 | DPS1_SB | DPS2_SB | DPS2_SB | DPS2_SB |
| 001 | DPS2_SB | DPS1_SB | DPS2_SB | DPS2_SB |
| 010 | DPS2_SB | DPS2_SB | DPS1_SB | DPS2_SB |

DISPLAY DEVICE AND METHOD FOR DRIVING THE SAME

This application is a divisional of U.S. patent application Ser. No. 13/856,560, filed on Apr. 4, 2013, which claims the benefit of Korean Patent Application No. 10-2012-0035623, filed on Apr. 5, 2012, the entire disclosure of each of which is hereby incorporated by reference as if fully set forth herein.

BACKGROUND OF THE INVENTION

Field of the Invention

The present invention relates to a display device, and more particularly, to a display device capable of displaying a standby screen on a display panel with various colors in a standby mode, and a method for controlling the same.

Discussion of the Related Art

A conventional display device displays only a black image in a standby mode. Accordingly, the color of a standby screen displayed on a conventional display device rarely matches an environment in which the display device is mounted. In particular, if a large display device is mounted on a wall, the display device makes the wall black, thus has poor aesthetics.

In order to solve the above-described problems of the conventional display device and to decorate the interior, a method of repeatedly displaying a predetermined image for a long time has been proposed like an electronic picture frame. However, as the size of the display device is increased, power consumption of the display device is increased.

SUMMARY OF THE INVENTION

Accordingly, the present invention is directed to a display device and a method for driving the same that substantially obviates one or more problems due to limitations and disadvantages of the related art.

An object of the present invention is to provide a display device capable of displaying various standby screens with minimal power in a standby mode and a method for driving the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a display device includes a display panel including a plurality of pixels, a plurality of gate lines and a plurality of data lines connected to the pixels and a common line connected to the pixels, a gate switching unit for connecting the gate lines to each other in response to an external standby mode signal, a data switching unit for grouping the plurality of data lines into a plurality of groups in response to the standby mode signal and connecting the data lines belonging to the same group to each other, and a standby mode driving unit for driving the gate lines in response to the standby mode signal and driving the data lines of at least one of the groups and the common line so as to generate a potential difference between the data lines of the group and the common line.

In response to the standby mode signal, the standby mode driving unit may supply a standby driving signal to the gate lines, supply any one of a first standby display signal and a second standby display signal having different levels to the data lines of each group, and supply any one of the first standby display signal and the second standby display signal to the common line so as to generate the potential difference between the data lines of at least one of the groups and the common line.

The standby driving signal and the first standby display signal may be constant voltage signals and the second standby display signal may be an alternating current (AC) voltage signal periodically and alternately having a high voltage and a low voltage.

The first standby display signal may have a value between the high voltage and the low voltage.

In order to enable the data lines of a group which receives the first standby display signal to be in a floating state after a predetermined time, the standby mode driving unit may further perform an operation for breaking an electrical connection between the data lines of the group and the standby mode driving unit after the predetermined time.

The data switching unit may group the data lines into a plurality of groups based on the colors of the pixels connected to the data lines.

The pixels may be divided into a red pixel, a green pixel and a blue pixel, pixels each having any one color of red, green and blue may be connected to each data line, and the data switching unit may group the data lines connected to the pixels having the same color into one group.

The data lines may include a plurality of red data lines to which the red pixels are connected, a plurality of green data lines to which the green pixels are connected and a plurality of blue data lines to which the blue pixels are connected, and the data switching unit may group the plurality of red data lines into a first group, group the plurality of green data lines into a second group and group the plurality of blue data lines into a third group.

The pixels may be divided into a red pixel, a green pixel and a blue pixel, pixels each having two or more colors of red, green and blue may be connected to each data line, and the data switching unit groups the data lines connected to the pixels having the same color combination into one group.

The data lines may include a plurality of red/blue data lines to which the red and blue pixels are connected, a plurality of green/red data lines to which the green and red pixels are connected and a plurality of blue/green data lines to which the blue and green pixels are connected, and the data switching unit may group the plurality of red/blue data lines into a first group, group the plurality of plurality of green/red data lines into a second group and group the plurality of blue/green data lines into a third group.

The gate switching unit may include a plurality of gate switching elements connected between adjacent gate lines, and a gate switch controller for turning all the gate switching elements on in response to the standby mode signal.

The data switching unit may include a plurality of data switching elements connected between adjacent data lines in the same group, and a data switch controller for turning all the data switching elements of each group on in response to the standby mode signal.

The standby mode driving unit may select standby display signals to be supplied to each group and the common line based on a value of the standby mode signal.

The standby mode driving unit may further include a look-up table in which information about standby display signals to be supplied to each group and the common line according to the value of the standby mode signal is registered, and the standby mode driving unit may select standby display signals to be supplied to each group and the common line based on information corresponding to the value of the standby mode signal.

In response to the standby mode signal, the data switching unit may further perform at least one of an operation for connecting at least two groups so as to connect the data lines included in the at least two groups to each other, and an operation for connecting the data lines of at least one group and the common line.

The data switching unit may include a plurality of line switching elements connected between adjacent data lines in the same group, a line switch controller for turning all the line switching elements of each group on in response to the standby mode signal, a plurality of group switching elements connected between the data lines of different groups, a plurality of common switching elements connected between any one data line of each group and the common line, and a group switch controller for individually controlling operations of the plurality of group switching elements and common switching elements based on the value of the standby mode signal.

The display device may, further include a mode controller for outputting any one of the standby mode signal and a display mode signal according to an external control signal or predefined settings.

The display device may further include a timing controller for rearranging the data signals from an external system and outputting the data signals according to timings in response to the display mode signal from the mode controller, a gate driver for sequentially applying scan pulse to the plurality of gate lines in response to the display mode signal from the mode controller, a data driver for converting the data signals from the timing controller into analog signals in response to the display mode signal from the mode controller and supplying the analog signals to the data lines, and a DC-DC converter for supplying a common voltage to the common electrode in response to the display mode signal from the mode controller. When the standby mode signal from the mode controller is supplied to the timing controller, the gate driver, the data driver and the DC-DC converter, operations of the timing controller, the gate driver, the data driver and the DC-DC converter may be stopped.

The display device may further include a gate connection controller connected between gate output terminals of the gate driver for outputting the scan pulses and the gate lines, and a data connection controller connected between data output terminals of the data driver for outputting the data signals and the data lines. The gate connection controller may electrically disconnect the gate output terminals and the gate lines in response to the standby mode signal from the mode controller, and the data connection controller may electrically disconnect the data output terminals and the data lines in response to the standby mode signal from the mode controller.

When the display mode signal from the mode controller is supplied to the gate switching unit, the data switching unit and the standby mode driving unit, operations of the gate switching unit, the data switching unit and the standby mode driving unit may be stopped.

In response to the standby mode signal, the standby mode driving unit may supply a standby driving signal to the gate lines, enable the data lines of at least one group to be in a floating state, and supply a standby display signal to the data lines of the groups other than the at least one group and the common line so as to generate the potential difference between the data lines of the at least one group and the common line.

The display device may further include a backlight unit for providing light to the display panel, and an intensity sensor for sensing intensity of external light. The backlight unit may select light having luminance lower than a predetermined reference value in response to the standby mode signal, and the backlight unit may determine whether light having low luminance or light having lower luminance is emitted based on the result sensed by the intensity sensor.

In another aspect of the present invention, a display device includes a display panel including a plurality of pixels, a plurality of gate lines and a plurality of data lines connected to the pixels, a first common line connected to some of the plurality of pixels and a second common line connected to the remaining pixels, a gate switching unit for connecting the gate lines to each other in response to an external standby mode signal, a data switching unit for grouping the plurality of data lines into a plurality of groups in response to the standby mode signal and connecting the data lines belonging to the same group to each other, and a standby mode driving unit for driving the gate lines in response to the standby mode signal and driving the data lines of the groups, the first common line and the second common line so as to generate a potential difference between the data lines of at least one of the groups and at least one common line.

In response to the standby mode signal, the standby mode driving unit may supply a standby driving signal to the gate lines, supply any one of a first standby display signal and a second standby display signal having different levels to the data lines of each group, and supply any one of the first standby display signal and the second standby display signal to the first and second common lines so as to generate the potential difference between the data lines of at least one of the groups and the at least one common line.

The standby driving signal and the first standby display signal may be constant voltage signals and the second standby display signal may be an AC voltage signal periodically and alternately having a high voltage and a low voltage.

The first standby display signal may have a value between the high voltage and the low voltage.

In order to enable the data lines of a group which receives the first standby display signal to be in a floating state after a predetermined time, the standby mode driving unit may further perform an operation for breaking an electrical connection between the data lines of the group and the standby mode driving unit after the predetermined time.

The pixels may be divided into a red pixel, a green pixel and a blue pixel, pixels each having two or more colors of red, green and blue may be connected to each data line, and the data switching unit may group the data lines connected to the pixels having the same color combination into one group.

The data lines may include a plurality of red/blue data lines to which the red and blue pixels are connected, a plurality of green/red data lines to which the green and red pixels are connected and a plurality of blue/green data lines to which the blue and green pixels are connected, and the data switching unit may group the plurality of red/blue data lines into a first group, group the plurality of plurality of green/red data lines into a second group and group the plurality of blue/green data lines into a third group.

In response to the standby mode signal, the data switching unit may further perform at least one of an operation for connecting at least two groups so as to connect the data lines included in the at least two groups to each other, and an operation for connecting the data lines of at least one group and at least one of the first and second common lines.

The data switching unit may include a plurality of line switching elements connected between adjacent data lines in the same group, a line switch controller for turning all the line switching elements of each group on in response to the standby mode signal, a plurality of group switching elements connected between the data lines of different groups, a plurality of first common switching elements connected between any one data line of each group and the first common line, a plurality of second common switching elements connected between any one data line of each group and the second common line, and a group switch controller for individually controlling operations of the plurality of group switching elements and first and second common switching elements based on the value of the standby mode signal.

The first common line may be connected to pixels connected to odd numbered gate lines, the second common line may be connected to pixels connected to even numbered gate lines, and the standby mode driving unit may apply different signals to the first common line and the second common line.

In response to the standby mode signal, the standby mode driving unit may supply a standby driving signal to the gate lines, enable the data lines of at least one group to be in a floating state, and supply a standby display signal to the data lines of the groups other than the at least one group and the at least one common line so as to generate the potential difference between the data lines of the at least one group and the at least one common line.

In another aspect of the present invention, a display device includes a display panel including a plurality of pixels, a plurality of gate lines and a plurality of data lines connected to the pixels, a plurality of common lines formed between adjacent data lines and connected to the pixels, a gate switching unit for connecting the gate lines to each other in response to an external standby mode signal, a data switching unit for grouping the plurality of data lines into a plurality of groups in response to the standby mode signal and connecting the data lines belonging to the same group to each other, and a standby mode driving unit for driving the gate lines in response to the standby mode signal and driving the data lines of the groups and the common lines so as to generate a potential difference between the data lines of at least one of the groups and at least one common line.

In response to the standby mode signal, the standby mode driving unit may supply a standby driving signal to the gate lines, supply any one of a first standby display signal and a second standby display signal having different levels to the data lines of each group, and supply any one of the first standby display signal and the second standby display signal to the common lines so as to generate the potential difference between the data lines of at least one of the groups and the at least one common line.

The standby driving signal and the first standby display signal may be constant voltage signals and the second standby display signal may be an AC voltage signal periodically and alternately having a high voltage and a low voltage.

The first standby display signal may have a value between the high voltage and the low voltage.

In order to enable the data lines of a group which receives the first standby display signal to be in a floating state after a predetermined time, the standby mode driving unit may further perform an operation for breaking an electrical connection between the data lines of the group and the standby mode driving unit after the predetermined time.

The pixels may be divided into a red pixel, a green pixel and a blue pixel, pixels each having two or more colors of red, green and blue may be connected to each data line, and the data switching unit groups the data lines connected to the pixels having the same color combination into one group.

The data lines may include a plurality of red/blue data lines to which the red and blue pixels are connected, a plurality of green/red data lines to which the green and red pixels are connected and a plurality of blue/green data lines to which the blue and green pixels are connected, and the data switching unit may group the plurality of red/blue data lines into a first group, group the plurality of plurality of green/red data lines into a second group and group the plurality of blue/green data lines into a third group.

The plurality of common lines may include a first common line formed between the red/blue data line and the green/red data line and connected to red pixels, a second common line formed between the green/red data line and the blue/green data line and connected to green pixels, and a third common line formed between the blue/green data line and the red/blue data line and connected to blue pixels.

The standby mode driving unit may supply at least one of the first and second standby display signals to the first common line, the second common line and the third common line in response to the standby mode signal.

In response to the standby mode signal, the data switching unit may further perform at least one of an operation for connecting at least two groups so as to connect the data lines included in the at least two groups to each other, and an operation for connecting the data lines of at least one group and at least one of the first, second and third common lines.

The data switching unit may include a plurality of line switching elements connected between adjacent data lines in the same group, a line switch controller for turning all the line switching elements of each group on in response to the standby mode signal, a plurality of group switching elements connected between the data lines of different groups, a plurality of first common switching elements connected between any one data line of each group and the first common line, a plurality of second common switching elements connected between any one data line of each group and the second common line, a plurality of third common switching elements connected between any one data line of each group and the third common line, and a group switch controller for individually controlling operation of the plurality of group switching elements and first common switching elements, the second common switching elements and the third common switching elements based on the value of the standby mode signal.

In response to the standby mode signal, the standby mode driving unit may supply a standby driving signal to the gate lines, enable the data lines of at least one group to be in a floating state, and supply a standby display signal to the data lines of the groups other than the at least one group and the at least one common line so as to generate the potential difference between the data lines of the at least one group and the at least one common line.

The standby driving signal and the first standby display signal may be the same, and the display device may further include a line connection control switching element for connecting any one gate line, to which the standby driving signal is applied, and any one data line, to which the first standby display signal is applied, to each other in response to the standby mode signal.

In another aspect of the present invention, a display device includes a display panel including a plurality of pixels, a plurality of gate lines and a plurality of data lines connected to the pixels and a common line connected to the pixels, a gate driver for sequentially driving the plurality of gate lines in response to an external standby mode signal, a data switching unit for grouping the plurality of data lines into a plurality of groups in response to the standby mode signal and connecting the data lines belonging to the same group to each other, and a standby mode driving unit for driving the data lines of the groups and the common line in response to the standby mode signal so as to generate a potential difference between the data lines of at least one of the groups and the common line.

The standby mode driving unit may further generate a gate high voltage and a gate low voltage and the gate high voltage and the gate low voltage may be supplied to the gate driver.

In another aspect of the present invention, a method for driving a display device includes the steps of A) preparing a display panel including a plurality of pixels, a plurality of gate lines and a plurality of data lines connected to the pixels and a common line connected to the pixels, B) connecting the gate lines to each other in response to an external standby mode signal, C) grouping the plurality of data lines into a plurality of groups in response to the standby mode signal and connecting the data lines belonging to the same group to each other, and D) driving the gate lines in response to the standby mode signal and driving the data lines of at least one of the groups and the common line so as to generate a potential difference between the data lines of the group and the common line.

The step D) may include supplying a standby driving signal to the gate lines, supplying any one of a first standby display signal and a second standby display signal having different levels to the data lines of each group, and supplying any one of the first standby display signal and the second standby display signal to the common line so as to generate the potential difference between the data lines of at least one of the groups and the common line.

The standby driving signal and the first standby display signal may be constant voltage signals and the second standby display signal may be an alternating current (AC) voltage signal periodically and alternately having a high voltage and a low voltage.

The first standby display signal may have a value between the high voltage and the low voltage.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
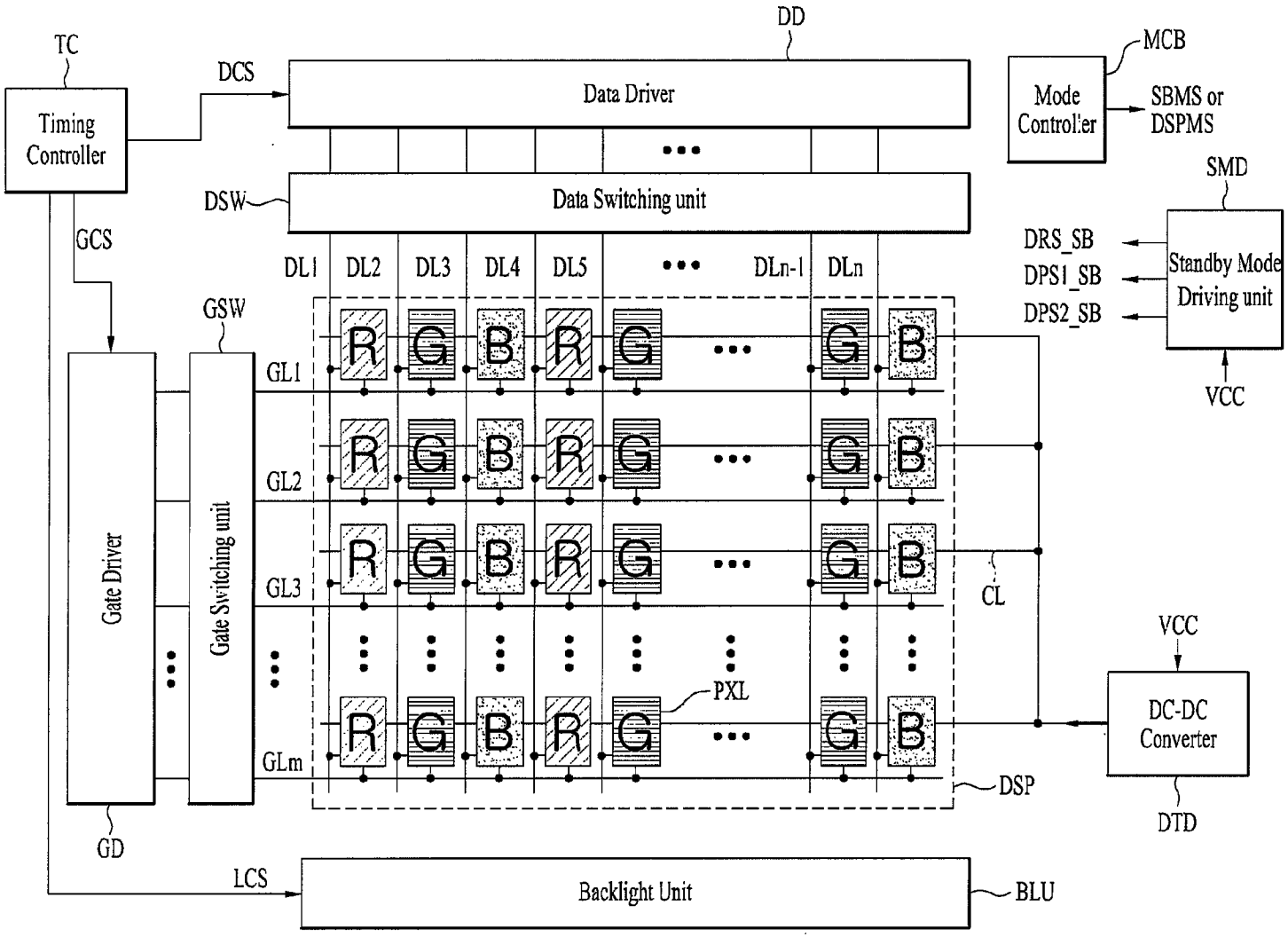
FIG. 1 is a diagram showing the configuration of a display device according to a first embodiment of the present invention.

FIG. 1 is a diagram showing the configuration of a display device according to a first embodiment of the present invention.

The display device according to the first embodiment of the present invention includes a mode controller MCB, a display panel DSP, a timing controller TC, a gate driver GD, a data driver DD, a DC-DC converter DTD, a backlight unit BLU, a gate switching unit GSW, a data switching unit DSW and a standby mode driving unit SMD, as shown in FIG. 1.

The display device according to the present invention may operate in any one of a display mode and a standby mode. The operation of the display device is controlled by the mode controller MCB.

The mode controller MCB outputs any one of a display mode signal DSPMS and a standby mode signal SBMS according to predefined settings or an external control signal. For example, the mode controller MCB may output any one of the display mode signal DSPMS and the standby mode signal SBMS according a remote control signal from a remote controller. Alternatively, the mode controller MCB may output any one of the display mode signal DSPMS and the standby mode signal SBMS if a predefined time is reached.

If the mode controller MCB selects and outputs the display mode signal DSPMS, the display device displays an image on a screen of the display panel DSP based on image data provided by a system (not shown). If the mode controller MCB selects and outputs the standby mode signal SBMS, the display device displays a predetermined standby screen on the display panel DSP. That is, if the standby mode signal SBMS is output from the mode controller MCB, the display device displays the standby screen on the display panel DSP regardless of the image data from the system. At this time, the value of the standby mode signal SBMS may be variously set. If a plurality of standby screens is prepared according to set value, a standby screen with various colors may be displayed on the display panel DSP according to the value of the standby mode signal SBMS.

The signal (the display mode signal DSPMS or the standby mode signal SBMS) output from the mode controller MCB is simultaneously supplied to the timing controller TC, the gate driver GD, the data driver DD, the DC-DC converter DTD, the gate switching unit GSW, the data switching unit DSW, the standby mode driving unit SMD and the backlight unit BLU. At this time, if the signal output from the mode controller MCB is a display mode signal DSPMS, the timing controller TC, the gate driver GD, the data driver DD, the DC-DC converter DTD and the backlight unit LBU normally operate. If the signal output from the mode controller MCB is a standby mode signal SBMS, operations of the timing controller TC, the gate driver GD, the data driver DD and the DC-DC converter DTD and the backlight unit LBU are stopped. In response to the standby mode signal SBMS, the backlight unit BLU emits light darker than light emitted in a display mode.

The display panel DSP includes a plurality of pixels PXL, a plurality of gate lines GL1 to GLm for transmitting a variety of signals necessary to display an image at the pixels PXL, a plurality of data lines DL1 to DLn, and a common line CL for transmitting a common voltage to a common electrode. The gate lines GL1 to GLm and the data lines DL1 to DLn are arranged to cross each other and a portion of the common line CL is parallel to the gate lines. The common line CL is commonly connected to the common electrode of all the pixels PXL.

The pixels are arranged on the display panel DSP in a matrix. n pixels PXL are arranged on each horizontal line. The pixels PXL include a red pixel R for displaying red, a green pixel G for displaying green and a blue pixel B for displaying blue. At this time, a red pixel R, a green pixel G and a blue pixel B connected to the same gate line and adjacently located in a horizontal direction form one unit pixel. This unit pixel mixes a red image, a green image and a blue image to display one unit image. Each pixel PXL may include a thin film transistor, a pixel electrode, a common electrode and a liquid crystal layer interposed therebetween. The configuration of one pixel included in the display panel DSP of FIG. 1 will now be described in detail.

Figure 2:
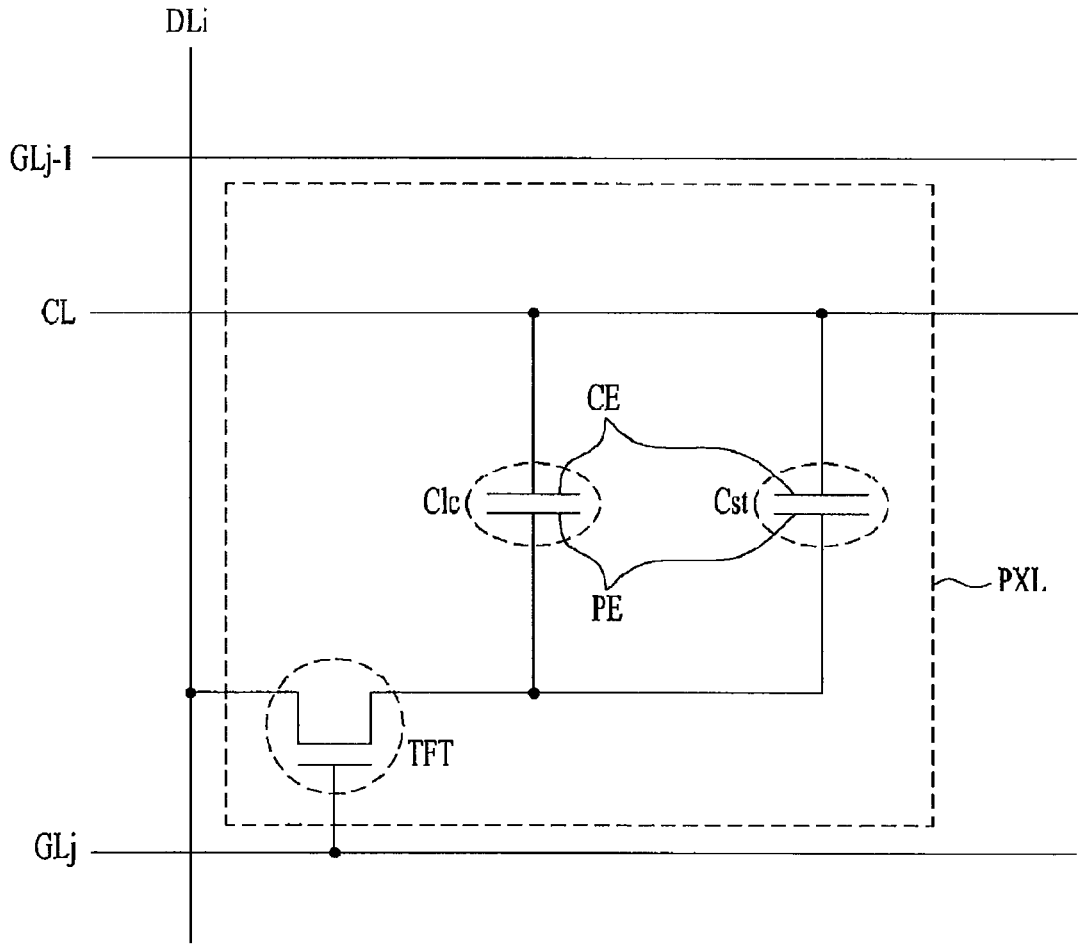
FIG. 2 is a diagram showing the configuration of any one pixel of FIG. 1.

FIG. 2 is a diagram showing the configuration of any one pixel of FIG. 1.

One pixel PXL includes a thin film transistor TFT, a liquid crystal capacitor Clc and a subsidiary storage capacitor Cst.

The thin film transistor TFT sends a data voltage (analog image data) from a data line DLi to a pixel PXL in response to a scan pulse from a gate line GLj.

The liquid crystal capacitor Clc stores a data voltage received from the thin film transistor TFT during a period of one frame. The liquid crystal capacitor Clc includes a liquid crystal layer and a pixel electrode PE and common electrode. The pixel electrode and common electrode face each other with the liquid crystal layer interposed therebetween. The pixel electrode PE is connected to a source electrode of the thin film transistor TFT and the common electrode CE is connected to the common line CL. The data voltage received from the thin film transistor TFT is applied to the pixel electrode PE and is held by the liquid crystal capacitor Clc.

The subsidiary storage capacitor Cst is formed in order to stably hold the data voltage stored by the liquid crystal capacitor Clc during a period of one frame. The subsidiary storage capacitor Cst includes a portion of the pixel electrode PE, a portion of the common electrode CE and a liquid crystal layer interposed between the portion of the pixel electrode and the portion of the common electrode. That is, the subsidiary storage capacitor Cst is formed in a portion in which the portion of the pixel electrode PE and the portion of the common electrode CE overlap. The data voltage applied to the pixel electrode PE is stably held by the subsidiary storage capacitor Cst during a period of one frame.

The subsidiary storage capacitor Cst may include an insulating layer (not shown) and a pixel electrode PE and a gate line Glj−1 of a previous stage which face each other with the insulating layer interposed therebetween. That is, the subsidiary storage capacitor Cst is formed in a portion in which a portion of the pixel electrode PE and a portion of the gate line GLj−1 of the previous stage overlap. The data voltage applied to the pixel electrode PE is stably held by the subsidiary storage capacitor Cst during a period of one frame.

The other pixels of FIG. 1 have the same configuration as FIG. 2.

The timing controller TC operates as follows in the display mode. That is, the timing controller TC receives a horizontal synchronization signal, a vertical synchronization signal and a clock pulse signal from a system and generates a data control signal DCS and a gate control signal GCS using the received signals. The generated data control signal DCS is supplied to the data driver DD, and the gate control signal GCS is supplied to the gate driver GD. The timing controller TC receives and aligns image data from the system and supplies the aligned image data to the data driver DD according to predetermined timings. The timing controller TC stops the above-described operation in the standby mode.

The data control signal DCS includes a source clock pulse signal, a source start pulse signal, a source output enable signal and a polarization reverse signal.

The gate control signal GCS includes a gate start pulse, a gate shift clock signal and a gate output enable signal.

The gate driver GD operates as follows in the display mode. That is, the gate driver GD sequentially generates scan pulses according to the gate control signal GCS and sequentially supplies the generated scan pulses to m gate lines GL1 to GLm. Then, the pixels connected to the gate lines are sequentially driven in horizontal line units. The gate driver GD stops the above-described operations in the standby mode.

The data driver DD operates as follows in the above-described display mode. That is, the data driver DD converts the image data from the timing controller TC into analog signals according to the data control signal DCS and supplies the image data of one horizontal line to all n data lines in every horizontal period in which one gate line is driven. The data driver DD stops the above-described operations in the standby mode.

The DC-DC converter DTD operates as follows in the above-described display mode. That is, the DC-DC converter DTD increases or decreases a power supply voltage VCC received from a power supply of the system via a connector (not shown) and generates voltages necessary for the display panel DSP. That is, the DC-DC converter DTD generates a reference voltage, a gamma reference voltage, a common voltage, a gate high voltage and a gate low voltage using the power supply voltage VCC. The gamma reference voltage is generated by dividing a reference voltage. The reference voltage and the gamma reference voltage are analog gamma voltages and are supplied to the data driver DD. The common voltage is supplied to the common electrode CE formed on the display panel DSP via the data driver DD. The common voltage is an alternating current (AC) voltage periodically having a high voltage and a low voltage. The period of this common voltage may be set to a period of two frames, and each of a period in which a high voltage is held and a period in which a low voltage is held are set to a period of one frame. The gate voltage is a high logic voltage of a scan pulse set to a threshold voltage or more of the thin film transistor and is supplied to the gate driver GD and the gate low voltage is a low logic voltage of a scan pulse set to an off voltage of the thin film transistor and is supplied to the gate driver GD.

The DC-DC converter DTD includes an output switch element for switching an output voltage of an output terminal and a pulse width modulator (PWM) or a pulse frequency modulator (PFM) for controlling a duty ratio or frequency of a control signal of the output switch element to increase or decrease the output voltage. The pulse width modulator increases the duty ratio of the control signal of the output switch element to increase the output voltage of the DC-DC converter DTD or decreases the duty ratio of the control signal of the output switch element to decrease the output voltage of the DC-DC converter DTD.

The pulse frequency modulator increases the frequency of the control signal of the output switch element to increase the output voltage of the DC-DC converter DTD or decreases the frequency of the control signal of the output switch element to decrease the output voltage of the DC-DC converter DTD.

The DC-DC converter DTD stops the above-described operations in the standby mode.

The backlight unit BLU operates as follows in the above-described display mode. That is, the backlight unit BLU provides light to the display panel DSP in response to a light source control signal LCS from the timing controller TC. The intensity of the light may be controlled according to the value of the light source control signal LCS. In the standby mode, the backlight unit BLU emits light having intensity lower than that of light emitted in the display mode. That is, the backlight unit BLU emits light having predetermined intensity in response to the standby mode signal SBMS. The light having the predetermined intensity is darker than light emitted in the display mode.

The timing controller TC, the gate driver GD, the data driver DD and the DC-DC converter DTD perform the above-described operation according to the display mode signal DSPMS while The timing controller TC, the gate driver GD, the data driver DD and the DC-DC converter stop the above-described operation according to the standby mode signal SEMS.

The gate switching unit GSW, the data switching unit DSW and the standby mode driving unit SMD perform a substantial operation in the standby mode, which will now be described in detail.

The gate switching unit GSW connects all the gate lines GL1 to GLm to each other in the standby mode. Then, all the gate lines GL1 to GLm are connected. In other words, the gate switching unit GSW combines all the gate lines GL1 to GLm in response to the standby mode signal SBMS. The gate switching unit GSW separates the combined gate lines GL1 to GLm to become an original state in response to the display mode signal DSPMS.

The data switching unit DSW groups all the data lines DL1 to DLn into predetermined groups in the standby mode. In other words, the data switching unit DSW groups all the data lines DL1 to DLn into a plurality of groups and connects data lines belonging to the same group to each other, in response to the standby mode signal SBMS.

At this time, the data switching unit DSW may group all the data lines DL1 to DLn to a plurality of groups based on the colors of the pixels PXL connected to the data line. That is, as shown in FIG. 1, a pixel R, G or B having any one of red, green and blue is connected to each of the data lines DL1 to DLn and the data switching unit DSW may group data lines, to which the pixels having the same color are connected, into one group. For example, as shown in FIG. 1, when the data lines DL1 to DLn include a plurality of red data lines DL1, DL4, DL7, . . . , to which the red pixels R are connected, a plurality of green data lines DL2, DL5, DL8, . . . , to which the green pixels G are connected, and a plurality of blue data lines DL3, DL6, DL9, . . . , to which the blue pixels B are connected, the data switching unit DSW may group the data lines DL1 to DLn into three groups. More specifically, the data switching unit DSW may group the plurality of red data lines DL1, DL4, DL7, . . . into a first group, the plurality of green data lines DL2, DL5, DL8, . . . into a second group, and the plurality of blue data lines DL3, DL6, DL9, . . . into a third group. In this case, the data switching unit DSW may combine the plurality of red data lines DL1, DL4, DL7, . . . of the first group, combine the plurality of green data lines DL2, DL5, DL8, . . . of the second group, and combine the plurality of blue data lines DL3, DL6, DL9, . . . of the third group.

In FIG. 1, (3p+1)-th (p being a natural number including 0) data lines correspond to the red data lines, (3p+2)-th data lines correspond to the green data lines, and (3p+3)-th data lines correspond to the blue data lines.

The data switching unit DSW separates the combined data lines to become an original state in response to the display mode signal DSPMS.

The standby mode driving unit SMD drives not only the gate lines GL1 to GLm but also the data lines DL1 to DLn in the standby mode. That is, the standby mode driving unit SMD drives the gate lines GL1 to GLm in response to the standby mode signal SBMS, and drives the data lines of the groups and the common line CL so as to generate a potential difference between the data line of at least one of the groups and the common line CL.

The standby mode driving unit SMD increases or decreases the power supply voltage VCC received from the power supply of the system and generates a standby driving signal DRS_SB, a first standby display signal DPS1_SB and a second standby display signal DPS2_SB. The standby mode driving unit SMD supplies the standby driving signal DRS_SB to the combined gate lines GL1 to GLm. At this time, the standby mode driving unit SMD may apply the standby driving signal DRS_SB to any one of the combined gate lines, selectively apply the standby driving signal DRS_SB to some of the combined gate lines or simultaneously apply the standby driving signal DRS_SB to all the combined gate lines. The standby mode driving unit SMD supplies any one of the first standby display signal DPS1_SB and the second standby display signal DPS2_SB having different levels to the data lines of each group. The standby mode driving unit SMD supplies any one of the first standby display signal DPS1_SB and the second standby display signal DPS2_SB to the common line CL so as to generate a potential voltage between the data line of at least one of the groups and the common line CL. The standby driving signal DRS_SB is a constant voltage signal having a constant level and may be a gate high voltage of the above-described scan pulse. The standby driving signal DRS_SB may be set to a voltage less than the gate high voltage. At this time, this voltage must have a level for turning a thin film transistor TFT on. By setting the level of the standby driving signal DRS_SB to the smallest level in a range satisfying the above condition (the turn-on condition of the thin film transistor), it is possible to further reduce power consumption.

The first standby display signal DPS1_SB is also a constant voltage signal similarly to the standby driving signal DPS_SB. In contrast, the second standby display signal DPS2_SB is an AC voltage signal. The first and second standby display signals DPS1_SB and DPS2_SB will be described in detail with reference to FIG. 3.

Figure 3:
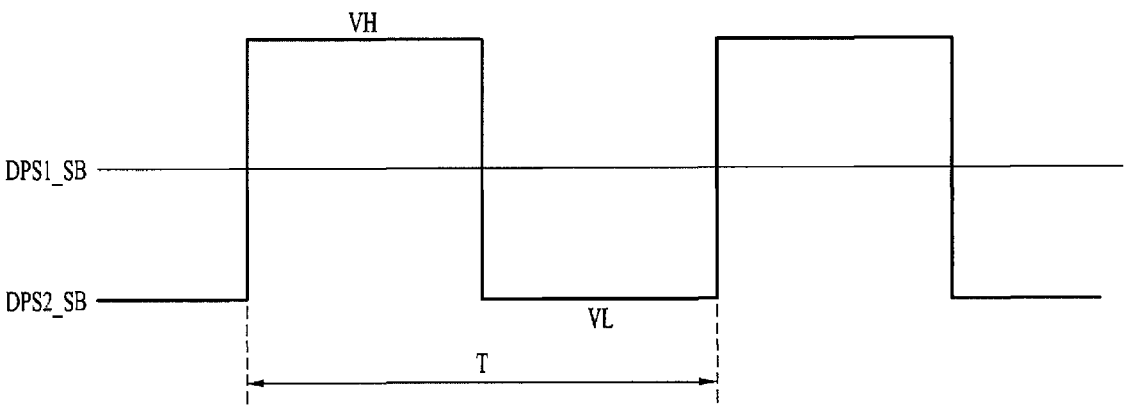
FIG. 3 is a diagram showing the waveform of a first standby display signal and a second standby display signal generated by a standby mode driving unit.

FIG. 3 is a diagram showing the waveform of the first standby display signal DPS1_SB and the second standby display signal DPS2_SB generated by the standby mode driving unit SMD. As shown in FIG. 3, the first standby display signal DPS1_SB is a constant voltage signal but the second standby display signal DPS2_SB is an AC voltage signal periodically and alternately having a high voltage and a low voltage. At this time, the first standby display signal DPS1_SB may have a value between a high voltage VH and a low voltage VL. For example, the first standby display signal DPS1_SB may have a value corresponding to ½ of the amplitude of the second standby display signal DPS2_SB. The period T of the second standby display signal DPS2_SB may be set to be greater or less than the period T of the common voltage output from the DC-DC converter DTD. The period T of the second standby display signal DPS2_SB may be equal to the period T of the common voltage output from the DC-DC converter DTD. For example, the second standby display signal DPS2_SB may be changed to periodically have a plurality of high voltages and a plurality of low voltages in a period of one frame. The second standby display signal DPS2_SB may be output such that the high voltage is held during a period of several frames and the low voltage is held during a period of several frames.

The second standby display signal DPS2_SB is periodically changed to the high voltage VH and the low voltage VL on the basis of the first standby display signal DPS1_SB, in order to periodically charge the liquid crystal capacitor Clc. A charging rate is increased as the frequency of the second standby display signal DPS2_SB is increased, and power consumption reduction is improved as the frequency of the second standby display signal DPS2_SB is decreased. By setting the level of the first and second standby display signals DPS1_SB and DPS2_SB to the smallest level in a range for displaying the standby screen of the display device, it is possible to further reduce power consumption.

In the present invention, the data lines are grouped into a plurality of groups in the standby mode, the data lines belonging to the same group are connected, and the data line and the common line CL are driven so as to generate the potential voltage between the data line of at least one group and the common line CL, thereby displaying the standby screen having various colors on the display panel DSP in the standby mode. Accordingly, according to the present invention, it is possible to display a color matching an environment in which the display device is mounted.

Some components included in the display device according to the first embodiment of the present invention may have the detailed configuration as follows.

Figure 4:
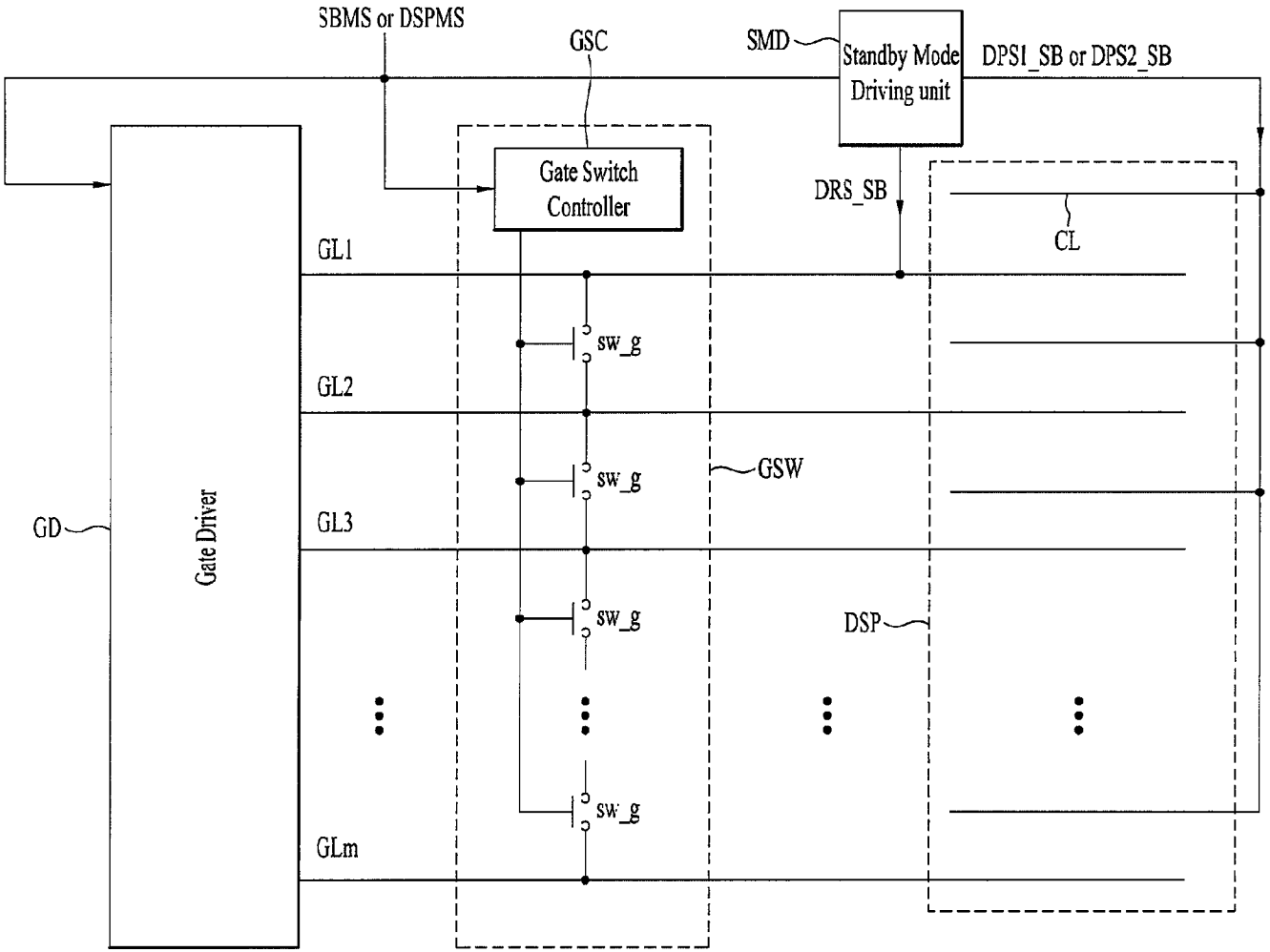
FIG. 4 is a diagram showing the detailed configuration of a gate switching unit of FIG. 1.

FIG. 4 is a diagram showing the detailed configuration of the gate switching unit GSW of FIG. 1.

The gate switching unit GSW includes a plurality of gate switching elements sw_g and a gate switch controller GSC as shown in FIG. 4.

The gate switching elements sw_g are connected between adjacent gate lines.

The gate switching unit GSW turns all the gate switching elements sw_g on in response to the standby mode signal SBMS. That is, the gate switch controller GSC generates a turn-on signal in response to the standby mode signal SBMS and simultaneously supplies the turn-on signal to all the gate switching elements sw_g. The turn-on signal may be a constant voltage or a pulse voltage set to a threshold voltage or more of the gate switching element sw_g. The turned-on gate switching element sw_g connects the adjacent gate lines. Accordingly, if all the gate switching elements sw_g are turned on, all the gate lines GL1 to GLm are connected.

The gate switch controller GSC turns all the gate switching elements sw_g off in response to the display mode signal DSPMS. The gate switch controller GSC simultaneously supplies a turn-off signal to all the gate switching elements sw_g in response to the display mode signal DSPMS. This turn-off signal may be a constant voltage or a pulse voltage which is set to be less than the threshold voltage of the gate switching element sw_g.

Figure 5:
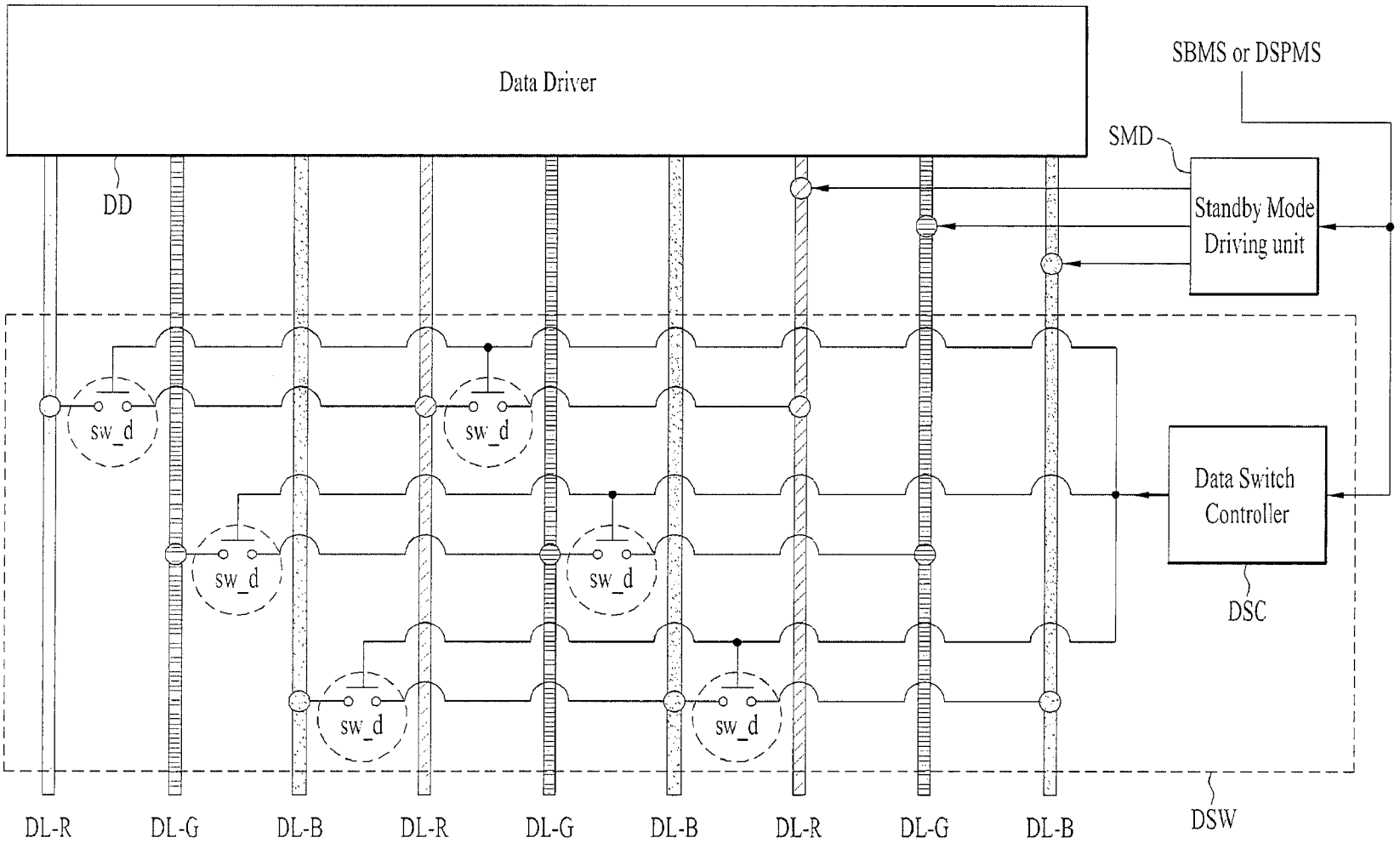
FIG. 5 is a diagram showing the detailed configuration of a data switching unit of FIG. 1.

FIG. 5 is a diagram showing the detailed configuration of the data switching unit DSW of FIG. 1.

The data switching unit DSW includes a plurality of data switching elements sw_d and a data switch controller DSC, as shown in FIG. 5.

The data switching elements sw_d are connected between adjacent data lines in the same group. The data switching elements sw_d may be grouped into three groups. For example, as shown in FIG. 5, the data switching elements sw_d may be divided into data switching elements sw_d connected between adjacent red data lines DL-R, data switching elements sw_d connected between adjacent green data lines DL-G and data switching elements sw_d connected between adjacent blue data lines DL-B.

The data switch controller DSC turns all the data switching elements sw_d on in response to the standby mode signal SBMS. That is, the data switch controller DSC generates a turn-on signal in response to the standby mode signal SBMS and simultaneously supplies the turn-on signal to all the data switching elements sw_d. This turn-on signal may be a constant voltage or a pulse voltage which is set to a threshold voltage or more of the data switching element sw_d. The turned-on data switching elements sw_d connect adjacent data lines in the same group. Accordingly, if all the data switching elements sw_d are turned on, the data lines belonging to the same groups are connected.

The data switch controller DSC turns all the data switching elements sw_d off in response to the display mode signal DSPMS. The data switch controller DSC simultaneously supplies the turn-off signal to all the data switching elements sw_d in response to the display mode signal DSPMS. The turn-off signal may be a constant voltage or a pulse voltage which is set to be less than a threshold voltage of the data switching element sw_d.

Figure 6:
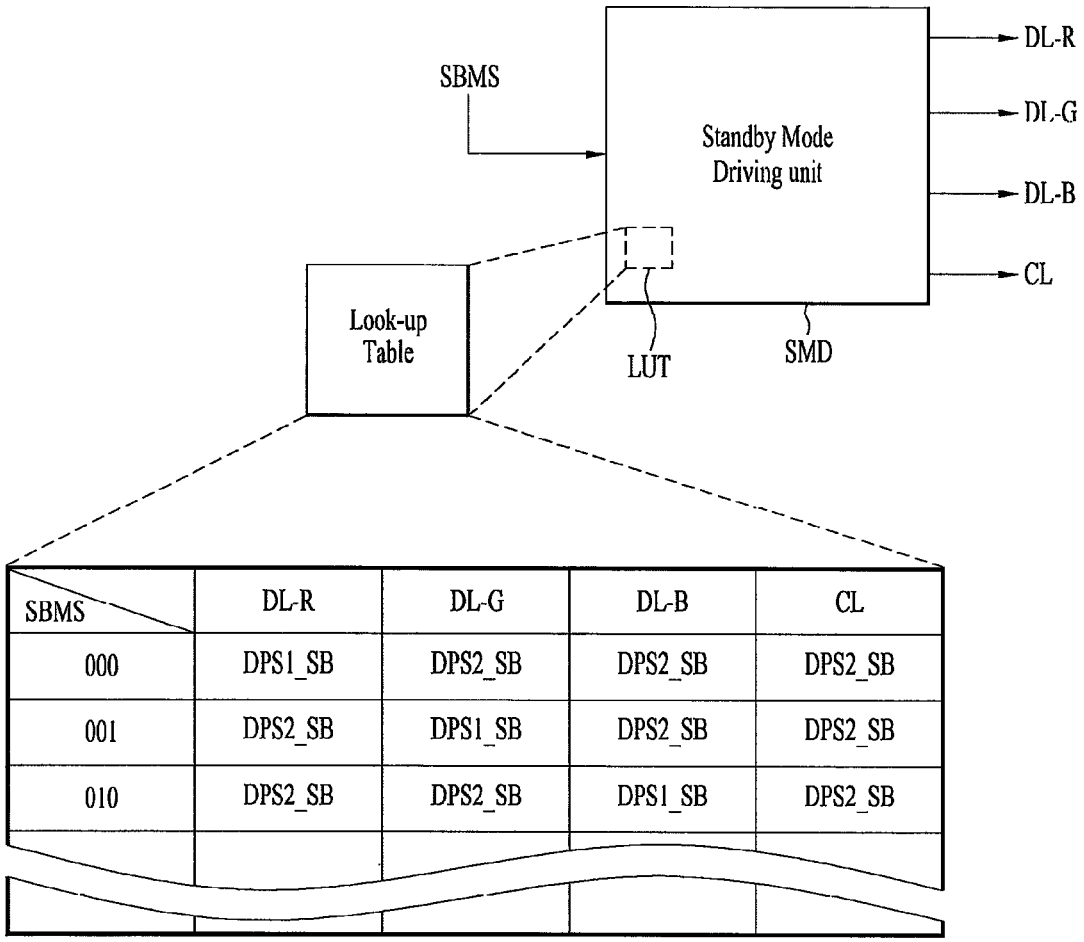
FIG. 6 is a diagram of the detailed configuration of the standby mode driving unit of FIG. 1.

FIG. 6 is a diagram of the detailed configuration of the standby mode driving unit SMD of FIG. 1.

The standby mode driving unit SMD may select standby display signals to be supplied to each group and the common line CL based on the value of the standby mode signal SEMS. The standby mode driving unit SMD may further include a look-up table LUT as shown in FIG. 6. In the look-up table LUT, information about the standby display signal to be supplied to a predetermined group and the common line CL according to the value of the standby mode signal SBMS is registered.

The standby mode driving unit SMD selects standby display signals to be supplied to each group and the common line CL based on information corresponding to the value of the standby mode signal SBMS. This standby mode signal SBMS may be k-bit digital data (k being a natural number). For example, as shown in the table of FIG. 6, if the standby mode signal SBMS is a 3-bit digital signal, the standby mode signal SBMS may have a total of eight binary values. As an example, if the standby mode signal SBMS has a binary value of "000", as shown in the table of FIG. 6, the standby mode driving unit SMD operates such that the first standby display signal DPS1_SB is applied to the red data line DL-R, the second standby display signal DPS2_SB is applied to the green data line DL-G, the second standby display signal DPS2_SB is applied to the blue data line DL-B, and the second standby display signal DPS2_SB is applied to the common line CL.

If the standby mode signal SBMS has a binary value of "001", as shown in the table of FIG. 6, the standby mode driving unit SMD operates such that the second standby display signal DPS2_SB is applied to the red data line DL-R, the first standby display signal DPS1_SB is applied to the green data line DL-G, the second standby display signal DPS2_SB is applied to the blue data line DL-B, and the second standby display signal DPS2_SB is applied to the common line CL.

If the selected signals are applied from the standby mode driving unit SMD to the data lines DL-R, DL-G and DL-B and the common electrode CE, only pixels connected to the data lines having a potential difference with the common electrode CE display a color having specific brightness according to the potential difference. In contrast, the other pixels connected to the remaining data lines having the same potential as the common electrode CE display black or white. If the display device of the present invention is a normally black type display device, the pixels connected to the remaining data lines having the same potential as the common electrode CE display black. Accordingly, a standby screen having the color of the specific brightness may be displayed on the screen of the display panel DSP in the standby mode.

Hereinafter, an example of displaying a standby screen having various colors using the display device according to the first embodiment of the present invention will be described in detail.

Figure 7A:
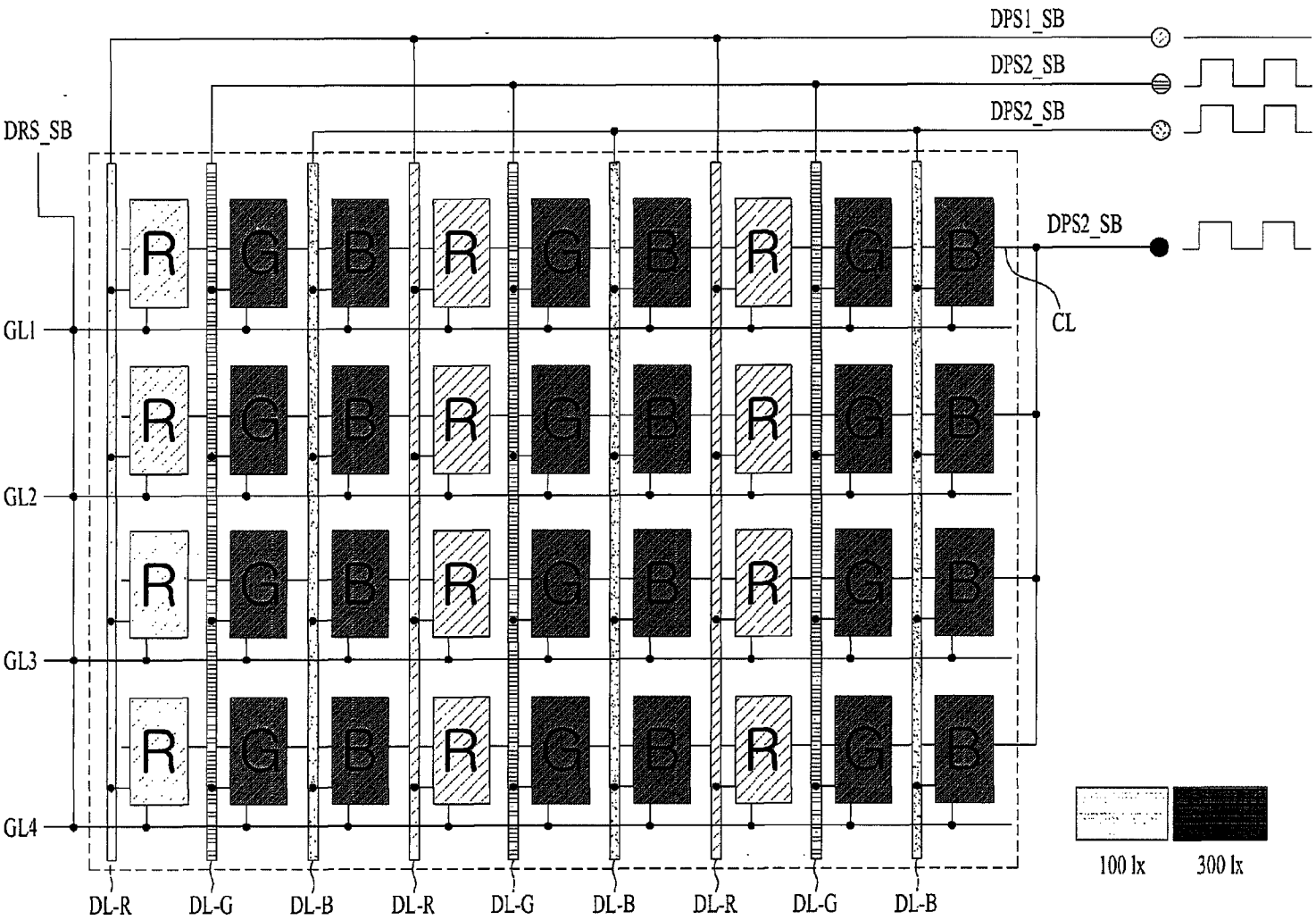
FIGS. 7A to 7C are diagrams illustrating a color implementation method of a standby screen according to the first embodiment of the present invention.
Figure 7B:
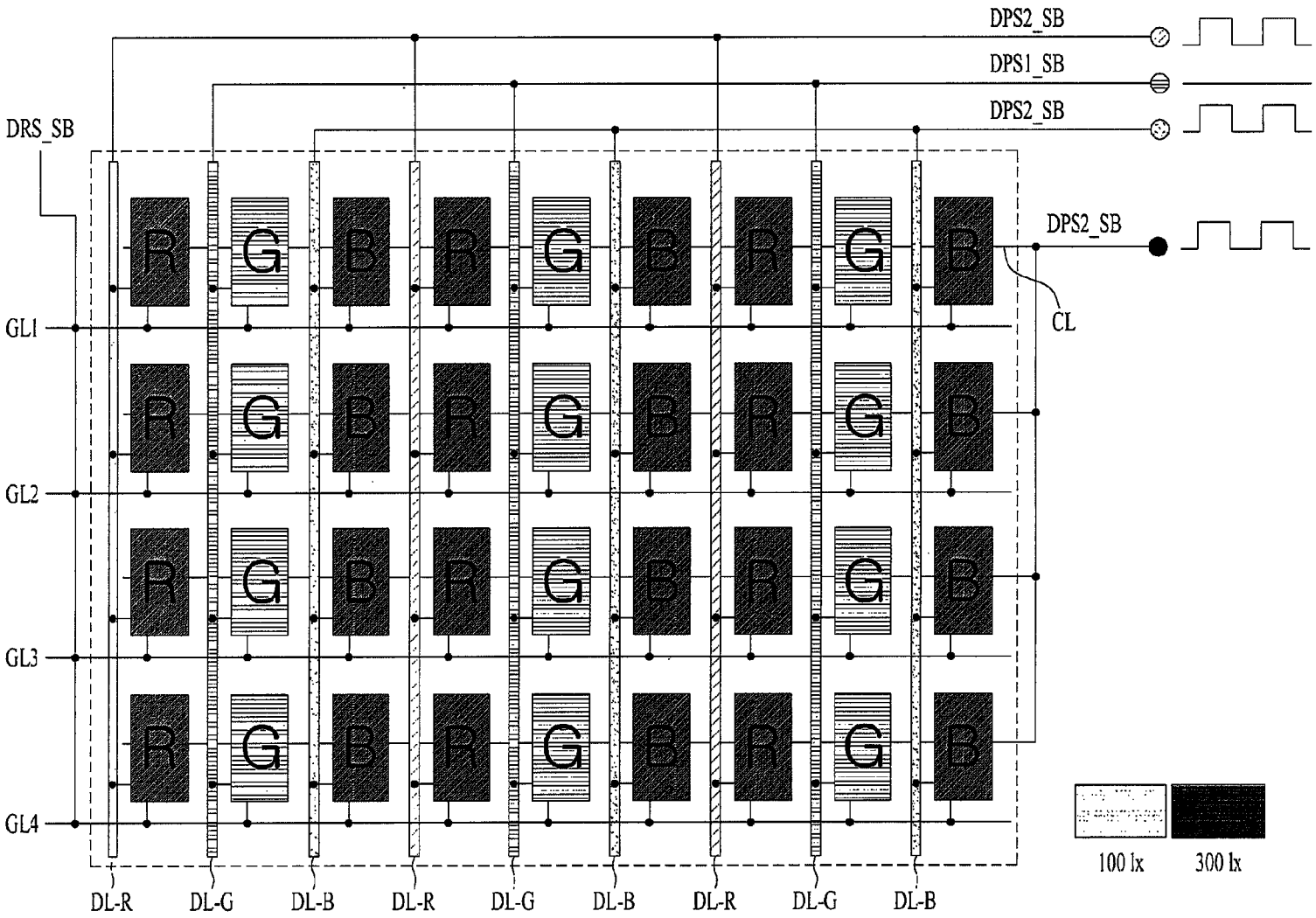
Figure 7C:
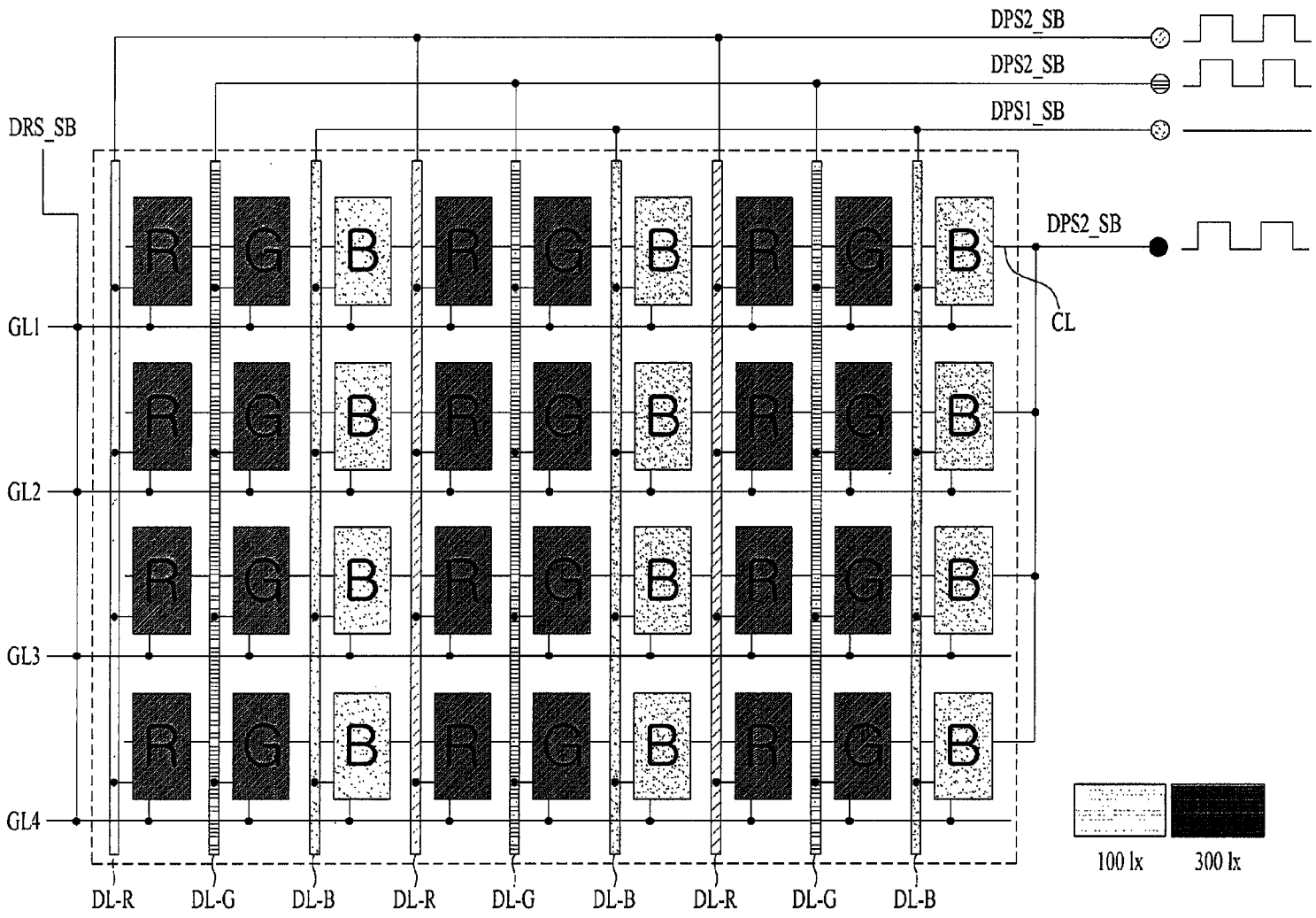

FIGS. 7A to 7C are diagrams illustrating a color implementation method of a standby screen according to the first embodiment of the present invention. Assume that the display device of the present invention is a normally black type display device as described above.

First, referring to FIG. 7A, the first standby display signal DPS1_SB is supplied to any one of the combined red data lines DL-R, the second standby display signal DPS2_SB is supplied to any one of the combined green data lines DL-G, the second standby display signal DPS2_SB is supplied to any one of the combined blue data line DL-B, and the second standby display signal DPS2_SB is supplied to the common line CL. In this case, since the data lines having a potential difference with the common line CL are only the red data lines DL-R, only the red pixels R connected to the red data lines DL-R display red having specific brightness according to the potential difference. In contrast, the green pixels G connected to the green data lines DL-G having the same potential as the common line CL and the blue pixels B connected to the blue data lines DL-B having the same potential as the common line CL display black. Accordingly, as shown in FIG. 7A, a red standby screen may be displayed on the screen of the display panel DSP in the standby mode. That is, standby screens having such a color are shown in one side of FIG. 7A. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

Next, referring to FIG. 7B, the second standby display signal DPS2_SB is supplied to any one of the combined red data lines DL-R, the first standby display signal DPS1_SB is supplied to any one of the combined green data lines DL-G, the second standby display signal DPS2_SB is supplied to any one of the combined blue data line DL-B, and the second standby display signal DPS2_SB is supplied to the common line CL. In this case, since the data lines having a potential difference with the common line CL are only the green data lines DL-G, only the green pixels G connected to the green data lines DL-G display green having specific brightness according to the potential difference. In contrast, the red pixels R connected to the red data lines DL-R having the same potential as the common line CL and the blue pixels B connected to the blue data lines DL-B having the same potential as the common line CL display black. Accordingly, as shown in FIG. 7B, a green standby screen may be displayed on the screen of the display panel DSP in the standby mode. That is, standby screens having such a color are shown in one side of FIG. 7B. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

Subsequently, referring to FIG. 7C, the second standby display signal DPS2_SB is supplied to any one of the combined red data lines DL-R, the second standby display signal DPS2_SB is supplied to any one of the combined green data lines DL-G, the first standby display signal DPS1_SB is supplied to any one of the combined blue data line DL-B, and the second standby display signal DPS2_SB is supplied to the common line CL. In this case, since data lines having a potential difference with the common line CL are only the blue data lines DL-B, only the blue pixels B connected to the blue data lines DL-B display blue having specific brightness according to the potential difference. In contrast, the red pixels R connected to the red data lines DL-R having the same potential as the common line CL and the green pixels G connected to the green data lines DL-G having the same potential as the common line CL display black. Accordingly, as shown in FIG. 7C, a blue standby screen may be displayed on the screen of the display panel DSP in the standby mode. That is, standby screens having such a color are shown in one side of FIG. 7C. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

By applying the first standby display signal DPS1_SB and the second standby display signal DPS2_SB to each group and the common line CL (that is, the common electrode CE) by combinations different from the examples shown in FIGS. 7*a* to 7*c*, it is possible to display a standby screen with another color. For example, by supplying the first standby display signal DPS1_SB to the red data lines DL-R instead of the second standby display signal DPS2_SB in FIG. 7C, it is possible to display a mixed color of red and blue.

Figure 8:
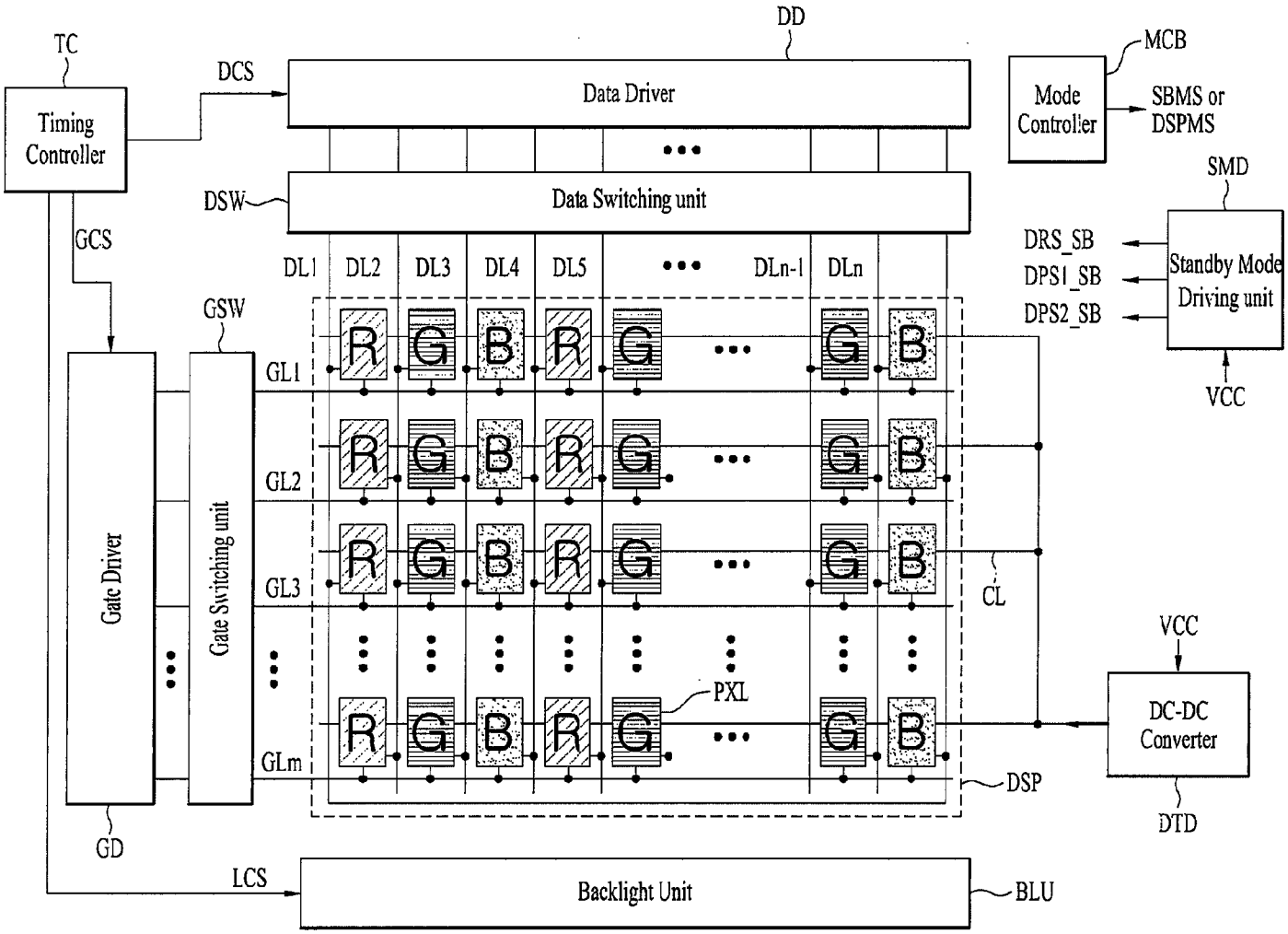
FIG. 8 is a diagram showing the configuration of a display device according to a second embodiment of the present invention.

FIG. 8 is a diagram showing the configuration of a display device according to a second embodiment of the present invention.

The display device according to the second embodiment of the present invention includes a mode controller MCB, a display panel DSP, a timing controller TC, a gate driver GD, a data driver DD, a DC-DC converter DTD, a backlight unit BLU, a gate switching unit GSW, a data switching unit DSW and a standby mode driving unit SMD, as shown in FIG. 8.

The mode controller MCB, the timing controller TC, the gate driver GD, the data driver DD, the DC-DC converter DTD, the backlight unit BLU, the gate switching unit GSW and the standby mode driving unit SMD according to the second embodiment of the present invention are equal to those of the first embodiment and thus a description thereof will be omitted.

The display panel DSP according to the second embodiment of the present invention includes a plurality of pixels PXL, a plurality of gate lines GL1 to GLm for transmitting a variety of signals necessary to display an image at the pixels PXL, a plurality of data lines DL1 to DLn, and a common line CL for transmitting a common voltage to a common electrode CE, as shown in FIG. 8. The gate lines GL1 to GLm and the data lines DL1 to DLn are arranged to cross each other and a portion of the common line CL is parallel to the gate lines. The common line CL is commonly connected to the common electrode CE of all the pixels PXL.

The pixels PXL are arranged on the display panel DSP in a matrix. n pixels PXL are arranged on each horizontal line. The pixels PXL include a red pixel R for displaying red, a green pixel G for displaying green and a blue pixel B for displaying blue. At this time, a red pixel R, a green pixel G and a blue pixel B connected to the same gate line and adjacently located in a horizontal direction form one unit pixel. This unit pixel mixes a red image, a green image and a blue image to display one unit image. Each pixel PXL may include a thin film transistor, a pixel electrode, a common electrode CE and a liquid crystal layer interposed therebetween. The configuration of one pixel PXL included in the display panel DSP of FIG. 8 is equal to the configuration of FIG. 2.

Pixels having different colors are connected to one data line on the display panel DSP in a zigzag form according to the second embodiment of the present invention. For example, a red pixel R and a blue pixel B are alternately connected to the first data line DL1 of FIG. 8 in a zigzag form along the longitudinal direction of the first data line DL1. Similarly, green pixels G and red pixels R are connected to the second data line DL2 in a zigzag form and blue pixels B and green pixels G are connected to the third data line DL3 in a zigzag form.

The data lines DL1 to DLn are grouped into predetermined groups by the data switching unit DSW. The data switching unit DSW connects the data lines belonging to the same group.

At this time, the data switching unit DSW may group all the data lines DL1 to DLn into a plurality of groups based on the colors of the pixels PXL connected to the data line. That is, as shown in FIG. 8, pixels having two colors among red, green and blue are connected to each data line in a zigzag form and the data switching unit DSW may group data lines, to which the pixels having the same color combination are connected, into one group. For example, as shown in FIG. 8, when the data lines DL1 to DLn include a plurality of red/blue data lines DL1, DL4, DL7, . . . , to which the red and blue pixels R and B are connected, a plurality of green/red data lines DL2, DL5, DL8, . . . , to which the green and red pixels G and R are connected, and a plurality of blue/green data lines DL3, DL6, DL9, . . . , to which the blue and green pixels B and G are connected, the data switching unit DSW may group the data lines DL1 to DLn into three groups. More specifically, the data switching unit DSW may group the plurality of red/blue data lines DL1, DL4, DL7, . . . into a first group, the plurality of green/red data lines DL2, DL5, DL8, . . . into a second group, and the plurality of blue/green data lines DL3, DL6, DL9, . . . into a third group. In this case, the data switching unit DSW may combine the plurality of red/blue data lines DL1, DL4, DL7, . . . of the first group, the plurality of green/red data lines DL2, DL5, DL8, . . . of the second group, and the plurality of blue/green data lines DL3, DL6, DL9, . . . of the third group.

In FIG. 8, (3p+1)-th (p being a natural number including 0) data lines correspond to the red/blue data lines, (3p+2)-th data lines correspond to the green/red data lines, and (3p+3)-th data lines correspond to the blue/green data lines.

Hereinafter, an example of displaying a standby screen having various colors using the display device according to the second embodiment of the present invention will be described in detail.

FIGS. 9*a* to 9*h* are diagrams illustrating a color implementation method of a standby screen according to a second embodiment of the present invention. Assume that the display device of the present invention is a normally black type display device as described above.

Figure 9A:
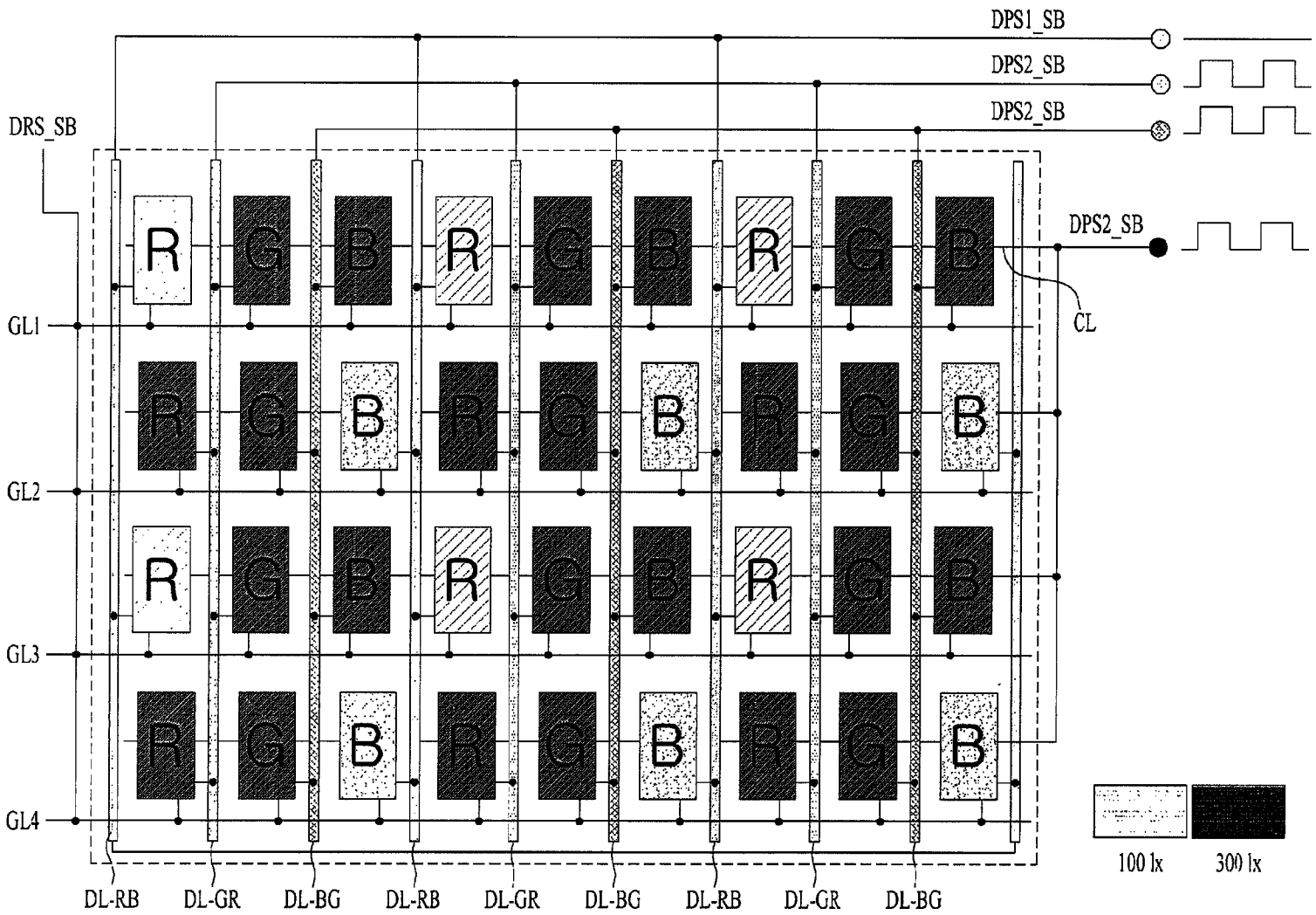
FIGS. 9*a* to 9*h* are diagrams illustrating a color implementation method of a standby screen according to the second embodiment of the present invention.

First, referring to FIG. 9A, the first standby display signal DPS1_SB is supplied to any one of the combined red/blue data lines DL-RB, the second standby display signal DPS2_SB is supplied to any one of the combined green/red data lines DL-GR, the second standby display signal DPS2_SB is supplied to any one of the combined blue/green data lines DL-BG, and the second standby display signal DPS2_SB is supplied to the common line CL. In this case, since the data lines having a potential difference with the common line CL are only the red/blue data lines DL-RB, only the red and blue pixels R and B connected to the red/blue data lines DL-RB display red and blue having specific brightness according to the potential difference. In contrast, the green and red pixels G and R connected to the green/red data lines DL-GR having the same potential as the common line CL and the blue and green pixels B and G connected to the blue/green data lines DL-BG having the same potential as the common line CL display black. Accordingly, as shown in FIG. 9A, a standby screen having a mixed color of red and blue may be displayed on the screen of the display panel DSP in the standby mode. That is, standby screens having such a color are shown at one side of FIG. 9A. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

Figure 9B:
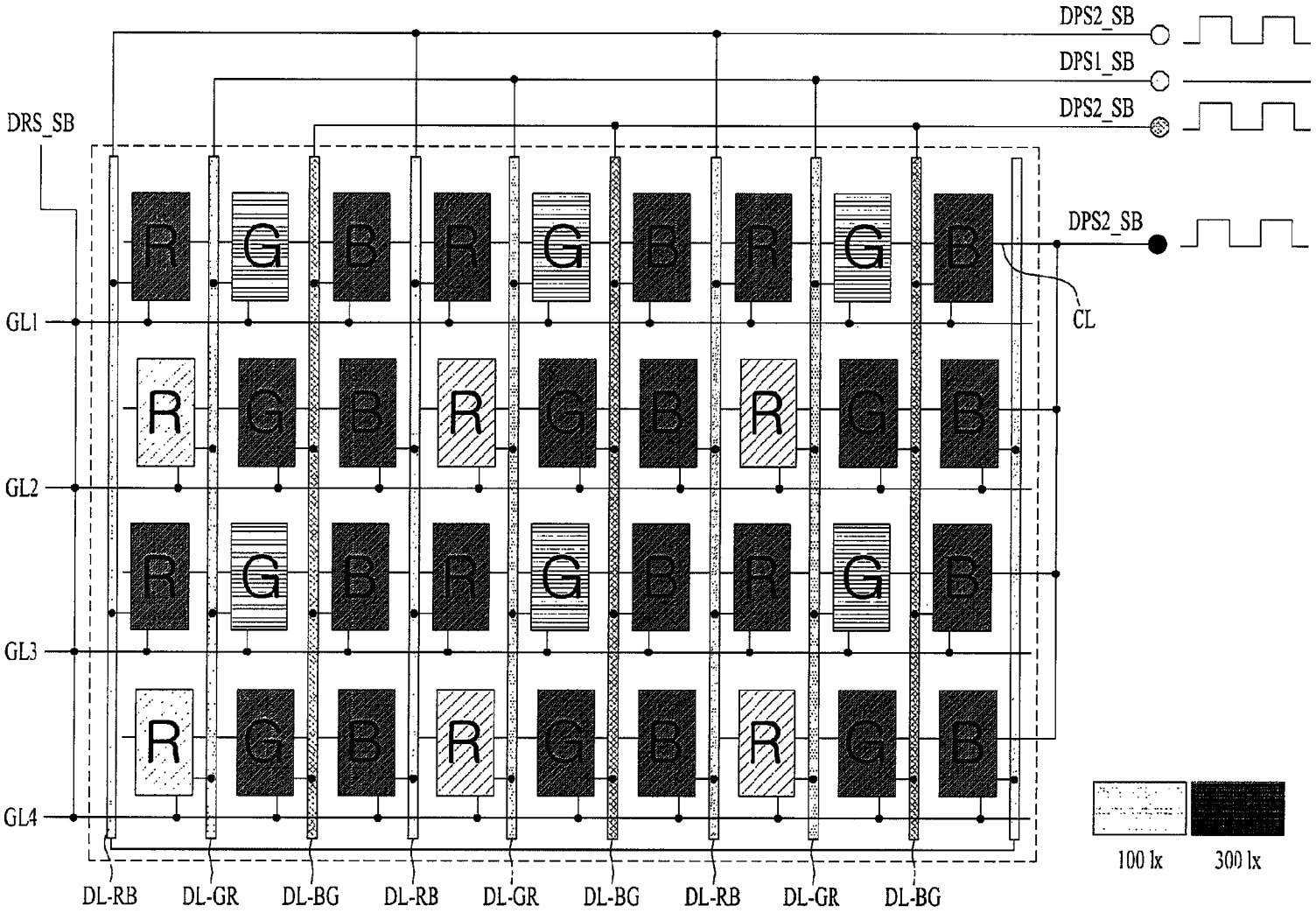

Next, referring to FIG. 9B, the second standby display signal DPS2_SB is supplied to any one of the combined red/blue data lines DL-RB, the first standby display signal DPS1_SB is supplied to any one of the combined green/red data lines DL-GR, the second standby display signal DPS2_SB is supplied to any one of the combined blue/green data lines DL-BG, and the second standby display signal DPS2_SB is supplied to the common line CL. In this case, since the data lines having a potential difference with the common line CL are only the green/red data lines DL-GR, only the green and red pixels G and R connected to the green/red data lines DL-RB display green and red having specific brightness according to the potential difference. In contrast, the red and blue pixels R and B connected to the red/blue data lines DL-RB having the same potential as the common line CL and the blue and green pixels B and G connected to the blue data lines DL-BG having the same potential as the common line CL display black. Accordingly, as shown in FIG. 9B, a standby screen having a mixed color of green and red may be displayed on the screen of the display panel DSP in the standby mode. That is, standby screens having such a color are shown in one side of FIG. 9B. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

Figure 9C:
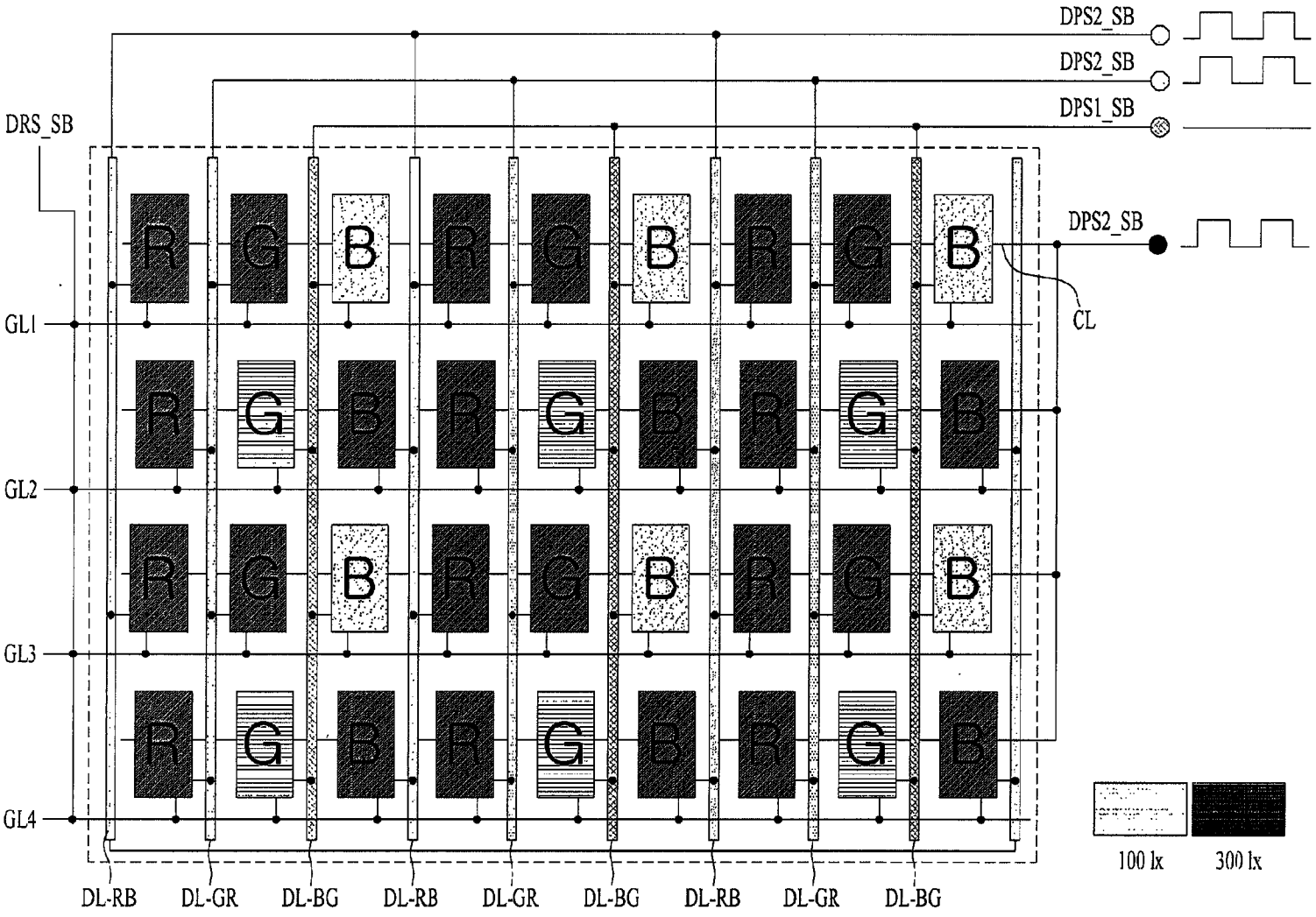

Subsequently, referring to FIG. 9C, the second standby display signal DPS2_SB is supplied to any one of the combined red/blue data lines DL-RB, the second standby display signal DPS2_SB is supplied to any one of the combined green/red data lines DL-GR, the first standby display signal DPS1_SB is supplied to any one of the combined blue/green data lines DL-BG, and the second standby display signal DPS2_SB is supplied to the common line CL. In this case, since the data lines having a potential difference with the common line CL are only the blue/green data lines DL-BG, only the blue and green pixels B and G connected to the blue/green data lines DL-BG display blue and green having specific brightness according to the potential difference. In contrast, the red and blue pixels R and B connected to the red/blue data lines DL-RB having the same potential as the common line CL and the green and red pixels G and R connected to the green and red data lines DL-GR having the same potential as the common line CL display black. Accordingly, as shown in FIG. 9C, a standby screen having a mixed color of blue and green may be displayed on the screen of the display panel DSP in the standby mode. That is, standby screens having such a color are shown in one side of FIG. 9C. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

Figure 9D:
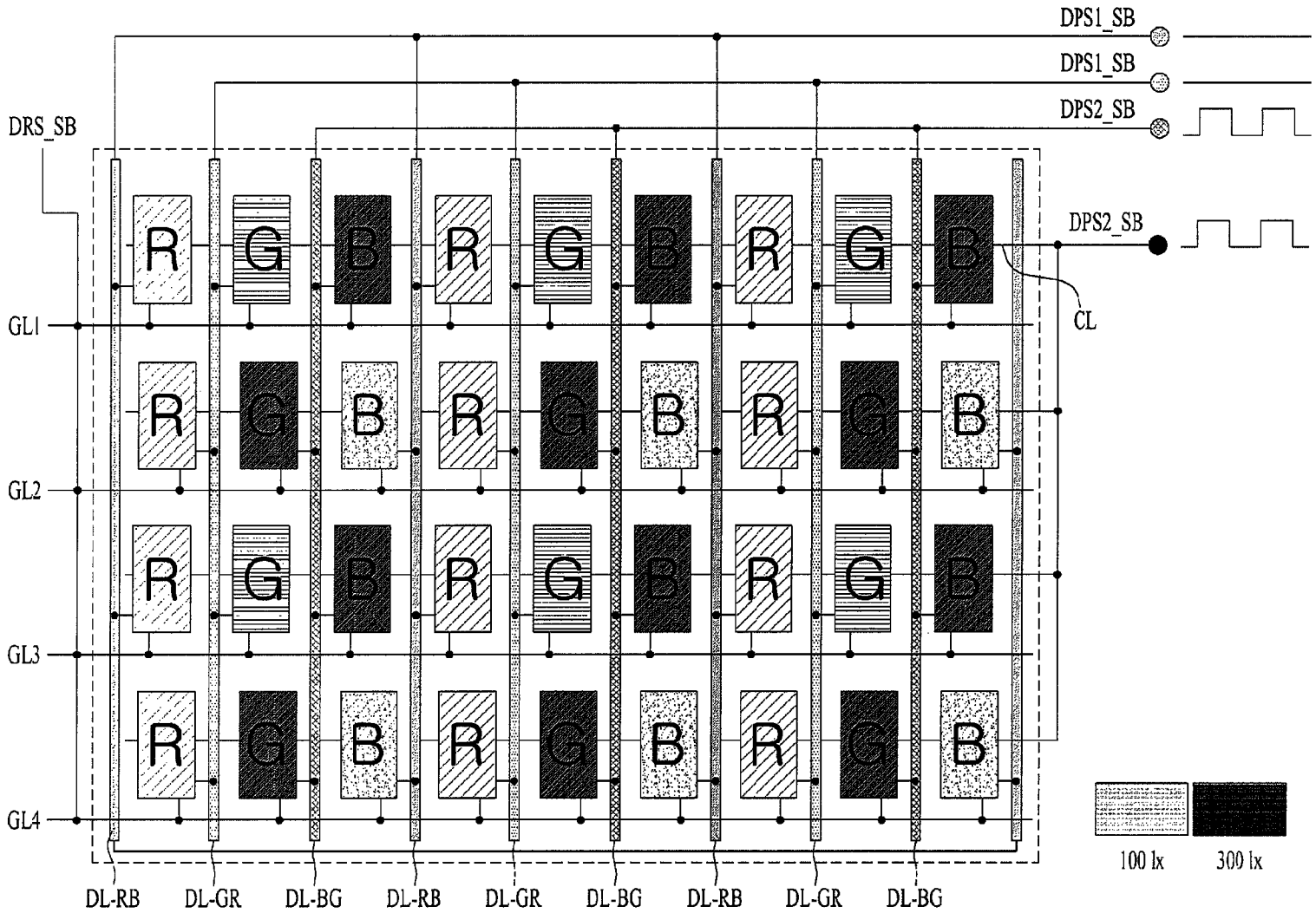

Next, referring to FIG. 9D, the first standby display signal DPS1_SB is supplied to any one of the combined red/blue data lines DL-RB, the first standby display signal DPS1_SB is supplied to any one of the combined green/red data lines DL-GR, the second standby display signal DPS2_SB is supplied to any one of the combined blue/green data lines DL-BG, and the second standby display signal DPS2_SB is supplied to the common line CL. In this case, since the data lines having a potential difference with the common line CL are the red/blue data lines DL-RB and the green/red data lines DL-GR, the red and blue pixels R and B connected to the red/blue data lines DL-RB and green and red pixels G and R connected to the green/red data lines DL-GR display red, green and blue having specific brightness according to the potential difference. In contrast, the blue and green pixels B and G connected to the blue/green data lines DL-BG having the same potential as the common line CL display black. Accordingly, as shown in FIG. 9D, a standby screen having a mixed color of much red, little green and little blue may be displayed on the screen of the display panel DSP in the standby mode. That is, standby screens having such a color are shown in one side of FIG. 9D. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

Figure 9E:
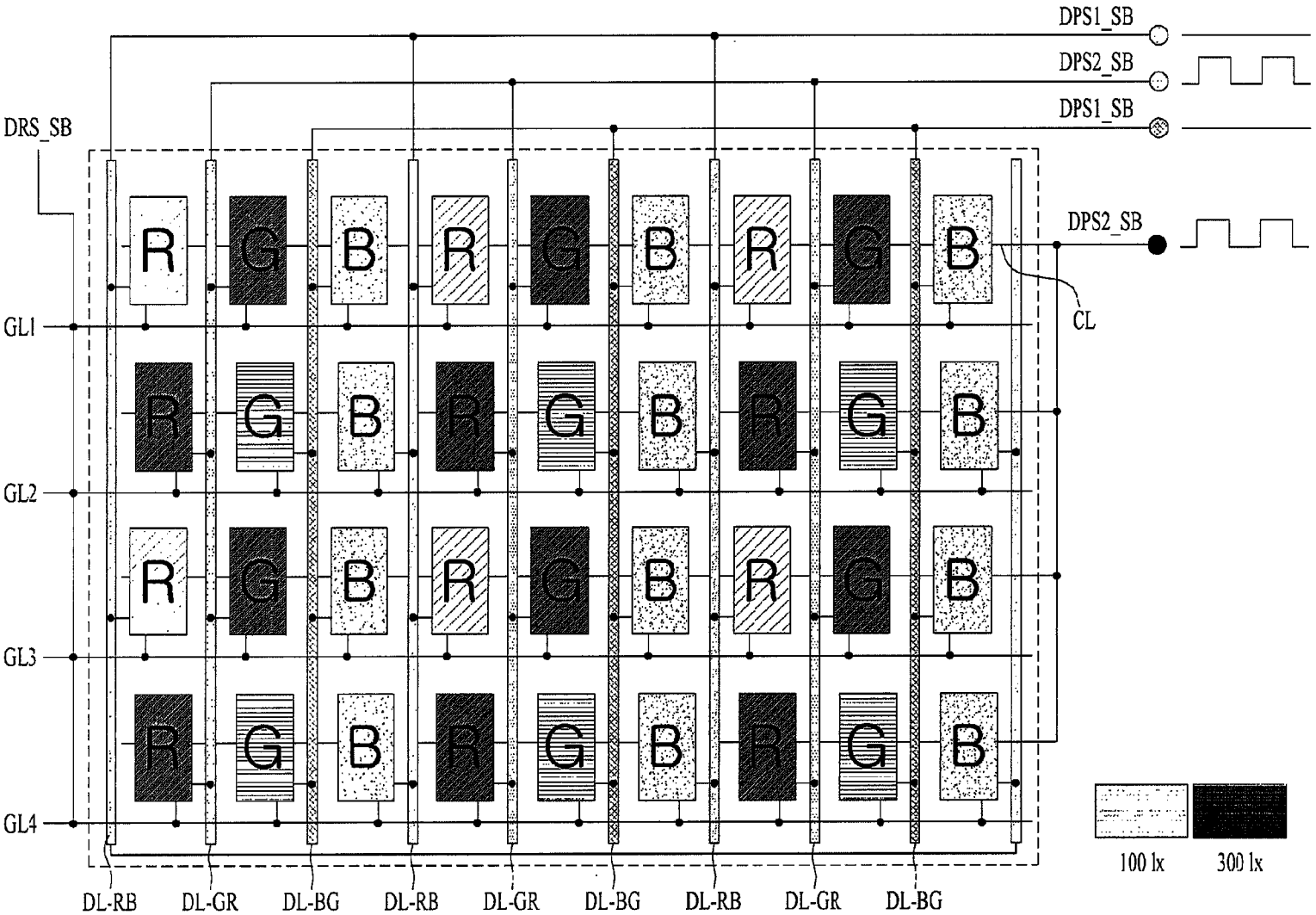

Subsequently, referring to FIG. 9E, the first standby display signal DPS1_SB is supplied to any one of the combined red/blue data lines DL-RB, the second standby display signal DPS2_SB is supplied to any one of the combined green/red data lines DL-GR, the first standby display signal DPS1_SB is supplied to any one of the combined blue/green data lines DL-BG, and the second standby display signal DPS2_SB is supplied to the common line CL. In this case, since the data lines having a potential difference with the common line CL are the red/blue data lines DL-RB and the blue/green data lines DL-BG, the red and blue pixels R and B connected to the red/blue data lines DL-RB and blue and green pixels B and G connected to the blue/green data lines DL-BG display red, green and blue having specific brightness according to the potential difference. In contrast, the green and red G and R connected to the green/red data lines DL-GR having the same potential as the common line CL display black. Accordingly, as shown in FIG. 9E, a standby screen having a mixed color of little red, little green and much blue may be displayed on the screen of the display panel DSP in the standby mode. That is, standby screens having such a color are shown in one side of FIG. 9E. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

Figure 9F:
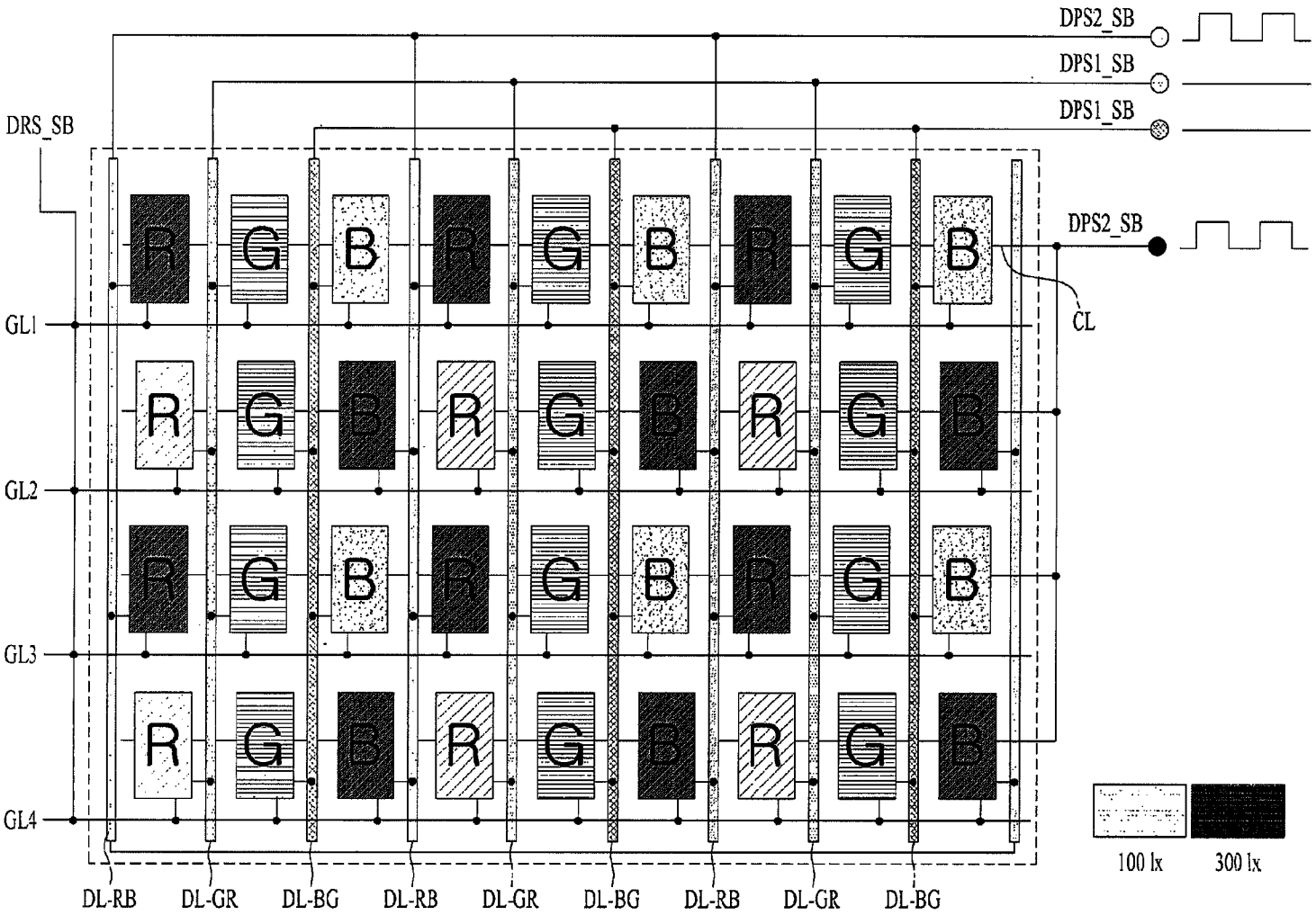

Next, referring to FIG. 9F, the second standby display signal DPS2_SB is supplied to any one of the combined red/blue data lines DL-RB, the first standby display signal DPS1_SB is supplied to any one of the combined green/red data lines DL-GR, the first standby display signal DPS1_SB is supplied to any one of the combined blue/green data lines DL-BG, and the second standby display signal DPS2_SB is supplied to the common line CL. In this case, since the data lines having a potential difference with the common line CL are the green/red data lines DL-GR and the blue/green data lines DL-BG, green and red pixels G and R connected to the green/red data lines DL-GR and the blue and green pixels B and G connected to the blue/green data lines DL-BG display red, green and blue having specific brightness according to the potential difference. In contrast, the red and blue pixels R and B connected to the red/blue data lines DL-RB having the same potential as the common line CL display black. Accordingly, as shown in FIG. 9F, a standby screen having a mixed color of little red, much green and little blue may be displayed on the screen of the display panel DSP in the standby mode. That is, standby screens having such a color are shown in one side of FIG. 9F. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

Subsequently, referring to FIG. 9G, the first standby display signal DPS1_SB is supplied to any one of the combined red/blue data lines DL-RB, the first standby display signal DPS1_SB is supplied to any one of the combined green/red data lines DL-GR, the first standby display signal DPS1_SB is supplied to any one of the combined blue/green data lines DL-BG, and the second standby display signal DPS2_SB is supplied to the common line CL. In this case, all the data lines have a potential difference with the common line CL. Accordingly, red and blue pixels R and B connected to the red/blue data lines DL-RB, green and red pixels G and R connected to the green/red data lines DL-GR and the blue and green pixels B and G connected to the blue/green data lines DL-BG display red, green and blue having specific brightness according to the potential difference.

Figure 9G:
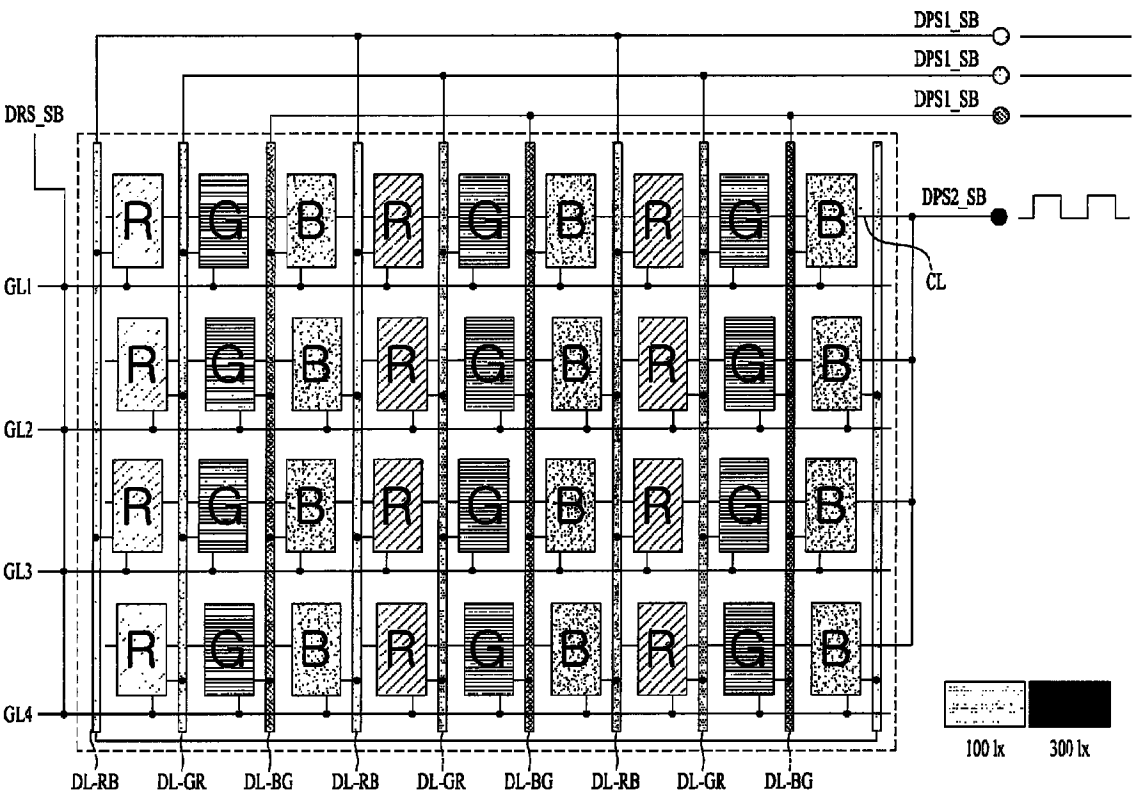

Accordingly, as shown in FIG. 9G, a standby screen having a mixed color of red, blue and green may be displayed on the screen of the display panel DSP in the standby mode. That is, standby screens having such a color are shown in one side of FIG. 9G. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

Figure 9H:
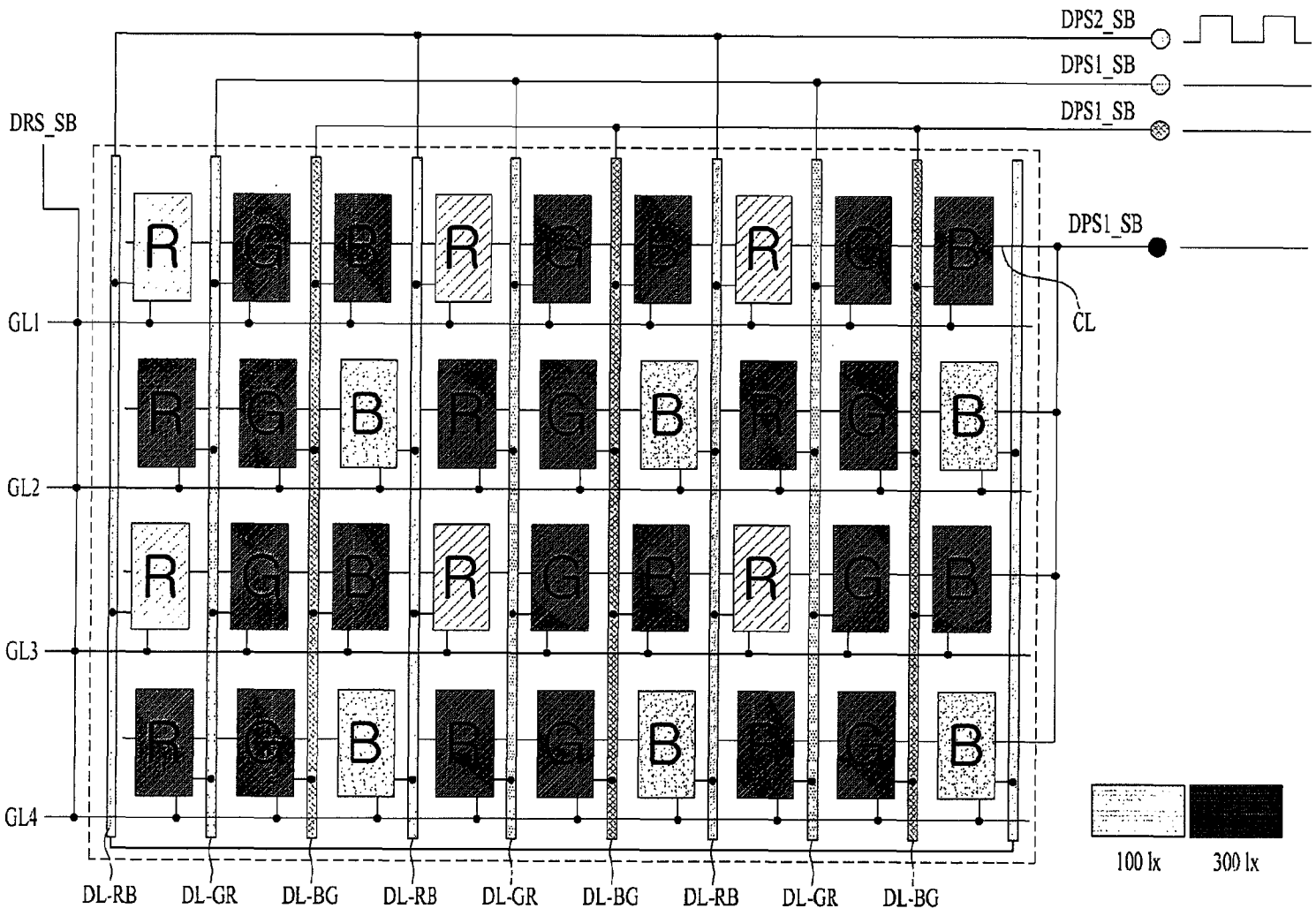

Next, referring to FIG. 9H, the second standby display signal DPS2_SB is supplied to any one of the combined red/blue data lines DL-RB, the first standby display signal DPS1_SB is supplied to any one of the combined green/red data lines DL-GR, the first standby display signal DPS1_SB is supplied to any one of the combined blue/green data lines DL-BG, and the first standby display signal DPS1_SB is supplied to the common line CL. In this case, since the data lines having a potential difference with the common line CL are only the red/blue data lines DL-RB, only the red and blue pixels R and B connected to the red/blue data lines DL-RB display red and blue having specific brightness according to the potential difference. In contrast, the green and red pixels G and R connected to the green/red data lines DL-GR having the same potential as the common line CL and the blue and green pixels B and G connected to the blue/green data lines DL-BG having the same potential as the common line CL display black. Accordingly, as shown in FIG. 9H, a standby screen having a mixed color of red and blue may be displayed on the screen of the display panel DSP in the standby mode. That is, standby screens having such a color are shown in one side of FIG. 9H. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

By applying the first standby display signal DPS1_SB and the second standby display signal DPS2_SB to each group and the common line CL (that is, the common electrode CE) by combinations different from the examples shown in FIGS. 9*a* to 9*h*, it is possible to display a standby screen with another color.

Figure 10:
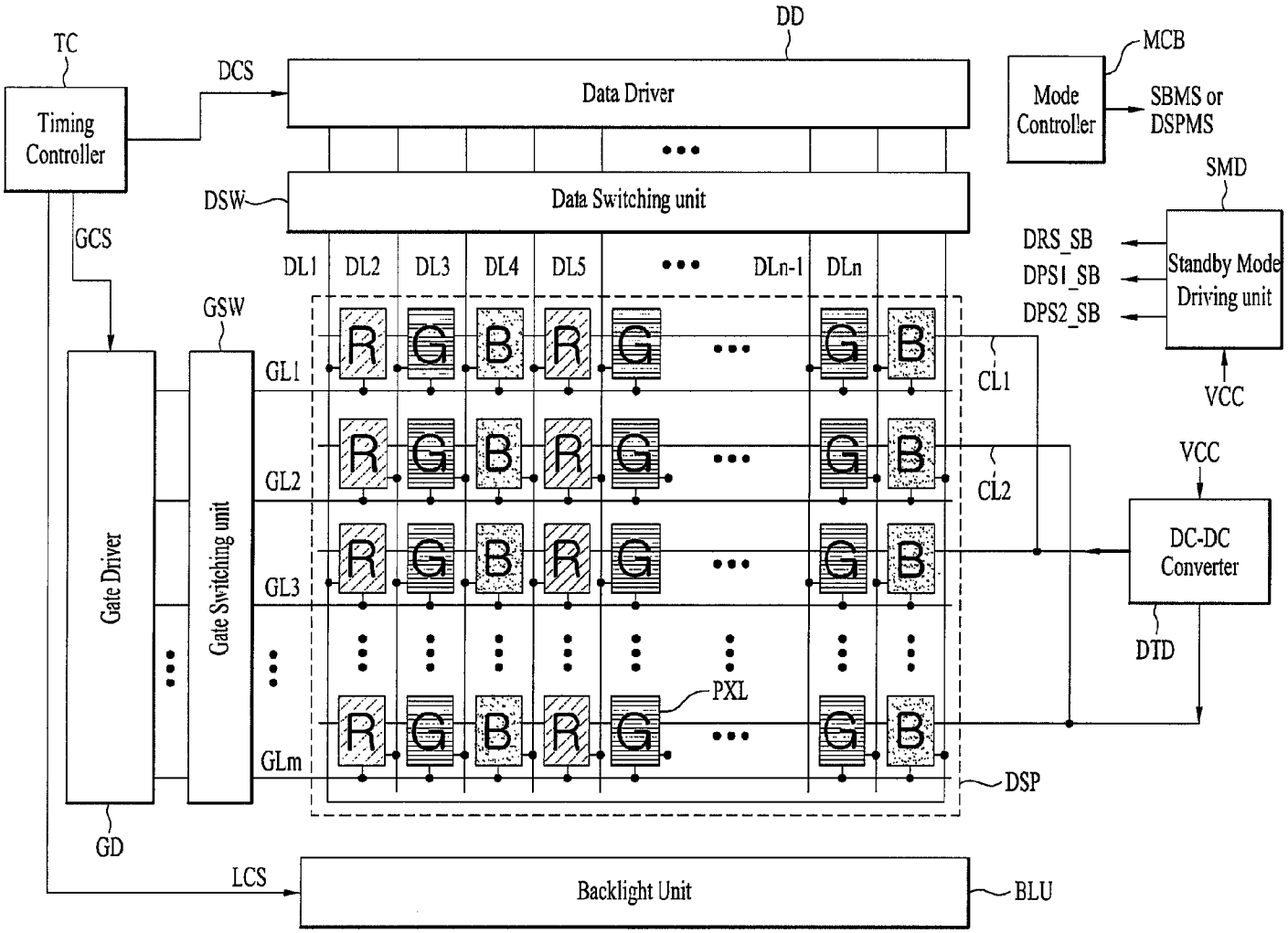
FIG. 10 is a diagram showing the configuration of a display device according to a third embodiment of the present invention.

FIG. 10 is a diagram showing the configuration of a display device according to a third embodiment of the present invention.

The display device according to the third embodiment of the present invention includes a mode controller MCB, a display panel DSP, a timing controller TC, a gate driver GD, a data driver DD, a DC-DC converter DTD, a backlight unit BLU, a gate switching unit GSW, a data switching unit DSW and a standby mode driving unit SMD, as shown in FIG. 10.

The mode controller MCB, the timing controller TC, the gate driver GD, the data driver DD, the backlight unit BLU, the gate switching unit GSW and the standby mode driving unit SMD according to the third embodiment of the present invention are equal to those of the first embodiment and thus a description thereof will be omitted.

The DC-DC converter DTD according to the third embodiment of the present invention is substantially equal to the DC-DC converter DTD of the first embodiment but is different therefrom in that one common voltage is further output as compared to the first embodiment. The first and second common voltages output from the DC-DC converter DTD according to the third embodiment of the present invention are AC voltage signals alternately having a high voltage and a low voltage. The first and second common voltages may have different phases or the same phase.

The display panel DSP according to the third embodiment of the present invention includes a plurality of pixels PXL, a plurality of gate lines GL1 to GLm for transmitting a variety of signals necessary to display an image at the pixels PXL, a plurality of data lines DL1 to DLn, and first and second common lines CL1 and CL2 for transmitting a common voltage to a common electrode CE, as shown in FIG. 10. The gate lines GL1 to GLm and the data lines DL1 to DLn are arranged to cross each other and a portion of the first and second common line CL1 and CL2 is parallel to the gate lines. The first common line CL1 is connected to pixels (hereinafter, odd numbered horizontal line pixels) of horizontal lines connected to odd numbered gate lines and the second common line CL2 is connected to pixels (hereinafter, even numbered horizontal line pixels) of horizontal lines connected to even numbered gate lines. In other words, the common electrodes CE of the odd numbered horizontal line pixels are commonly connected to the first common line CL1 and the common electrodes CE of the even numbered horizontal line pixels are commonly connected to the second common line CL2.

The pixels PXL are arranged on the display panel DSP in a matrix. n pixels PXL are arranged on each horizontal line. The pixels PXL include a red pixel R for displaying red, a green pixel G for displaying green and a blue pixel B for displaying blue. At this time, a red pixel R, a green pixel G and a blue pixel B connected to the same gate line and adjacently located in a horizontal direction form one unit pixel. This unit pixel mixes a red image, a green image and a blue image to display one unit image. Each pixel PXL may include a thin film transistor, a pixel electrode, a common electrode CE and a liquid crystal layer interposed therebetween. The configuration of one pixel PXL included in the display panel DSP of FIG. 10 is equal to the configuration of FIG. 2. The common electrodes CE of the odd numbered horizontal line pixels are commonly connected to the first common line CL1 and the common electrodes CE of the even numbered horizontal line pixels are commonly connected to the second common line CL2.

Pixels having different colors are connected to one data line on the display panel DSP in a zigzag form according to the third embodiment of the present invention. For example, a red pixel R and a blue pixel B are alternately connected to the first data line DL1 of FIG. 10 in a zigzag form along the longitudinal direction of the first data line DL1. Similarly, green pixels G and red pixels R are connected to the second data line DL2 in a zigzag form and blue pixels B and green pixels G are connected to the third data line DL3 in a zigzag form. That is, the connection relationship between the data lines and the pixels according to the third embodiment of the present invention is equal to that of the second embodiment.

The data lines DL1 to DLn are grouped into predetermined groups by the data switching unit DSW. The data switching unit DSW connects the data lines belonging to the same group. The operation of the standby mode driving unit SMD according to the third embodiment of the present invention is equal to that of the second embodiment and, for a description thereof, the standby mode driving unit SMD of the second embodiment is referred to. The standby mode driving unit SMD according to the third embodiment of the present invention supplies at least one of the first standby display signal DPS1_SB and the second standby display signal DPS2_SB to two different common lines CL1 and CL2 instead of one common line CL. More specifically, the standby mode driving unit SMD of the display device according to the third embodiment of the present invention drives the gate lines in response to the standby mode signal SBMS, and drives the data lines of the groups, the first common line CL1 and the second common line CL2 so as to generate a potential difference between the data lines of at least one group and at least one common line CL, which will be described in detail with reference to the figures.

Figure 11:
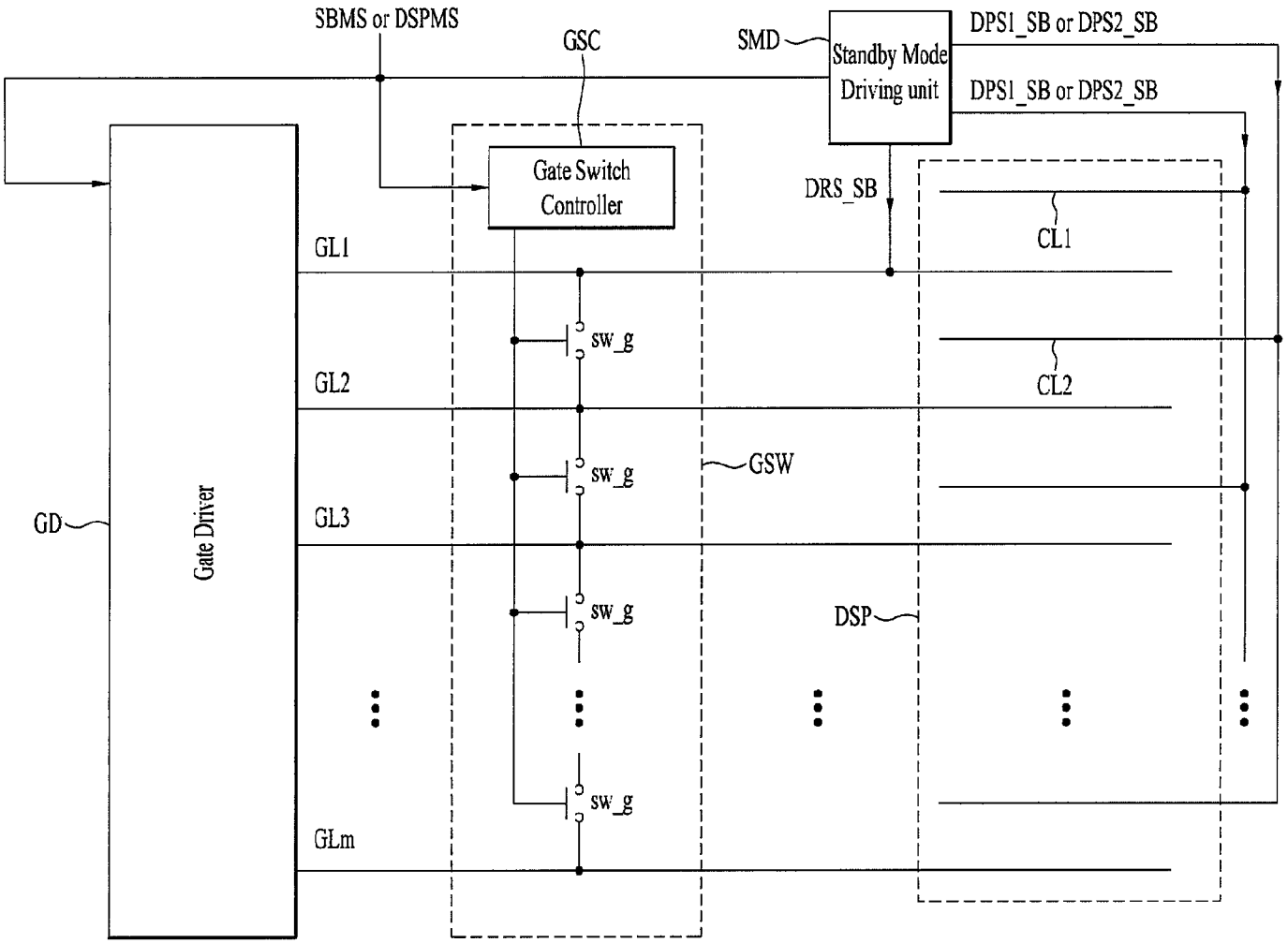
FIG. 11 is a diagram showing the detailed configuration of a standby mode driving unit of FIG. 10.

FIG. 11 is a diagram showing the detailed configuration of the standby mode driving unit SMD of FIG. 10.

The standby mode driving unit SMD of the display device according to the third embodiment of the present invention supplies any one of the first standby display signal DPS1_SB and the second standby display signal DPS2_SB to the first common line CL1 and any one of the first standby display signal DPS1_SB and the second standby display signal DPS2_SB to the second common line CL2 so as to generate a potential difference between the data lines of at least one group and at least one common line, as shown in FIG. 11.

Hereinafter, an example of displaying a standby screen having various colors using the display device according to the third embodiment of the present invention will be described in detail.

FIGS. 12*a* to 12*d* are diagrams illustrating a color implementation method of a standby screen according to the third embodiment of the present invention. Assume that the display device of the present invention is a normally black type display device as described above.

Figure 12A:
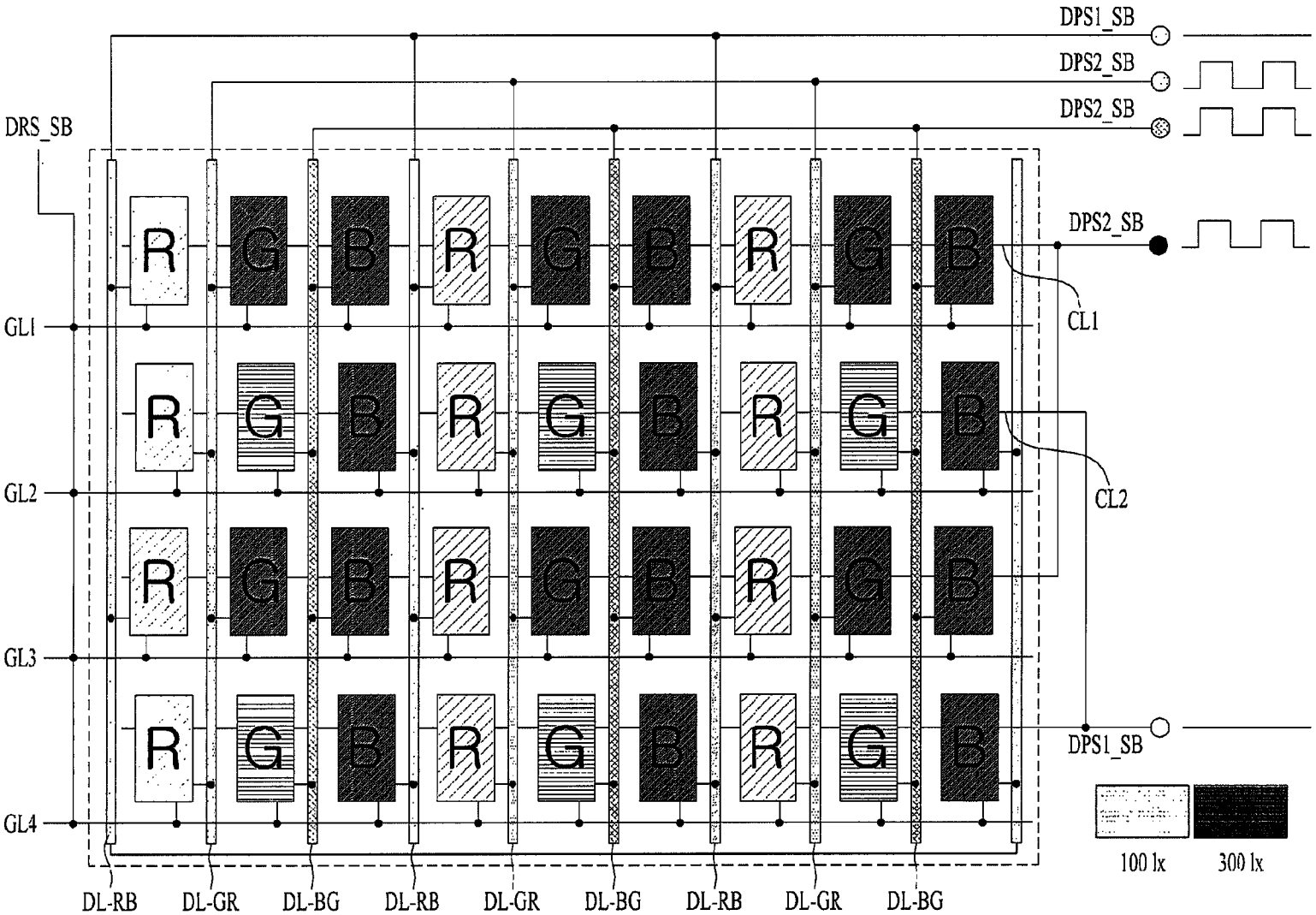
FIGS. 12*a* to 12*d* are diagrams illustrating a color implementation method of a standby screen according to the third embodiment of the present invention.

First, referring to FIG. 12A, the first standby display signal DPS1_SB is supplied to any one of the combined red/blue data lines DL-RB, the second standby display signal DPS2_SB is supplied to any one of the combined green/red data lines DL-GR, the second standby display signal DPS2_SB is supplied to any one of the combined blue/green data lines DL-BG, the second standby display signal DPS2_SB is supplied to the first common line CL1, and the first standby display signal DPS1_SB is supplied to the second common line CL2. In this case, the data lines having a potential difference with the first common line CL1 are the red/blue data lines DL-RB and the data lines having a potential difference with the second common line CL2 are the green/red data lines DL-GR and the blue/green data lines DL-BG.

At this time, only the red pixels R connected to the first common line CL1 among the pixels connected to the red/blue data lines DL-RB selectively display red having specific brightness according to the potential difference. In contrast, the blue pixels B connected to the second common line CL2 among the pixels connected to the red/blue data lines DL-RB display black. This is because the red/blue data lines DL-RB and the second common line CL2 have the same potential.

In this way, only the red pixels R connected to the first common line CL1 among the pixels connected to the green/red data lines DL-GR selectively display red having specific brightness according to the potential difference. In contrast, the green pixels G connected to the second common line CL2 among the pixels connected to the green/red data lines DL-GR display black.

In addition, only the green pixels G connected to the first common line CL1 among the blue/green data lines DL-BG selectively display green having specific brightness according to the potential difference. In contrast, the blue pixels B connected to the second common line CL2 among the pixels connected to the blue/green data lines DL-BG display black.

Accordingly, as shown in FIG. 12A, a standby screen having a mixed color of much red and little blue may be displayed on the screen of the display panel DSP in the standby mode. That is, standby screens having such a color are shown in one side of FIG. 12A. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

Subsequently, referring to FIG. 12B, the second standby display signal DPS2_SB is supplied to any one of the combined red/blue data lines DL-RB, the first standby display signal DPS1_SB is supplied to any one of the combined green/red data lines DL-GR, the second standby display signal DPS2_SB is supplied to any one of the combined blue/green data lines DL-BG, the second standby display signal DPS2_SB is supplied to the first common line CL1, and the first standby display signal DPS1_SB is supplied to the second common line CL2. In this case, the data lines having a potential difference with the first common line CL1 are the green/red data lines DL-GR and the data lines having a potential difference with the second common line CL2 are the red/blue data lines DL-RB and the blue/green data lines DL-BG.

At this time, only the green pixels G connected to the first common line CL1 among the pixels connected to the green/red data lines DL-GR selectively display green having specific brightness according to the potential difference. In contrast, the red pixels R connected to the second common line CL2 among the pixels connected to the green/red data lines DL-GR display black. This is because the green/red data lines DL-GR and the second common line CL2 have the same potential.

In this way, only the blue pixels B connected to the second common line CL2 among the pixels connected to the red/blue data lines DL-RB selectively display blue having specific brightness according to the potential difference. In contrast, the red pixels R connected to the first common line CL1 among the pixels connected to the red/blue data lines DL-RB display black.

In addition, only the green pixels G connected to the second common line CL2 among the blue/green data lines DL-BG selectively display green having specific brightness according to the potential difference. In contrast, the blue pixels B connected to the first common line CL1 among the pixels connected to the blue/green data lines DL-BG display black.

Figure 12B:
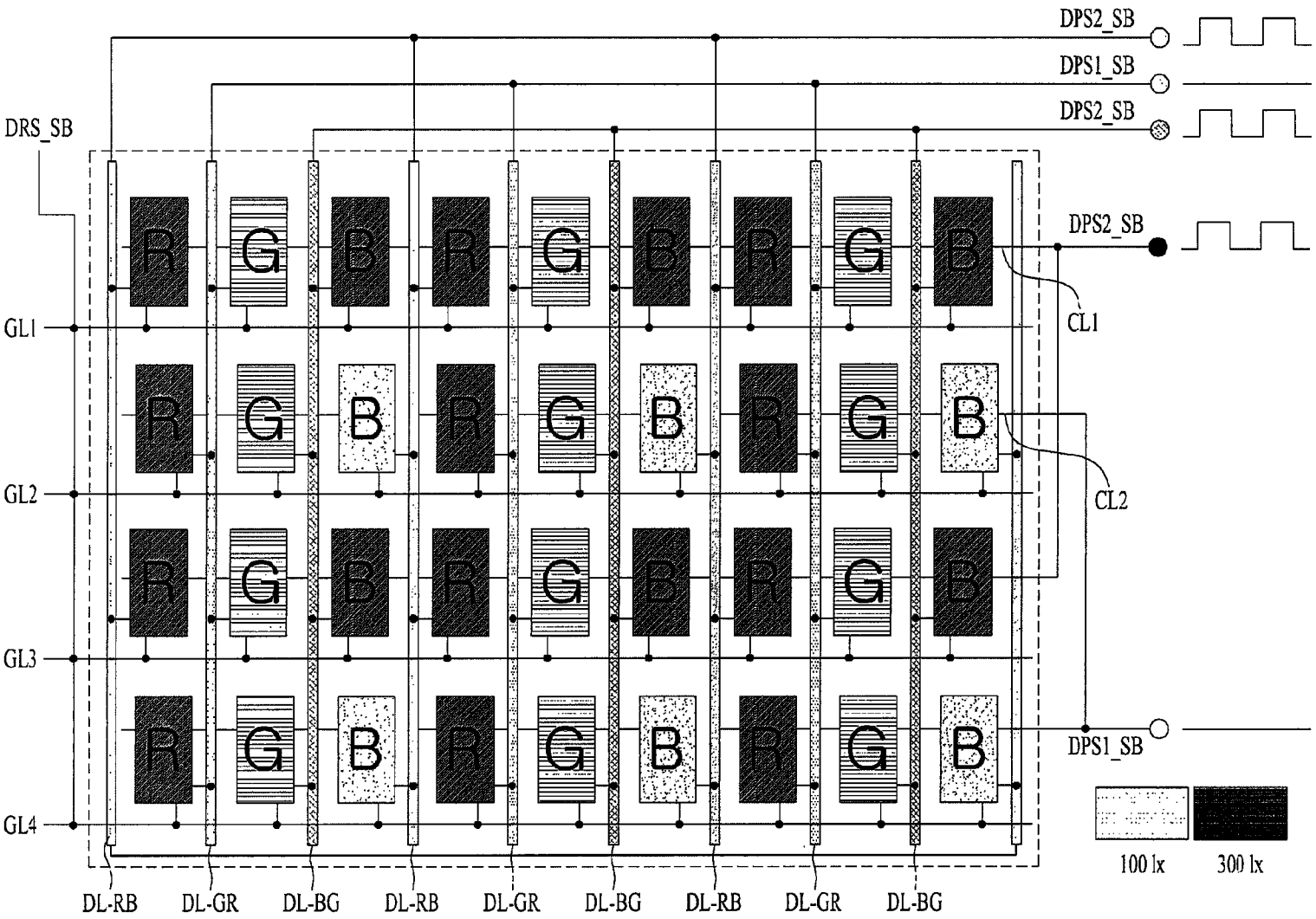

Accordingly, as shown in FIG. 12B, a standby screen having a mixed color of much green and little blue may be displayed on the screen of the display panel DSP in the standby mode. That is, standby screens having such a color are shown in one side of FIG. 12B. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

Figure 12C:
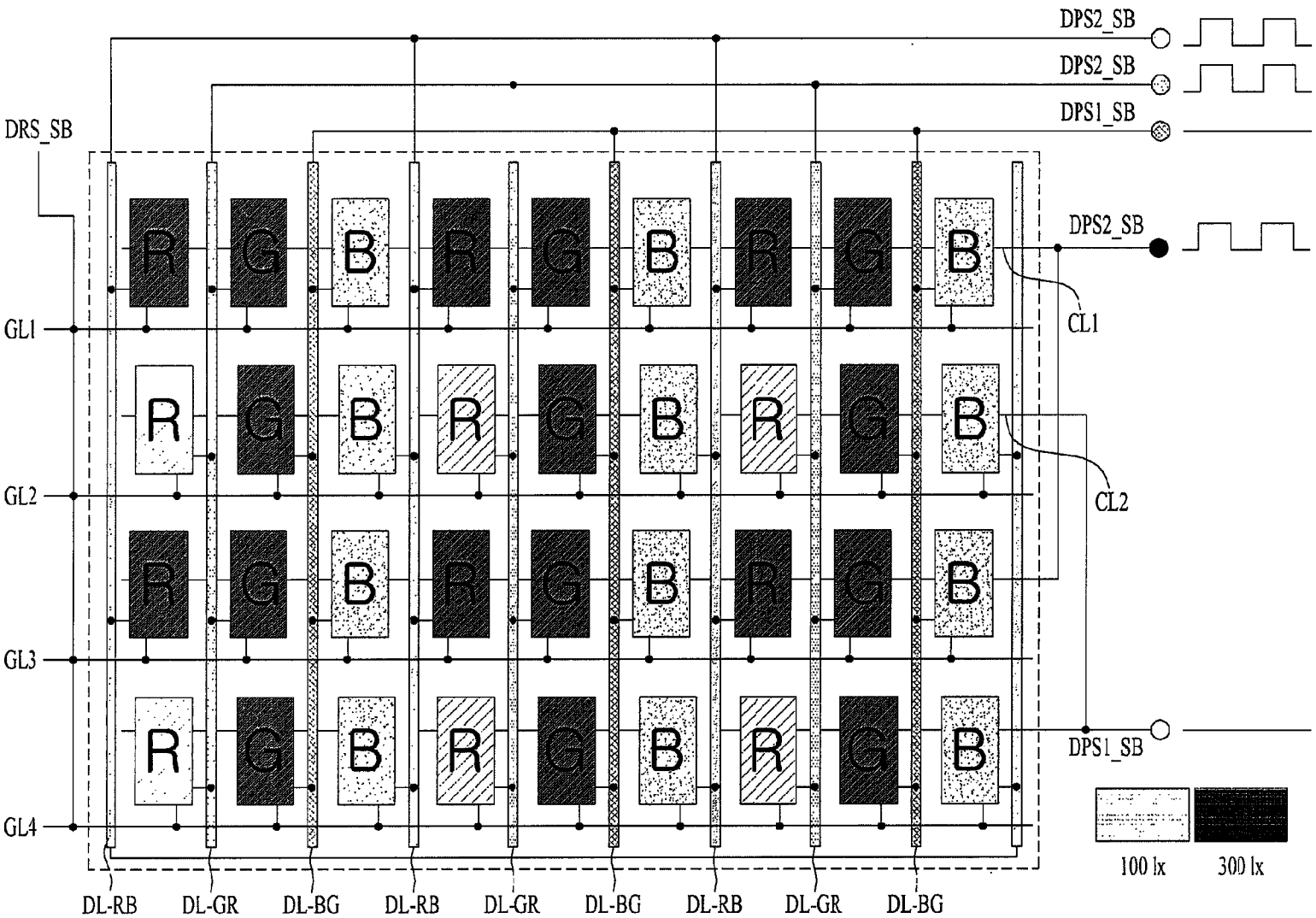

Next, referring to FIG. 12C, the second standby display signal DPS2_SB is supplied to any one of the combined red/blue data lines DL-RB, the second standby display signal DPS2_SB is supplied to any one of the combined green/red data lines DL-GR, the first standby display signal DPS1_SB is supplied to any one of the combined blue/green data lines DL-BG, the second standby display signal DPS2_SB is supplied to the first common line CL1, and the first standby display signal DPS1_SB is supplied to the second common line CL2. In this case, the data lines having a potential difference with the first common line CL1 are the blue/green data lines DL-BG and the data lines having a potential difference with the second common line CL2 are the red/blue data lines DL-RB and the green/red data lines DL-GR.

At this time, only the blue pixels B connected to the second common line CL2 among the pixels connected to the blue/green data lines DL-BG selectively display blue having specific brightness according to the potential difference. In contrast, the green pixels G connected to the first common line CL1 among the pixels connected to the blue/green data lines DL-BG display black. This is because the blue/green data lines DL-BG and the first common line CL1 have the same potential.

In this way, only the blue pixels B connected to the first common line CL1 among the pixels connected to the red/blue data lines DL-RB selectively display blue having specific brightness according to the potential difference. In contrast, the red pixels R connected to the first common line CL1 among the pixels connected to the blue/green data lines DL-BG display black.

In addition, only the red pixels R connected to the second common line CL2 among the green/red data lines DL-GR selectively display red having specific brightness according to the potential difference. In contrast, the green pixels G connected to the first common line CL1 among the pixels connected to the green/red data lines DL-GR display black.

Accordingly, as shown in FIG. 12C, a standby screen having a mixed color of much blue and little red may be displayed on the screen of the display panel DSP in the standby mode. That is, standby screens having such a color are shown in one side of FIG. 12C. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

Subsequently, referring to FIG. 12D, the second standby display signal DPS2_SB is supplied to any one of the combined red/blue data lines DL-RB, the first standby display signal DPS1_SB is supplied to any one of the combined green/red data lines DL-GR, the first standby display signal DPS1_SB is supplied to any one of the combined blue/green data lines DL-BG, the first standby display signal DPS1_SB is supplied to the first common line CL1, and the second standby display signal DPS2_SB is supplied to the second common line CL2. In this case, the data lines having a potential difference with the first common line CL1 are the red/blue data lines DL-RB and the data lines having a potential difference with the second common line CL2 are the green/red data lines DL-GR and the blue/green data lines DL-BG.

At this time, only the red pixels R connected to the first common line CL1 among the pixels connected to the red/blue data lines DL-RB selectively display red having specific brightness according to the potential difference. In contrast, the blue pixels B connected to the second common line CL2 among the pixels connected to the red/blue data lines DL-RB display black. This is because the red/blue data lines DL-RB and the second common line CL2 have the same potential.

In this way, only the red pixels R connected to the first common line CL1 among the pixels connected to the green/red data lines DL-GR selectively display red having specific brightness according to the potential difference. In contrast, the green pixels G connected to the second common line CL2 among the pixels connected to the green/red data lines DL-GR display black.

In addition, only the green pixels G connected to the first common line CL1 among the blue/green data lines DL-BG selectively display green having specific brightness according to the potential difference. In contrast, the blue pixels B connected to the second common line CL2 among the pixels connected to the blue/green data lines DL-BG display black.

Figure 12D:
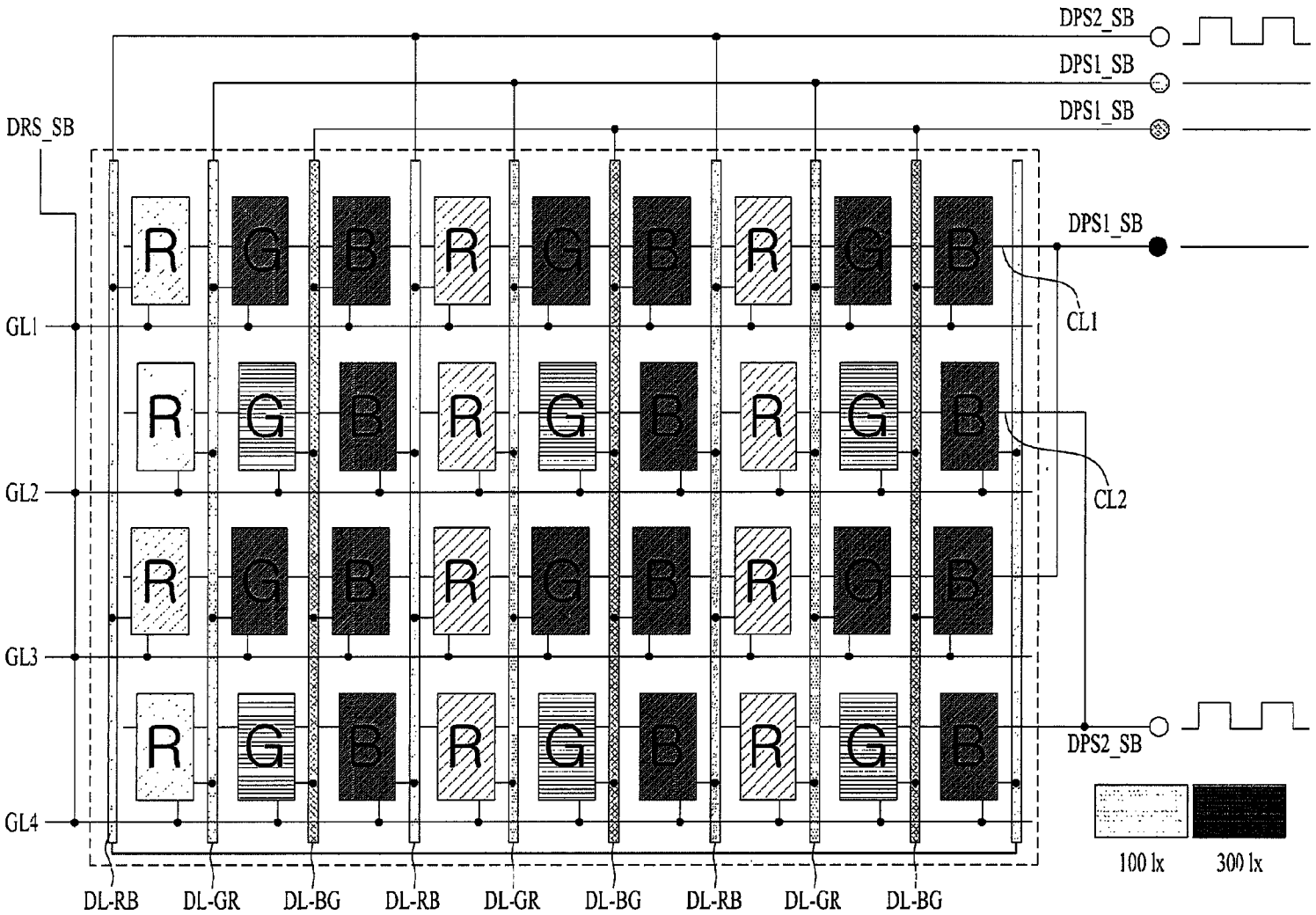

Accordingly, as shown in FIG. 12D, a standby screen having a mixed color of much red and little blue may be displayed on the screen of the display panel DSP in the standby mode. That is, standby screens having such a color are shown in one side of FIG. 12D. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

By applying the first standby display signal DPS1_SB and the second standby display signal DPS2_SB to each group and the common lines CL1 and CL2 by combinations different from the examples shown in FIGS. 12*a* to 12*d*, it is possible to display a standby screen with another color.

Figure 13:
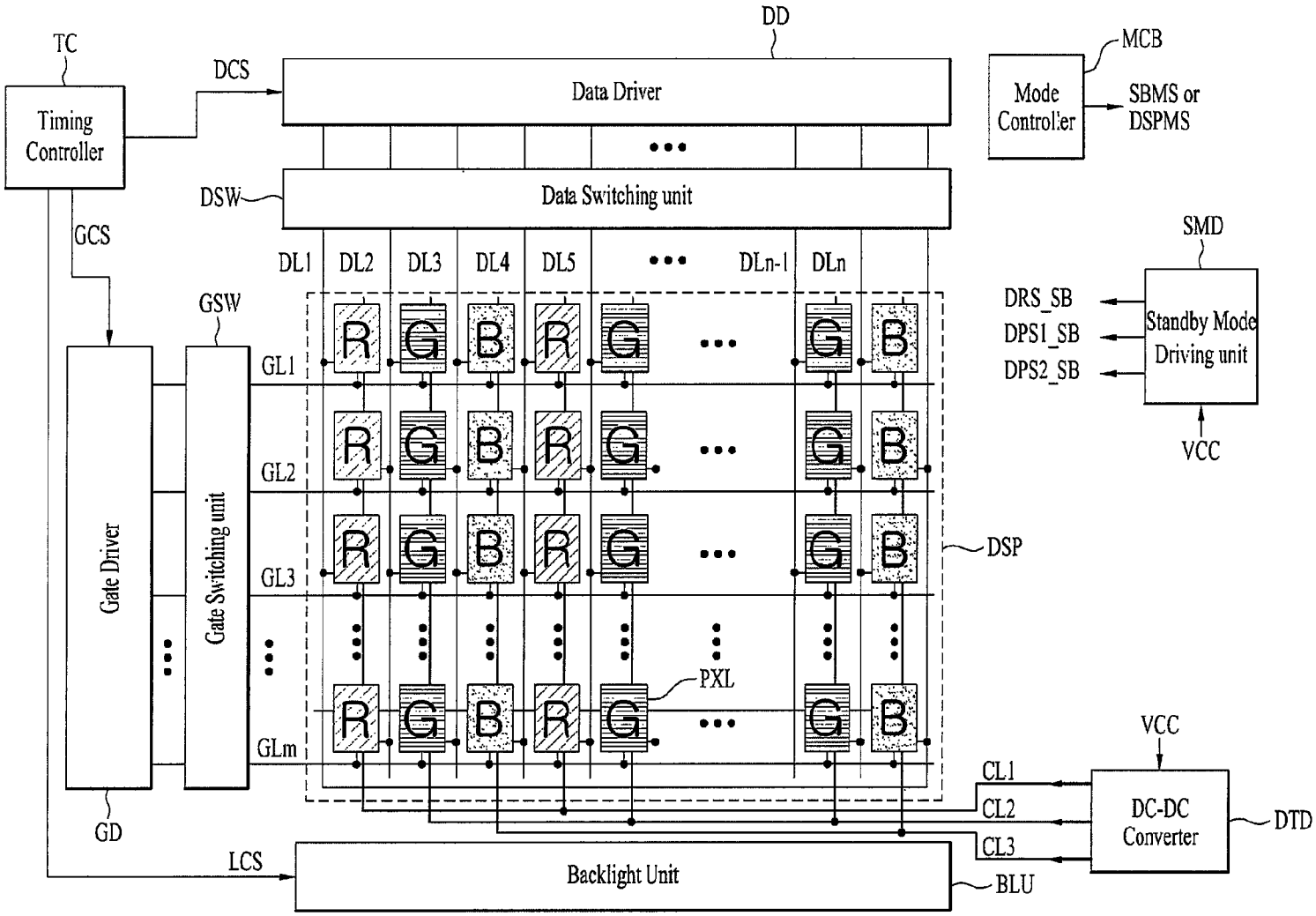
FIG. 13 is a diagram showing the configuration of a display device according to a fourth embodiment of the present invention.

FIG. 13 is a diagram showing the configuration of a display device according to a fourth embodiment of the present invention.

The display device according to the fourth embodiment of the present invention includes a mode controller MCB, a display panel DSP, a timing controller TC, a gate driver GD, a data driver DD, a DC-DC converter DTD, a backlight unit BLU, a gate switching unit GSW, a data switching unit DSW and a standby mode driving unit SMD, as shown in FIG. 13.

The mode controller MCB, the timing controller TC, the gate driver GD, the data driver DD, the backlight unit BLU, the gate switching unit GSW and the standby mode driving unit SMD according to the fourth embodiment of the present invention are equal to those of the first embodiment and a description thereof will be omitted.

The DC-DC converter DTD according to the fourth embodiment of the present invention is substantially equal to the DC-DC converter DTD of the first embodiment but is different therefrom in that two common voltages are further output as compared to the first embodiment. The first to third common voltages output from the DC-DC converter DTD according to the fourth embodiment of the present invention are AC voltage signals alternately having a high voltage and a low voltage. The first to third common voltages may have different phases or the same phase.

The display panel DSP according to the fourth embodiment of the present invention includes a plurality of pixels PXL, a plurality of gate lines GL1 to GLm for transmitting a variety of signals necessary to display an image at the pixels PXL, a plurality of data lines DL1 to DLn, and first to third common lines CL1 to CL3 for transmitting a common voltage to a common electrode CE, as shown in FIG. 13. The gate lines GL1 to GLm and the data lines DL1 to DLn are arranged to cross each other and a portion of the first to third common line CL1 to CL3 is parallel to the data lines. The first common line CL1 is connected to pixels (hereinafter, first vertical line pixels) of vertical lines located between adjacent (3p+1)-th data lines and (3p+2)-th data lines, the second common line CL2 is connected to pixels (hereinafter, second vertical line pixels) of vertical lines located between adjacent (3p+2)-th data lines and (3p+3)-th data lines, and the third common line CL3 is connected to pixels (hereinafter, third vertical line pixels) of vertical lines located between adjacent (3p+3)-th data lines and (3p+4)-th data lines. In other words, the common electrodes CE of the first vertical line pixels are commonly connected to the first common line CL1, the common electrodes CE of the second vertical line pixels are commonly connected to the second common line CL2, and the common electrodes CE of the third vertical line pixels are commonly connected to the third common line CL3.

The pixels PXL are arranged on the display panel DSP in a matrix. n pixels PXL are arranged on each horizontal line. The pixels PXL include a red pixel R for displaying red, a green pixel G for displaying green and a blue pixel B for displaying blue. At this time, a red pixel R, a green pixel G and a blue pixel B connected to the same gate line and adjacently located in a horizontal direction form one unit pixel. This unit pixel mixes a red image, a green image and a blue image to display one unit image. Each pixel PXL may include a thin film transistor, a pixel electrode, a common electrode CE and a liquid crystal layer interposed therebetween. The configuration of one pixel PXL included in the display panel DSP of FIG. 13 is equal to the configuration of FIG. 2. The common electrodes CE of the first vertical line pixels are commonly connected to the first common line CL1, the common electrodes CE of the second vertical line pixels are commonly connected to the second common line CL2, and the common electrodes CE of the third vertical line pixels are commonly connected to the third common line CL3.

Pixels having different colors are connected to one data line on the display panel DSP in a zigzag form according to the fourth embodiment of the present invention. For example, a red pixel R and a blue pixel B are alternately connected to the first data line DL1 of FIG. 13 in a zigzag form along the longitudinal direction of the first data line DL1. Similarly, green pixels G and red pixels R are connected to the second data line DL2 in a zigzag form and blue pixels B and green pixels G are connected to the third data line DL3 in a zigzag form. That is, the connection relationship between the data lines and the pixels according to the fourth embodiment of the present invention is equal to that of the second embodiment.

The data lines are grouped into predetermined groups by the data switching unit DSW. The data switching unit DSW connects the data lines belonging to the same group. The operation of the standby mode driving unit SMD according to the fourth embodiment of the present invention is equal to that of the second embodiment and, for a description thereof, the standby mode driving unit SMD of the second embodiment is referred to. The standby mode driving unit SMD according to the fourth embodiment of the present invention supplies at least one of the first standby display signal DPS1_SB and the second standby display signal DPS2_SB to three different common lines CL1 to CL3 instead of one common line CL. More specifically, the standby mode driving unit SMD of the display device according to the fourth embodiment of the present invention drives the gate lines in response to the standby mode signal SBMS and drives the data lines of the groups and the first to third common lines CL1 to CL3 so as to generate a potential difference between the data lines of at least one group and at least one common line, which will be described in detail with reference to the figures.

Figure 14:
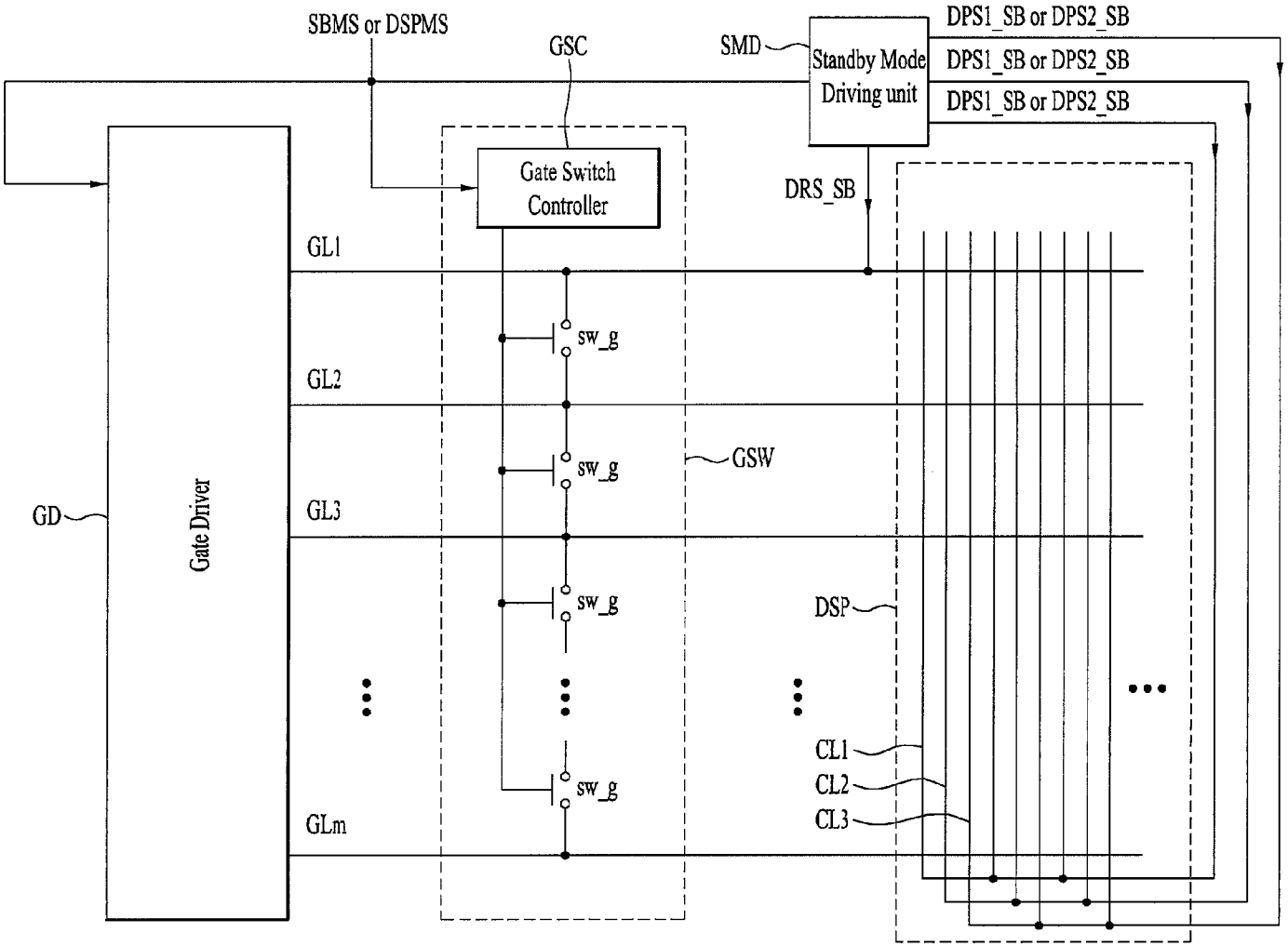
FIG. 14 is a diagram showing the detailed configuration of a standby mode driving unit of FIG. 13.

FIG. 14 is a diagram showing the detailed configuration of the standby mode driving unit SMD of FIG. 13.

The standby mode driving unit SMD of the display device according to the fourth embodiment of the present invention supplies any one of the first standby display signal DPS1_SB and the second standby display signal DPS2_SB to the first common line CL1, any one of the first standby display signal DPS1_SB and the second standby display signal DPS2_SB to the second common line CL2 and any one of the first standby display signal DPS1_SB and the second standby display signal DPS2_SB to the third common line CL3 so as to generate a potential difference between the data lines of at least one group and at least one common line CL, as shown in FIG. 14.

Hereinafter, an example of displaying a standby screen having various colors using the display device according to the fourth embodiment of the present invention will be described in detail.

Figure 15A:
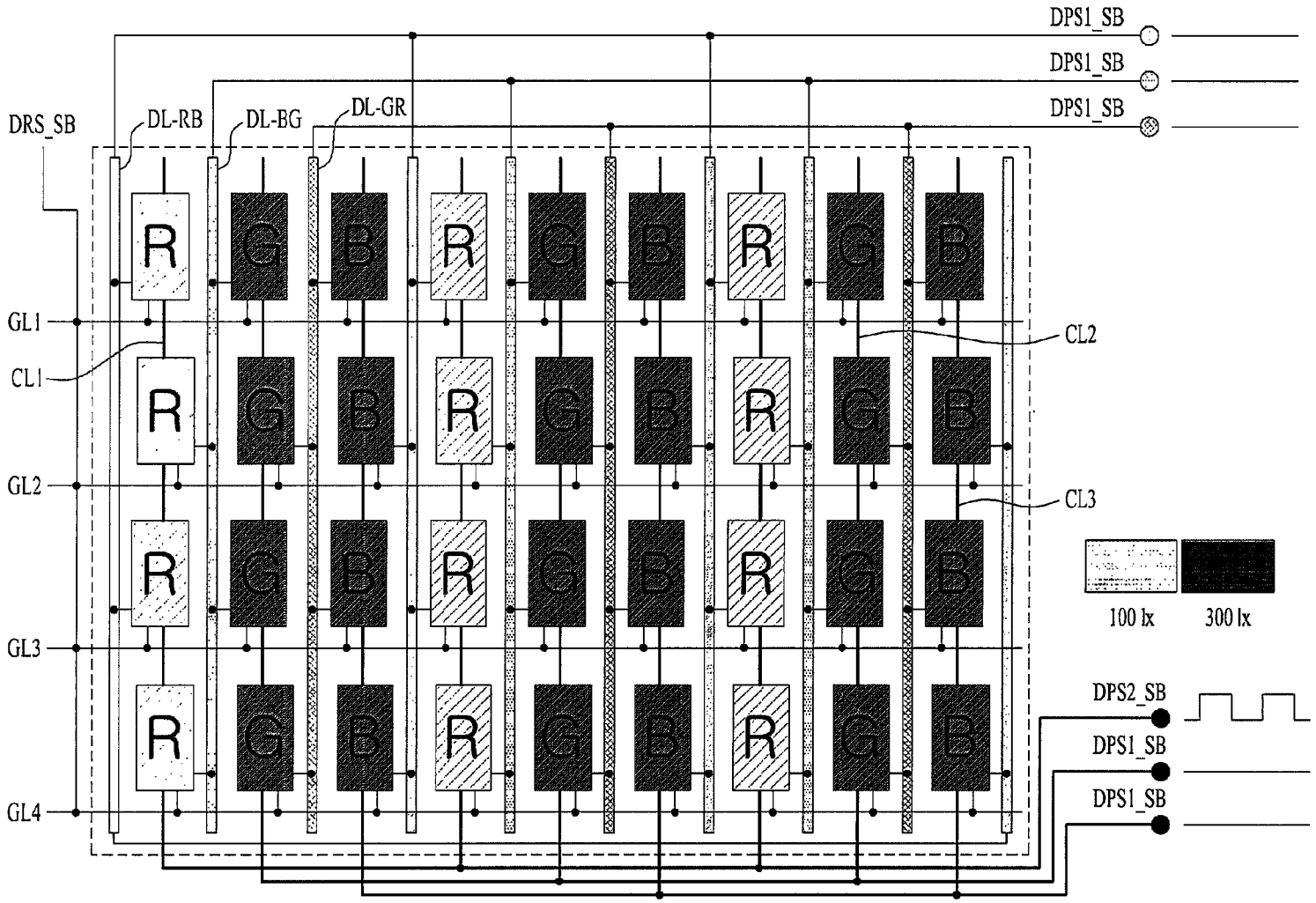
FIGS. 15*a* to 15*b* are diagrams illustrating a color implementation method of a standby screen according to the fourth embodiment of the present invention.
Figure 15B:
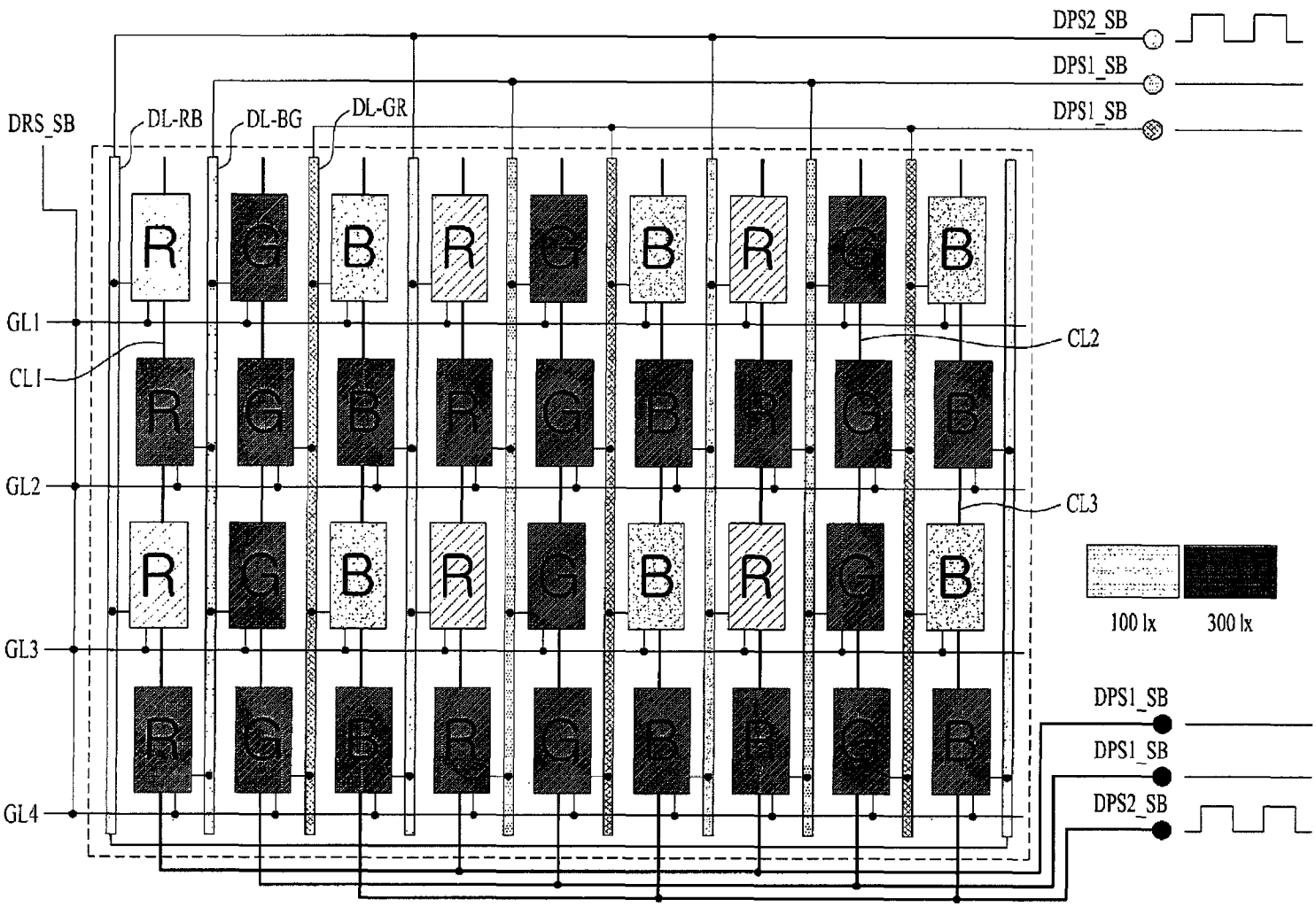

FIGS. 15*a* to 15*b* are diagrams illustrating a color implementation method of a standby screen according to the fourth embodiment of the present invention. Assume that the display device of the present invention is a normally black type display device as described above.

First, referring to FIG. 15A, the first standby display signal DPS1_SB is supplied to any one of the combined red/blue data lines DL-RB, the first standby display signal DPS1_SB is supplied to any one of the combined green/red data lines DL-GR, the first standby display signal DPS1_SB is supplied to any one of the combined blue/green data lines DL-BG, the second standby display signal DPS2_SB is supplied to the first common line CL1, the first standby display signal DPS1_SB is supplied to the second common line CL2, and the first standby display signal DPS1_SB is supplied to the third common line CL3. In this case, the data lines having a potential difference with the first common line CL1 are the red/blue data lines DL-RB, the green/red data lines DL-GR and the blue/green data lines DL-BG. That is, the first common line CL1 and all the data lines DL1 to DLn have a potential difference. The second common line CL2 and all the data lines DL1 to DLn have the same potential. In addition, the third common line CL3 and all the data lines DL1 to DLn have the same potential.

At this time, only the red pixels R connected to the first common line CL1 among the pixels connected to the red/blue data lines DL-RB selectively display red having specific brightness according to the potential difference. In contrast, the blue pixels B connected to the third common line CL3 among the pixels connected to the red/blue data lines DL-RB display black. This is because the red/blue data lines DL-RB and the third common line CL3 have the same potential.

In this way, only the red pixels R connected to the first common line CL1 among the pixels connected to the green/red data lines DL-GR selectively display red having specific brightness according to the potential difference. In contrast, the green pixels G connected to the second common line CL2 among the pixels connected to the green/red data lines DL-GR display black.

In addition, all the pixels connected to the blue/green data lines DL-BG display black. That is, the green pixels G connected to the second common line CL2 among the blue/green data lines DL-BG and the green pixels G connected to the third common line CL3 among the pixels connected to the blue/green data lines DL-BG all display black.

Accordingly, as shown in FIG. 15A, a red standby screen may be displayed on the screen of the display panel DSP in the standby mode. That is, standby screens having such a color are shown in one side of FIG. 15A. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

Next, referring to FIG. 15B, the second standby display signal DPS2_SB is supplied to any one of the combined red/blue data lines DL-RB, the first standby display signal DPS1_SB is supplied to any one of the combined green/red data lines DL-GR, the first standby display signal DPS1_SB is supplied to any one of the combined blue/green data lines DL-BG, the first standby display signal DPS1_SB is supplied to the first common line CL1, the first standby display signal DPS1_SB is supplied to the second common line CL2, and the second standby display signal DPS2_SB is supplied to the third common line CL3. In this case, the data lines having a potential difference with the first common line CL1 are only the red/blue data lines DL-RB, and the data lines having a potential difference with the second common line CL2 are only the red/blue data lines DL-RB. In addition, the data lines having a potential difference with the third common line CL3 are the green/red data lines DL-GR and the blue/green data lines DL-BG.

At this time, only the red pixels R connected to the first common line CL1 among the pixels connected to the red/blue data lines DL-RB selectively display red having specific brightness according to the potential difference. In contrast, the blue pixels B connected to the third common line CL3 among the pixels connected to the red/blue data lines DL-RB display black. This is because the red/blue data lines DL-RB and the third common line CL3 have the same potential.

Since the pixels connected to the red/blue data lines DL-RB and connected to the second common line CL2 are not present, a determination as to whether these pixels are driven is not made. Similarly, since the pixels connected to the green/red data lines DL-GR and connected to the third common line CL3 are not present, a determination as to whether these pixels are driven is not made.

Only the blue pixels B connected to the third common line CL3 among the pixels connected to the blue/green data line DL-BG selectively display blue having specific brightness according to the potential difference. In contrast, the green pixels G connected to the second common line CL2 among the pixels connected to the blue/green data line DL-BG display black.

Accordingly, as shown in FIG. 15B, a standby screen having a mixed color of red and blue may be displayed on the screen of the display panel DSP in the standby mode. That is, standby screens having such a color are shown in one side of FIG. 15B. One of the two standby screens is a standby screen when intensity of external light is 100 lx (lux) at a position where the display device is placed and the other standby screen is a standby screen when the intensity of external light is 300 lx. The brightness of the standby screen is relatively increased as the intensity of external light decreases.

By applying the first standby display signal DPS1_SB and the second standby display signal DPS2_SB to each group and the common lines CL1 to CL3 by combinations different from the examples shown in FIGS. 15*a* to 15*b*, it is possible to display a standby screen with another color.

Figure 16:
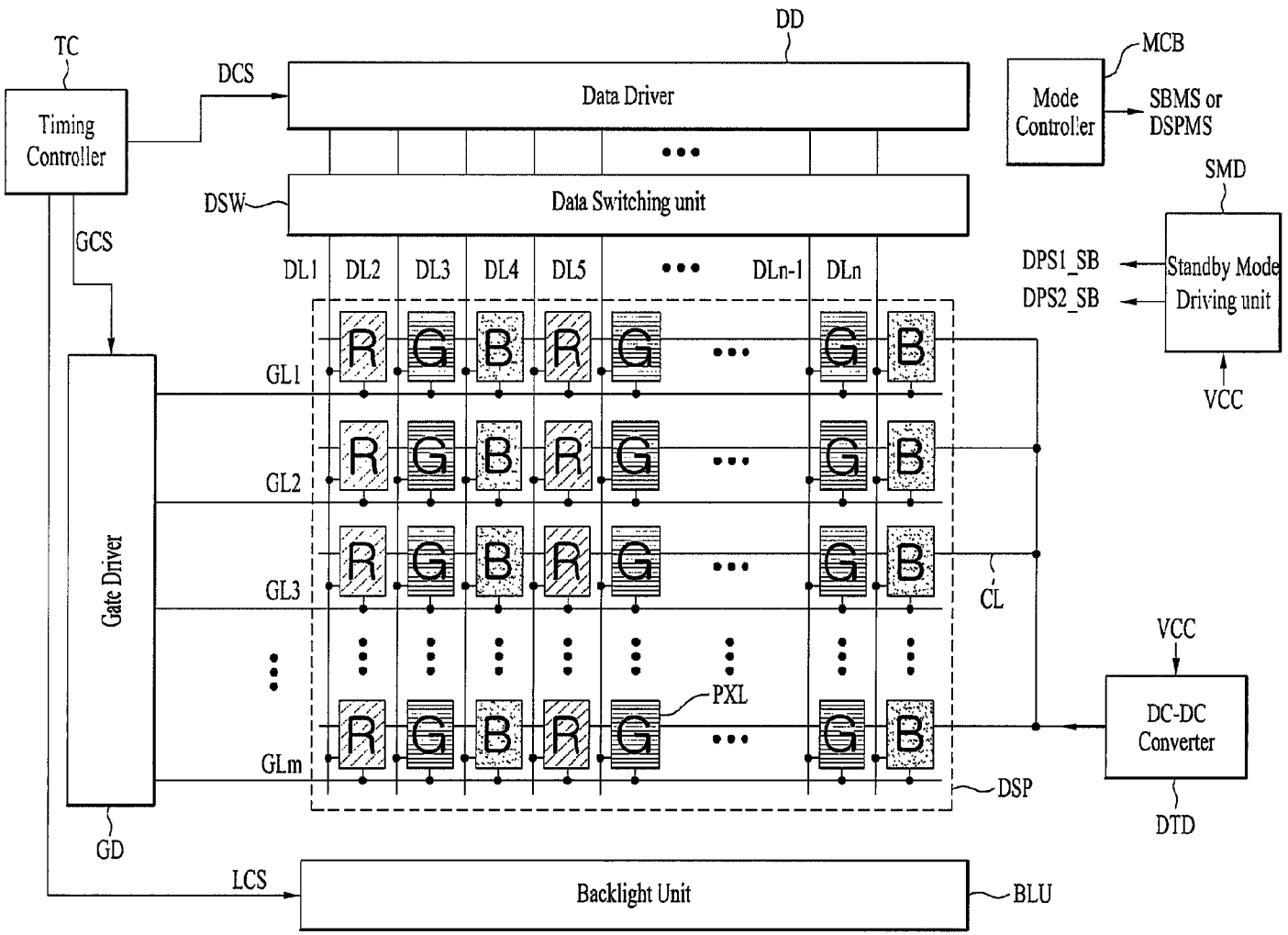
FIG. 16 is a diagram showing the configuration of a display device according to a fifth embodiment of the present invention.

FIG. 16 is a diagram showing the configuration of a display device according to a fifth embodiment of the present invention.

The display device according to the fifth embodiment of the present invention includes a mode controller MCB, a display panel DSP, a timing controller TC, a gate driver GD, a data driver DD, a DC-DC converter DTD, a backlight unit BLU, a data switching unit DSW and a standby mode driving unit SMD, as shown in FIG. 16.

The mode controller MCB, the timing controller TC, the data driver DD, the DC-DC converter DTD and the backlight unit BLU according to the fifth embodiment of the present invention are equal to those of the first embodiment and thus a description thereof will be omitted.

The gate driver GD of the display device according to the fifth embodiment of the present invention performs the operation not only in the display mode but also in the standby mode. That is, the gate driver GD sequentially scan pulses in response to the standby mode signal SBMS from the mode controller MCB and sequentially supplies the generated scan pulses to m gate lines GL1 to GLm. Then, the pixels connected to the gate line are sequentially driven in horizontal line units even in the standby mode.

In other words, the display device according to the fifth embodiment of the present invention does not have the gate switching unit GSW of the first embodiment and the gate driver GD of the fifth embodiment serves as the gate switching unit GSW. In the fifth embodiment, since the gate lines GL1 to GLm are separated even in the standby mode, the gate driver GD sequentially supplies the scan pulse to the gate lines GL1 to GLm to sequentially drive all the gate lines GL1 to GLm.

The standby mode driving unit SMD of the fifth embodiment of the present invention drives the data lines DL1 to DLn in the standby mode. That is, the standby mode driving unit SMD drives the data lines of the group and the common line CL so as to generate a potential difference between the data lines of at least one group and the common line CL in response to the standby mode signal SBMS. That is, the standby mode driving unit SMD of the fifth embodiment does not generate the above-described standby driving signal DRS_SB. This is because the standby driving signal DRS_SB is replaced with the scan pulses in the fifth embodiment. Therefore, the standby mode driving unit SMD increases or decreases the power supply voltage VCC received from the power supply of the system and generates a first standby display signal DPS1_SB and a second standby display signal DPS2_SB.

The standby mode driving unit SMD of the fifth embodiment of the present invention may further generate a gate high voltage and a gate low voltage in addition to the first standby display signal DPS1_SB and the second standby display signal DPS2_SB. In the standby mode, the gate high voltage and the gate low voltage generated by the standby mode driving unit are supplied to the gate driver GD. This gate driver generates the scan pulses using the gate high voltage and the gate low voltage.

In the standby mode, the gate lines GL1 to GLm may be simultaneously or sequentially driven, thereby displaying the standby screen with various colors as described above.

Although not shown, the gate driver GD and the standby mode driving unit SMD of the second to fourth embodiments may be replaced with the gate driver GD and the standby mode driving SMD of the fifth embodiment. In this case, the gate switching unit GSW of the second to fourth embodiments is eliminated.

In all the above-described embodiments, the data lines belonging to different groups may be connected when receiving the same standby display signal. For connection, the data switching unit DSW of each embodiment may further perform at least one of an operation for connecting at least two groups to connect the data lines included in the at least two groups to each other and an operation for connecting the data lines of at least one group and at least one of red, green and blue common lines to each other, as will be described in detail with reference to the figures.

Figure 17:
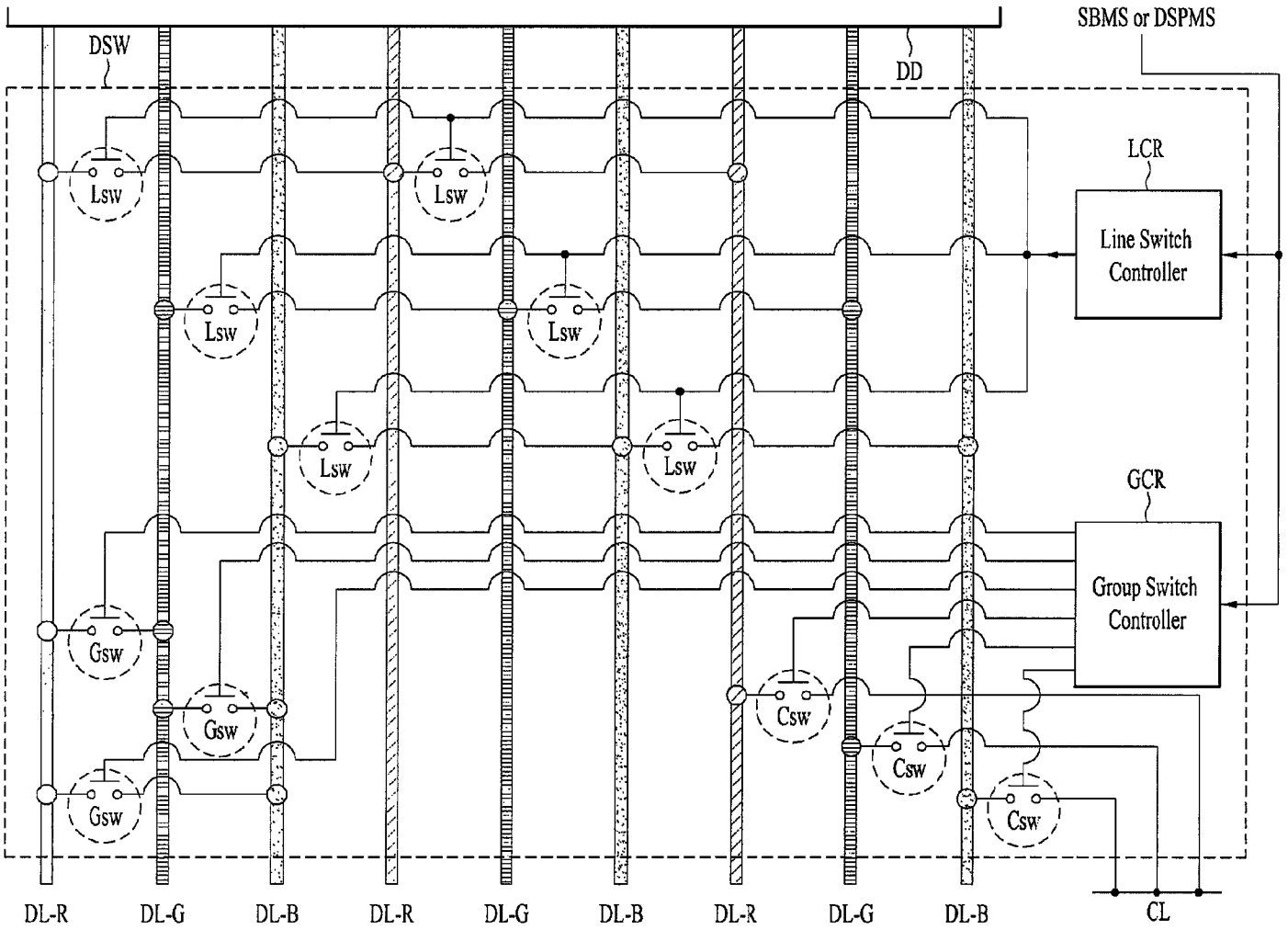
FIG. 17 is a diagram showing another structure of a data switching unit of FIG. 1.

FIG. 17 is a diagram showing another structure of the data switching unit DSW of FIG. 1.

The data switching unit DSW according to the embodiment of the present invention may include a plurality of line switching elements Lsw, a line switch controller LCR, a plurality of group switching elements Gsw, a plurality of common switching elements Csw and a group switch controller GCR as shown in FIG. 17.

The line switching element Lsw are connected between adjacent data lines in the same group. The line switching elements Lsw perform the same function as the data switching elements sw_d of FIG. 5. That is, the line switching elements Lsw may be grouped into three groups. For example, as shown in FIG. 17, the line switching elements Lsw may be divided into line switching elements Lsw connected between adjacent red data lines DL-R, line switching elements Lsw connected between adjacent green data lines DL-G and line switching elements Lsw connected between adjacent blue data lines DL-B.

The line switch controller LCR turns the line switching elements Lsw of each group on in response to the standard mode signal SBMS. The line switch controller LCR performs the same function as the data switch controller DCS of FIG. 5. That is, the line switch controller LCR turns all the line switching elements Lsw of each group on in response to the standby mode signal SBMS. That is, the line switch controller LCR generates a turn-on signal in response to the standby mode signal SBMS and simultaneously supplies the turn-on signal to all the line switching elements Lsw. The turn-on signal may be a constant voltage or a pulse voltage set to a threshold voltage or more of the line switching elements Lsw. The turned-on line switching elements Lsw connect the adjacent data lines of the same group to each other. Accordingly, if all the line switching elements Lsw are turned on, the data lines included in the same group are connected to each other.

The line switch controller LCR turns all the line switching elements Lsw off in response to the display mode signal DSPMS. The line switch controller LCR simultaneously supplies a turn-off signal to all the line switching elements Lsw in response to the display mode signal DSPMS. This turn-off signal may be a constant voltage or a pulse voltage which is set to be less than the threshold voltage of the line switching elements Lsw.

The group switching elements Gsw are connected between the data lines in the different groups. The group switching elements Gsw are divided into a group switching element Gsw connected between a red data line DL-R and a green data line DL-G, a group switching element Gsw connected between a green data line DL-G and a blue data line DL-B and a group switching element Gsw connected between a red data line DL-R and a blue data line DL-B.

The common switching elements Csw are connected between any one data line of each group and the common line CL. The common switching elements Csw are divided into a common switching element Csw connected between a red data line DL-R and the common line CL, a common switching element Csw connected between a green data line DL-G and the common line CL and a common switching element Csw connected between a blue data line DL-B and the common line CL.

The group switch controller GCR individually controls operations of the plurality of group switching elements Gsw and the common switching elements Csw based on the value of the standby mode signal SBMS. For example, as shown in FIG. 7*a*, if the binary value of the standby mode signal SBMS includes information indicating that the green data line DL-G, the blue data line DL-B and the common line CL receive the same second standby display signal DPS2_SB, the group switch controller GCR turns the group switching element Gsw connected between the green data line DL-G and the blue data line DL-B on, turns group switching element Gsw connected between the blue data line DL-B and the common line CL on, and turns the remaining group switching elements Gsw off. Then, the green data line DL-G, the blue data line DL-B and the common line CL are connected to each other. This is advantageous in view of signal synchronization between lines for transmitting the same standby display signal.

Although not shown in the figure, the data switching unit DSW of FIG. 8 may also have the structure shown in FIG. 17.

Although not shown in the figure, the data switching unit DSW of FIG. 10 may also have the structure shown in FIG. 17. However, since the display device of FIG. 10 includes two common lines, that is, the first and second common lines CL1 and CL2, the data switching unit DSW has a plurality of first common switching elements and a plurality of second common switching elements instead of the plurality of common switching elements Csw. At this time, the first common switching elements are connected between any one data line of each group and the first common line CL1. The second common switching elements are connected between any one data line of each group and the second common line CL2. For example, the first common switching elements may be divided into a first common switching element connected between a red/blue data line DL-RB and a first common line CL1, a first common switching element connected between a green/red data line DL-GR and a first common line CL1 and a first common switching element connected between a blue/green data line DL-BG and a first common line CL1. Similarly, the second common switching elements may be divided into a second common switching element connected between a red/blue data line DL-RB and a second common line CL2, a second common switching element connected between a green/red data line DL-GR and a second common line CL2 and a second common switching element connected between a blue/green data line DL-BG and a second common line CL2.

In this case, the group switch controller GCR individually controls operations of the plurality of group switching elements Gsw, the first common switching elements Csw and the second common switching elements Csw based on the value of the standby mode signal SBMS.

Although not shown in the figure, the data switching unit DSW of FIG. 13 may also have the structure shown in FIG. 16. However, since the display device of FIG. 13 includes three common lines, that is, the first to third common lines CL1 to CL3, the data switching unit DSW has a plurality of first common switching elements, a plurality of second common switching elements and a plurality of third common switching elements instead of the plurality of common switching elements. At this time, the first common switching elements are connected between any one data line of each group and the first common line CL1. The second common switching elements are connected between any one data line of each group and the second common line CL2. The third common switching elements are connected between any one data line of each group and the third common line CL3. For example, the first common switching elements may be divided into a first common switching element connected between a red/blue data line DL-RB and a first common line CL1, a first common switching element connected between a green/red data line DL-GR and a first common line CL1 and a first common switching element connected between a blue/green data line DL-BG and a first common line CL1. Similarly, the second common switching elements may be divided into a second common switching element connected between a red/blue data line DL-RB and a second common line CL2, a second common switching element connected between a green/red data line DL-GR and a second common line CL2 and a second common switching element connected between a blue/green data line DL-BG and a second common line CL2. Similarly, the third common switching elements may be divided into a third common switching element connected between a red/blue data line DL-RB and a third common line CL3, a third common switching element connected between a green/red data line DL-GR and a third common line CL3 and a second common switching element connected between a blue/green data line DL-BG and a third common line CL3.

In this case, the group switch controller GCR individually controls operations of the plurality of group switching elements Gsw, the first common switching elements Csw, the second common switching elements Csw and the third common switching elements Csw based on the value of the standby mode signal SBMS.

In order to prevent interference between the scan signal from the gate driver GD and the standby driving signal DRS_SB from the standby mode driving unit SMD or interference between the data voltage from the data driver DD and the standby display signal (the first standby display signal DPS1_SB or the second standby display signal DPS2_SB) from the standby mode driving unit SMD, the present invention may further include a gate connection controller and a data connection controller, which will be described in detail with reference to the figures.

Figure 18:
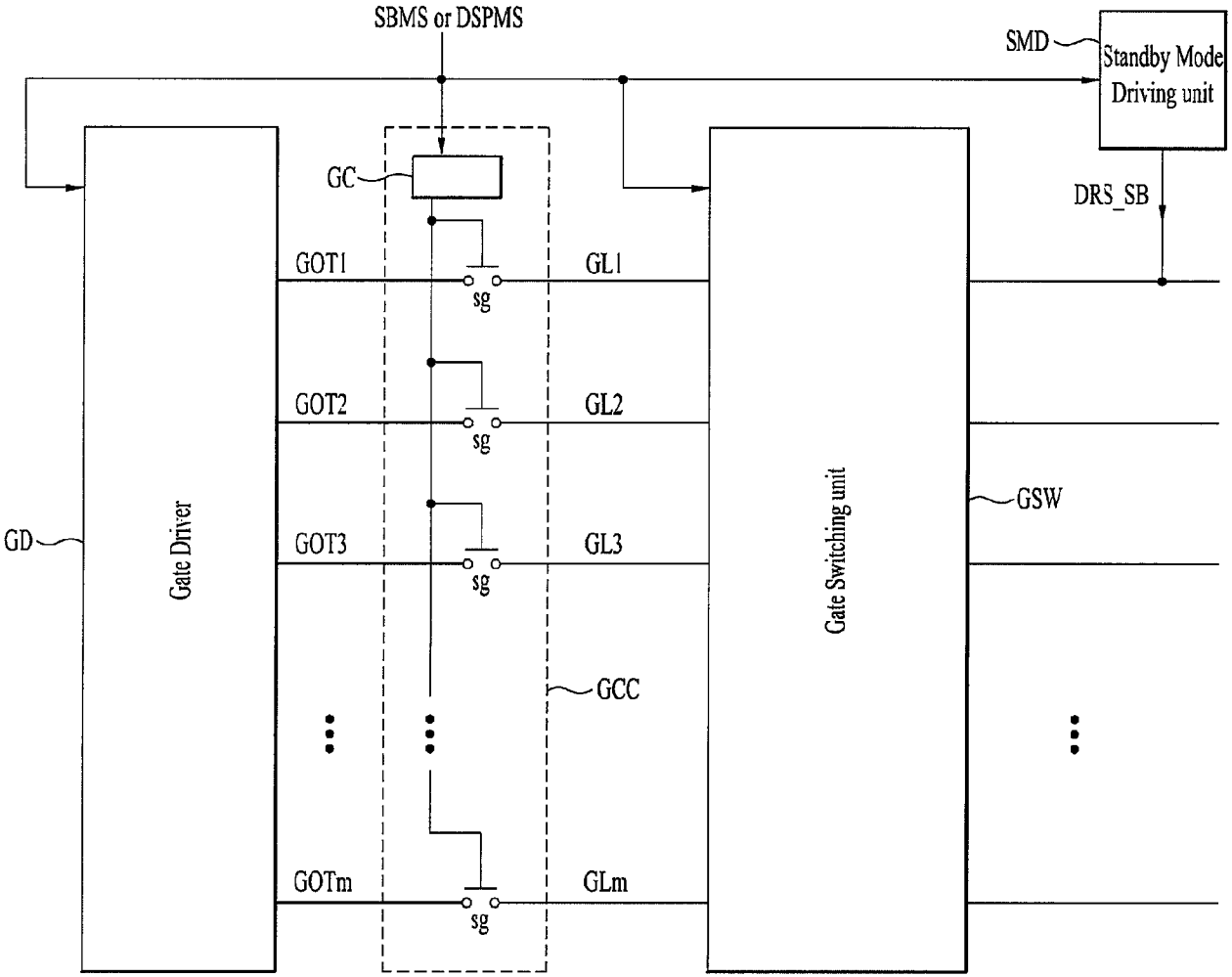
FIG. 18 is a diagram showing the detailed configuration of a gate connection controller.

FIG. 18 is a diagram showing the detailed configuration of the gate connection controller.

As shown in FIG. 18, the gate connection controller GCC is connected between gate output terminals GOT1 to GOTm of the gate driver GD and gate lines GL1 to GLm. The gate connection controller GCC electrically disconnects the gate output terminals GOT1 to GOTm and the gate lines GL1 to GLm in response to the standby mode signal SBMS from the mode controller MCB. In contrast, the gate connection controller GCC connects the gate output terminals GOT1 to GOTm and the gate lines GL1 to GLm in response to the display mode signal DSPMS from the mode controller MCB.

The gate connection controller GCC includes a plurality of gate connection switching elements sg and a gate controller GC as shown in FIG. 18.

Each gate connection switching element is connected between each of the gate output terminals GOT1 to GOTm and each of the gate lines GL1 to GLm.

The gate controller GC turns all the gate switching elements sw_g off in response to the standby mode signal SBMS. The gate controller GC generates a turn-off signal in response to the standby mode signal SBMS and simultaneously supplies the turn-off signal to all of the gate switching elements sw_g. Then, the electrical connection between the gate driver GD and the gate lines is broken. In contrast, the gate controller GC turns all the gate switching elements sw_g on in response to the display mode signal DSPMS. The gate controller GC generates a turn-on signal in response to the display mode signal DSPMS and simultaneously supplies the turn-on signal to all of the gate switching elements sw_g. Then, the gate driver GD and the gate lines are electrically connected.

The display device according to the fifth embodiment does not require the gate connection controller GCC. That is, the gate connection controller GCC may be further included in the display devices according to the first to fourth embodiments.

Figure 19:
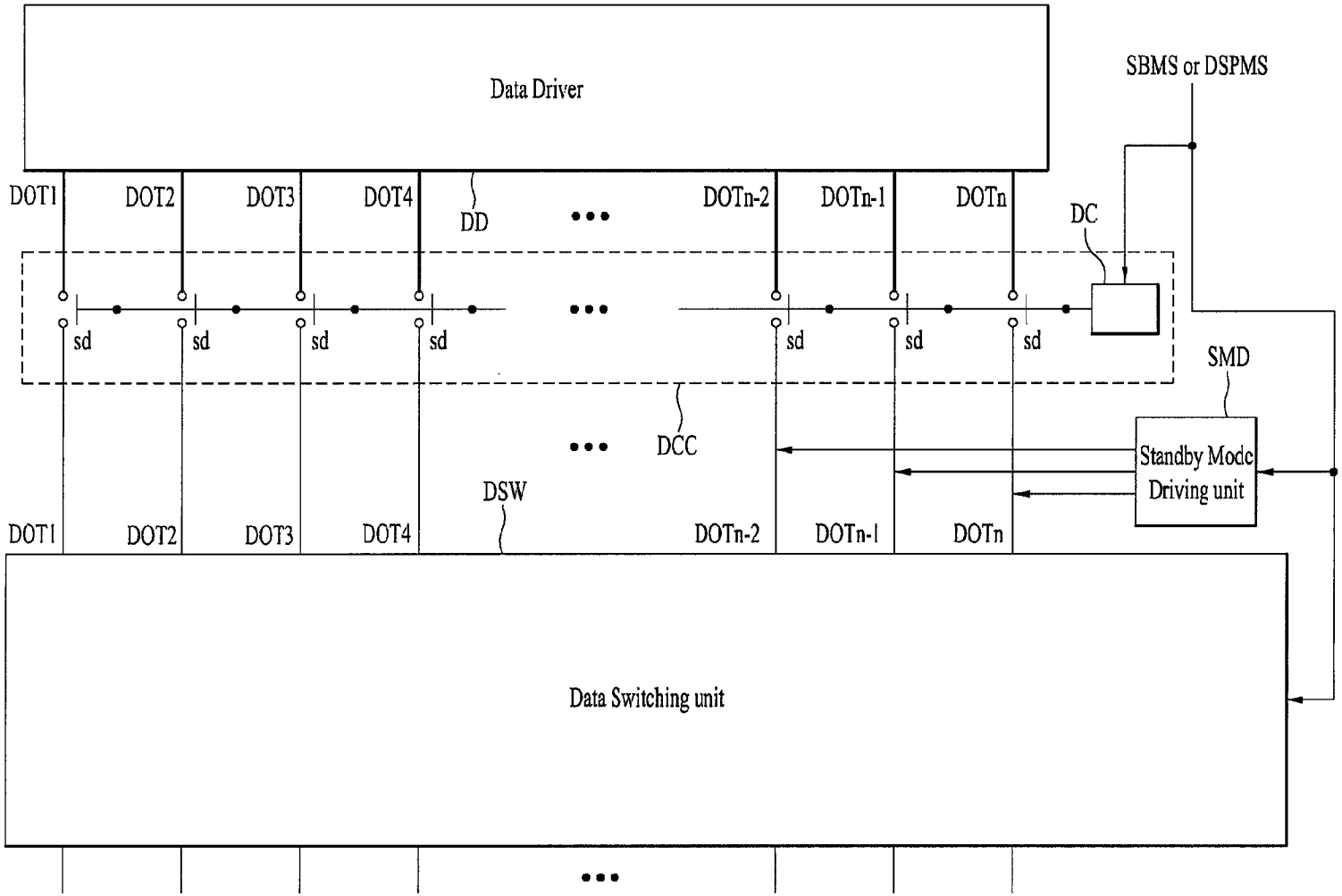
FIG. 19 is a diagram showing the detailed configuration of a data connection controller.

FIG. 19 is a diagram showing the detailed configuration of the data connection controller.

As shown in FIG. 19, the data connection controller DCC is connected between data output terminals DOT1 to DOTn of the data driver DD and data lines DL1 to DLn. The data connection controller DCC electrically disconnects the data output terminals DOT1 to DOTn and the data lines DL1 to DLn in response to the standby mode signal SBMS from the mode controller MCB. In contrast, the data connection controller DCC connects the data output terminals DOT1 to DOTn and the data lines DL1 to DLn in response to the display mode signal DSPMS from the mode controller MCB.

The data connection controller DCC includes a plurality of data connection switching elements sd and a data controller DC as shown in FIG. 19.

Each data connection switching element sd is connected between each of the data output terminals DOT1 to DOTn and each of the data line DL1 to DLn.

The data controller DC turns all the data switching elements sw_d off in response to the standby mode signal SBMS. The data controller DC generates a turn-off signal in response to the standby mode signal SBMS and simultaneously supplies the turn-off signal to all the data switching elements sw_d. Then, the electrical connection between the data driver DD and the data lines DL1 to DLn is broken. In contrast, the data controller DC turns all the data switching elements sw_d on in response to the display mode signal DSPMS. The data controller DC generates a turn-on signal in response to the display mode signal DSPMS and simultaneously supplies the turn-on signal to all the data switching elements sw_d. Then, the data driver DD and the data lines are electrically connected.

If the resistance of the gate driver GD and the resistance of the data driver DD are significantly large, the gate connection controller GCC and the data connection controller DCC may not be used.

The gate connection switching elements sg and the data connection switching elements sd may be controlled using only any one of the gate controller GC and the data controller DC.

In all the above-described embodiments, in order to enable the data lines of a group which receives the first standby display signal DPS1_SB to be in a floating state after a predetermined time, the standby mode driving unit SMD may further perform an operation for breaking the electrical connection between the data lines of the group and the standby mode driving unit SMD after the predetermined time.

That is, a standby driving signal generator for generating the above-described standby driving signal DRS_SB, a first standby display signal generator for generating the first standby display signal DPS1_SB and a second standby display signal generator for generating the second standby display signal DPS2_SB are included in the standby mode driving unit SMD. The first standby display signal generator includes a transmission control switch for transmitting the first standby display signal DPS1_SB to the data lines of each group and the common line(s). The transmission control switch may be automatically turned off when the above-described predetermined time has elapsed after the transmission control switch is turned on by the standby mode signal SBMS. Accordingly, the first standby display signal DPS1_SB may be supplied to the data lines of each group and the common line(s) only during the predetermined time from the time when the standby mode signal SBMS is generated. At this time, as the above-described predetermined time has elapsed and thus the transmission control switch is turned off, the connection between the output terminal of the first standby display signal generator and the line (the data line or the common line(s)) is broken and thus the line is maintained in the floating state. By stopping driving of the first display signal generator during the floating state, it is possible to slightly reduce power consumption. The turn-off operation of the transmission control switch may be performed after the disconnection of the data connection controller DCC.

Meanwhile, the line (the data line or the common line(s)) to which the first standby display signal DPS1_SB will be supplied may be maintained in the floating state from the beginning. For example, as shown in FIG. 7*a*, by maintaining the disconnection between the red data line DL-R and the first display signal generator without applying the first standby display signal DPS1_SB to the red data lines DL-R, the effect obtained by applying a specific voltage to the red data lines DL-R can be obtained. That is, the first standby display signal DPS1_SB may be replaced with the specific voltage. Such operation may be performed by turning the transmission control switch of the standby mode driving unit SMD off from the beginning, or maintaining disconnection between the line which will be in the floating state and the standby mode driving unit SMD from the beginning.

In the first to fourth embodiments, the standby driving signal and the first standby display signal may be the same signal. At this time, if the standby driving signal is applied to any one gate line in the standby mode and the first standby display signal is supplied to the data lines of any one group, the gate line and the data lines of any one group may be connected to each other. The gate line and one data line of any one group may be disconnected or connected by a separate line connection control switching element. The line connection control switching element may be controlled according to the turn-on signal or the turn-off signal from the gate switch controller (GSC of FIG. 4).

The display devices according to all the above-described embodiments may further include a luminous sensor (not shown) for sensing the intensity of external light.

In this case, the backlight unit BLU selects light having luminance lower than a predetermined reference value in response to the standby mode signal SBMS and then determines whether the light having low luminance is emitted or light having lower luminance is emitted based on the result sensed by the luminous sensor. For example, if the intensity of the light sensed by the luminous sensor is lower than the predetermined reference value, the backlight unit BLU emits the light having low luminance as it is. In contrast, if the intensity of the light sensed by the luminous sensor is higher than the predetermined reference value, the backlight unit BLU emits the light having lower luminance. Accordingly, it is possible to solve a problem that the standby screen is not easily seen if the intensity of external light is increased and the brightness of the standby screen displayed on the display screen is increased. That is, if the brightness of the screen is decreased in a bright place, the standby screen is relatively clearly seen.

The display device according to the present invention has the following effects.

First, in the present invention, the data lines are grouped into a plurality of groups in the standby mode to connect the data lines belonging to the same group and the data lines and the common line are driven so as to generate the potential difference between the data lines of at least one group and the common line, thereby displaying the standby screen with various colors on the display panel in the standby mode. Accordingly, it is possible to display the color matching an environment in which the display device is mounted.

Second, in the present invention, since the display panel is driven using the signals (the standby driving signal, the first standby display signal and the second standby display signal) generated by the standby mode driving unit in a state in which the driving device such as the gate driver, the data driver and the timing controller are turned off in the standby mode, it is possible to minimize power consumption during the display of the standby screen.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display device, comprising:

a display panel including a plurality of pixels, a plurality of gate lines and a plurality of data lines connected to the pixels, a first common line connected to some of the plurality of pixels, and a second common line connected to the remaining pixels;

a gate switching unit for connecting the gate lines to each other in response to an external standby mode signal;

a data switching unit for grouping the plurality of data lines into a plurality of groups in response to the standby mode signal and connecting the data lines belonging to the same group to each other; and a standby mode driving unit for driving the gate lines in response to the standby mode signal and driving the data lines of the groups, the first common line and the second common line to generate a potential difference between the data lines of at least one of the groups and at least one common line, wherein each of the groups respectively corresponds to all data lines of a same color, wherein each of the groups respectively corresponds to a different color, wherein the display device is capable of displaying a standby screen with various colors on the display panel, wherein the pixels are divided into a red pixel, a green pixel, and a blue pixel, wherein pixels each having two or more colors of red, green, and blue are connected to each data line, wherein the data switching unit groups the data lines connected to the pixels having the same color combination into one group, wherein the data lines include a plurality of red/blue data lines to which the red and blue pixels are connected, a plurality of green/red data lines to which the green and red pixels are connected, and a plurality of blue/green data lines to which the blue and green pixels are connected, and wherein the data switching unit groups the plurality of red/blue data lines into a first group, groups the plurality of plurality of green/red data lines into a second group, and groups the plurality of blue/green data lines into a third group.

2. The display device according to claim 1, wherein, in response to the standby mode signal, the standby mode driving unit:

supplies a standby driving signal to the gate lines;

supplies any one of a first standby display signal and a second standby display signal having different levels to the data lines of each group; and supplies any one of the first standby display signal and the second standby display signal to the first and second common lines to generate the potential difference between the data lines of at least one of the groups and the at least one common line.

3. The display device according to claim 2, wherein:

the standby driving signal and the first standby display signal are constant voltage signals; and the second standby display signal is an AC voltage signal periodically and alternately having a high voltage and a low voltage.

4. The display device according to claim 3, wherein the first standby display signal has a value between the high voltage and the low voltage.

5. The display device according to claim 3, wherein, to enable the data lines of a group that receives the first standby display signal to be in a floating state after a predetermined time, the standby mode driving unit further performs an operation for breaking an electrical connection between the data lines of the group and the standby mode driving unit after the predetermined time.

6. The display device according to claim 1, wherein, in response to the standby mode signal, the data switching unit further performs at least one of:

an operation for connecting at least two groups to connect the data lines included in the at least two groups to each other; and an operation for connecting the data lines of at least one group and at least one of the first and second common lines.

7. The display device according to claim 6, wherein the data switching unit includes:

a plurality of line switching elements connected between adjacent data lines in the same group;

a line switch controller for turning all the line switching elements of each group on in response to the standby mode signal;

a plurality of group switching elements connected between the data lines of different groups;

a plurality of first common switching elements connected between any one data line of each group and the first common line;

a plurality of second common switching elements connected between any one data line of each group and the second common line; and a group switch controller for individually controlling operations of the plurality of group switching elements and first and second common switching elements based on the value of the standby mode signal.

8. The display device according to claim 1, wherein:

the first common line is connected to pixels connected to odd numbered gate lines;

the second common line is connected to pixels connected to even numbered gate lines; and the standby mode driving unit applies different signals to the first common line and the second common line.

9. The display device according to claim 1, wherein, in response to the standby mode signal, the standby mode driving unit:

supplies a standby driving signal to the gate lines;

enables the data lines of at least one group to be in a floating state; and supplies a standby display signal to the data lines of the groups other than the at least one group and the at least one common line to generate the potential difference between the data lines of the at least one group and the at least one common line.

10. A display device, comprising:

a display panel including a plurality of pixels, a plurality of gate lines and a plurality of data lines connected to the pixels, and a plurality of common lines formed between adjacent data lines and connected to the pixels;

a gate switching unit for connecting the gate lines to each other in response to an external standby mode signal;

a data switching unit for grouping the plurality of data lines into a plurality of groups in response to the standby mode signal and connecting the data lines belonging to the same group to each other; and a standby mode driving unit for driving the gate lines in response to the standby mode signal and driving the data lines of the groups and the common lines to generate a potential difference between the data lines of at least one of the groups and at least one common line, wherein each of the groups respectively corresponds to all data lines of a same color, wherein each of the groups respectively corresponds to a different color, wherein the display device is capable of displaying a standby screen with various colors on the display panel, wherein the pixels are divided into a red pixel, a green pixel, and a blue pixel, wherein pixels each having two or more colors of red, green, and blue are connected to each data line, wherein the data switching unit groups the data lines connected to the pixels having the same color combination into one group, wherein the data lines include a plurality of red/blue data lines to which the red and blue pixels are connected, a plurality of green/red data lines to which the green and red pixels are connected, and a plurality of blue/green data lines to which the blue and green pixels are connected, and wherein the data switching unit groups the plurality of red/blue data lines into a first group, groups the plurality of plurality of green/red data lines into a second group, and groups the plurality of blue/green data lines into a third group.

11. The display device according to claim 10, wherein, in response to the standby mode signal, the standby mode driving unit:

supplies a standby driving signal to the gate lines;

supplies any one of a first standby display signal and a second standby display signal having different levels to the data lines of each group; and supplies any one of the first standby display signal and the second standby display signal to the common lines to generate the potential difference between the data lines of at least one of the groups and the at least one common line.

12. The display device according to claim 11, wherein:

the standby driving signal and the first standby display signal are constant voltage signals; and the second standby display signal is an AC voltage signal periodically and alternately having a high voltage and a low voltage.

13. The display device according to claim 12, wherein the first standby display signal has a value between the high voltage and the low voltage.

14. The display device according to claim 12, wherein, to enable the data lines of a group that receives the first standby display signal to be in a floating state after a predetermined time, the standby mode driving unit further performs an operation for breaking an electrical connection between the data lines of the group and the standby mode driving unit after the predetermined time.

15. The display device according to claim 11, wherein the plurality of common lines includes:

a first common line formed between the red/blue data line and the green/red data line and connected to red pixels;

a second common line formed between the green/red data line and the blue/green data line and connected to green pixels; and a third common line formed between the blue/green data line and the red/blue data line and connected to blue pixels.

16. The display device according to claim 15, wherein the standby mode driving unit supplies at least one of the first and second standby display signals to the first common line, the second common line, and the third common line in response to the standby mode signal.

17. The display device according to claim 15, wherein, in response to the standby mode signal, the data switching unit further performs at least one of:

an operation for connecting at least two groups to connect the data lines included in the at least two groups to each other; and an operation for connecting the data lines of at least one group and at least one of the first, second and third common lines.

18. The display device according to claim 17, wherein the data switching unit includes:

a plurality of line switching elements connected between adjacent data lines in the same group;

a line switch controller for turning all the line switching elements of each group on in response to the standby mode signal;

a plurality of group switching elements connected between the data lines of different groups;

a plurality of first common switching elements connected between any one data line of each group and the first common line;

a plurality of second common switching elements connected between any one data line of each group and the second common line;

a plurality of third common switching elements connected between any one data line of each group and the third common line; and a group switch controller for individually controlling operation of the plurality of group switching elements and first common switching elements, the second common switching elements, and the third common switching elements based on the value of the standby mode signal.

19. The display device according to claim 10, wherein, in response to the standby mode signal, the standby mode driving unit:

supplies a standby driving signal to the gate lines;

enables the data lines of at least one group to be in a floating state; and supplies a standby display signal to the data lines of the groups other than the at least one group and the at least one common line to generate the potential difference between the data lines of the at least one group and the at least one common line.

20. The display device according to claim 17, wherein:

the standby driving signal and the first standby display signal are the same; and the display device further includes a line connection control switching element for connecting any one gate line, to which the standby driving signal is applied, and any one data line, to which the first standby display signal is applied, to each other in response to the standby mode signal.

21. A display device, comprising:

a display panel including a plurality of pixels, a plurality of gate lines and a plurality of data lines connected to the pixels, and a common line connected to the pixels;

a gate driver for sequentially driving the plurality of gate lines in response to an external standby mode signal;

a data switching unit for grouping the plurality of data lines into a plurality of groups in response to the standby mode signal and connecting the data lines belonging to the same group to each other; and a standby mode driving unit for driving the data lines of the groups and the common line in response to the standby mode signal to generate a potential difference between the data lines of at least one of the groups and the common line, wherein each of the groups respectively corresponds to all data lines of a same color, wherein each of the groups respectively corresponds to a different color, wherein the display device is capable of displaying a standby screen with various colors on the display panel, wherein the pixels are divided into a red pixel, a green pixel, and a blue pixel, wherein pixels each having two or more colors of red, green, and blue are connected to each data line, wherein the data switching unit groups the data lines connected to the pixels having the same color combination into one group, wherein the data lines include a plurality of red/blue data lines to which the red and blue pixels are connected, a plurality of green/red data lines to which the green and red pixels are connected, and a plurality of blue/green data lines to which the blue and green pixels are connected, and wherein the data switching unit groups the plurality of red/blue data lines into a first group, groups the plurality of plurality of green/red data lines into a second group, and groups the plurality of blue/green data lines into a third group.

22. The display device according to claim 21, wherein:

the standby mode driving unit further generates a gate high voltage and a gate low voltage; and the gate high voltage and the gate low voltage are supplied to the gate driver.

* * * * *